US006746830B2

(12) United States Patent
Arakawa et al.

(10) Patent No.: US 6,746,830 B2
(45) Date of Patent: Jun. 8, 2004

(54) SILVER HALIDE PHOTOSENSITIVE MATERIAL AND IMAGE-FORMING METHOD USING HEAT-RESPONSIVE-DISCOLORABLE COLORING COMPOSITION

(75) Inventors: Jun Arakawa, Kanagawa-ken (JP); Takahiro Ishizuka, Kanagawa-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/279,823

(22) Filed: Oct. 25, 2002

(65) Prior Publication Data

US 2003/0186176 A1 Oct. 2, 2003

(30) Foreign Application Priority Data

Oct. 26, 2001 (JP) ..... 2001-329718

(51) Int. Cl.[7] ..... G03C 1/815

(52) U.S. Cl. ..... 430/350; 430/21; 430/339; 430/345; 430/351; 430/353; 430/510; 430/513; 430/531; 430/559; 430/566; 430/620

(58) Field of Search ..... 430/350, 339, 430/345, 351, 353, 566, 531, 21, 513, 510, 559, 620

(56) References Cited

U.S. PATENT DOCUMENTS 6,451,516 B1 * 9/2002 Irving et al. ..... 430/350

FOREIGN PATENT DOCUMENTS

JP 10-016410 * 1/1998

* cited by examiner

*Primary Examiner*—Thorl Chea
(74) *Attorney, Agent, or Firm*—Sughrue Mion, PLLC

(57) ABSTRACT

A silver halide photosensitive material having a substrate, a heat-responsive-discolorable coloring layer and a photosensitive layer coated thereon and having a silver halide, dye-providing compound and a binder, the heat-responsive-discolorable coloring layer containing a heat-responsive-discolorable coloring composition, which is colored at a temperature lower than its discoloration initiation temperature (T) of 60 to 200° C.; which is substantially discolored at a temperature equal to or higher than T; and which does not recover its color once discolored, even when its temperature is lowered to a temperature lower than T again, and the heat-responsive-discolorable coloring composition containing a polymer having a glass transition temperature of 60 to 200° C.

9 Claims, No Drawings

SILVER HALIDE PHOTOSENSITIVE MATERIAL AND IMAGE-FORMING METHOD USING HEAT-RESPONSIVE-DISCOLORABLE COLORING COMPOSITION

FIELD OF THE INVENTION

The present invention relates to a silver halide photosensitive material comprising a heat-responsive-discolorable coloring composition capable of rapidly forming high-quality image excellent in sharpness, color reproducibility and optical readability, and a method for forming image using the heat-responsive-discolorable coloring composition.

BACKGROUND OF THE INVENTION

To absorb a particular wavelength, a photosensitive silver halide emulsion layer, etc. of a photosensitive material is sometimes colored. For instance, when the spectroscopic composition of a light entering into a silver halide emulsion layer is controlled, a coloring layer is formed farther than the emulsion layer of the photosensitive material from a substrate. Such a coloring layer is also called "filter layer." When there are a plurality of photographic emulsion layers like a multi-layer color photosensitive material, the filter layer may be located between them.

A light scattered during passing through the emulsion layer or after penetrating the emulsion layer may be reflected on an interface between the emulsion layer and the substrate or a surface of the photosensitive material on the opposite side of the emulsion layer, and enters into the emulsion layer again, causing the blurring of image, called "halation." To prevent this halation, a coloring layer called "antihalation layer" is formed between the emulsion layer and the substrate, or on a surface of the substrate opposite to the emulsion layer side. In the case of the multi-layer color photosensitive material, an antihalation layer may also be formed between each set of adjacent layers.

These coloring layers are necessary only at the time of exposure, and unnecessary thereafter. Particularly when image information obtained on the photosensitive materials is read by a scanner, the existence of absorption by the coloring layer at a reading wavelength necessitates the reading of high-concentration information, resulting in the generation of noises. Accordingly, at least a part of the coloring layer is preferably discolored, namely its color is removed. Though discoloration can be carried out after exposure in the conventional, wet-treatment-type, photosensitive materials, such treatment cannot be conducted in a dry treatment, and thus the coloring layer should be discolored by other means.

With respect to discoloration of a coloring layer, several methods were proposed, and main methods among them are:

(1) Methods using a coloring layer comprising heat-decolorable dyes (U.S. Pat. Nos. 3,769,019, 3,821,001, 4,033,948, 4,088,497, 4,153,463 and 4,283,487, JP 52-139136 A, JP 53-132334 A, JP 54-56818 A, JP 57-16060 A and JP 59-182436 A, etc.), or dyes decolored by corrosive gases generated from counter salts while heating (U.S. Pat. No. 4,347,401, etc.), as an antihalation layer;

(2) Methods for discoloration of a coloring layer when heated in the presence of agents for generating carbanions by heating and dyes in the coloring layer (U.S. Pat. Nos. 5,135,842, 5,258,274, 5,314,795, 5,324,627 and 5,384,237, EP 605 286 B, JP 6-222504 A and JP 7-199409 A);

(3) Methods using dyes comprising leuco dyes and acids vaporizable or decomposable by heating for generating a color-developed state by their combination in an antihalation layer or a filter layer (JP 10-16410 A and JP 10-287055 A);

(4) Methods using a coloring layer comprising dyes discolored by light, such as an o-nitroarylidene dye or an o-nitro-o-azarylidene dye (U.S. Pat. Nos. 3,984,248 and JP 54-17833 A), dyes having cleavable N—O bonds (U.S. Pat. No. 3,770,451), chrominium-type cyanine dyes (JP 2-229864 A), anionic dyes containing iodonium salts as counter ions (JP 59-164549 A), etc., as an antihalation layer; and (5) Methods using a coloring layer comprising both (a) photosensitive halogen-containing compounds (JP 57-20734 A and JP 57-68831 A), azide compounds (JP 63-146028 A), ketone-based sensitizing compounds (JP 50-10618 A), mesoionic compounds (U.S. Pat. No. 4,548,895) or iodonium compounds (U.S. Pat. No. 4,701,402), and (b) dyes which are decolored by reaction with active species generated by irradiating and/or heating the above compounds, or by interaction with the above compounds in excited states.

The above methods (1) to (3) are easy because discoloration occurs when heated. However, a discoloration reaction is likely to occur during storage in these methods, failing to exhibit functions when necessary. For example, non-professional photographers often store photographic photosensitive materials under such a hard condition as in a car in the middle of summer, making it likely that the coloring layers of the photographic photosensitive materials are decolored by heat before their use. It has also been found that in a case where a reaction accompanied with gas generation at the time of heating is utilized, the gas likely forms bubbles, resulting in image defects.

The methods (4) and (5), in which discoloration occurs by light irradiation, are free from the above problems. However, because a large amount of irradiation rays are needed for discoloration in these methods, photo-discoloration is likely to occur, and it takes much time for the treatment.

Under these circumstances, JP 2002-006449 A proposes a method for discoloring a coloring layer by temperature elevation at the time of reading image information by a scanner after developing a photosensitive material at a high temperature, while fully permitting the coloring layer to exhibit its functions (filtration, antihalation, anti-irradiation, etc.) at around room temperature at which the photosensitive material is usually used. It has been found as a result of intense research, however, that because the scanner should be heated in this method, sensors such as CCD, etc. used in the scanner are affected by thermal noises, resulting in inevitable deterioration in the quality of image to be read. Also, because a reading part is controlled at a high temperature, the equipment is extremely expensive.

OBJECTS OF THE INVENTION

Accordingly, an object of the present invention is to solve the problems of the above prior art technologies, thereby providing a silver halide photosensitive material capable of reading image with high quality by a scanner, which comprising a heat-responsive-discolorable coloring layer containing a heat-responsive-discolorable coloring composition that is easily discolored by a dry treatment without image defects.

Another object of the present invention is to provide a method for forming an image using the heat-responsive-discolorable coloring composition.

SUMMARY OF THE INVENTION

As a result of intensive research in view of the above object, the inventors have found that by adding a polymer having a glass transition temperature (Tg) of 60° C. to 200° C. to a discolorable coloring composition, it is possible to obtain a heat-responsive-discolorable coloring composition, which is colored at a temperature lower than its discoloration initiation temperature (T) of 60° C. to 200° C. and substantially discolored at a temperature equal to or higher than the discoloration initiation temperature (T), and which does not recover its color once discolored, even when its temperature is lowered to a temperature lower than the discoloration initiation temperature (T) again. The present invention has been completed based on this finding.

Thus, the silver halide photosensitive material of the present invention is composed of a substrate, a heat-responsive-discolorable coloring layer and a photosensitive layer coated thereon, and the heat-responsive-discolorable coloring layer is composed of a heat-responsive-discolorable coloring composition. Further, the heat-responsive-discolorable coloring composition is colored at a temperature lower than its discoloration initiation temperature (T) and substantially discolored at a temperature equal to or higher than the discoloration initiation temperature (T), and does not recover its color once discolored, even when its temperature is lowered to a temperature lower than the discoloration initiation temperature (T) again. The discoloration initiation temperature (T) is 60° C. to 200° C., and the heat-responsive-discolorable coloring composition comprises a polymer having a glass transition temperature (Tg) of 60° C. to 200° C. The photosensitive layer comprises a silver halide, a dye-providing compound and a binder.

In the present invention, the heat-responsive-discolorable coloring composition preferably comprises at least an electron-donating, organic color former (coloring compound) at an acidic compound. The acidic compound is preferably a phenol compound. The above polymer is preferably in the form of dispersed particles having an average particle size of 0.01 μm to 1 μm. The photosensitive layer preferably comprises an organic silver salt. The heat-responsive-discolorable coloring composition preferably contains a hindered phenol.

The method for forming an image according to the present invention comprises the steps of exposing the silver halide photosensitive material of the present invention; and heating the exposed silver halide photosensitive material at 60 to 200° C. to form an image on the silver halide photosensitive material. The image formed on the silver halide photosensitive material can be optically read easily at a temperature of 60° C. or lower to produce digital image information.

DETAILED DESCRIPTION OF THE PREFERRED EMBODIMENTS

The silver halide photosensitive material of the present invention comprises a heat-responsive-discolorable coloring layer composed of heat-responsive-discolorable coloring composition, and a photosensitive layer comprising silver halide, a dye-providing compound and a binder, on a substrate. The photosensitive layer preferably comprises an organic silver salt, and the photosensitive material may comprise a development accelerator, a developing agent, a thermal solvent, a base precursor, various additives, etc. Detailed explanation will be made below with respect to the heat-responsive-discolorable coloring composition and other elements in the silver halide photosensitive material of the present invention, and a method for forming an image using the photosensitive material.

The "discoloration initiation temperature (T)" is defined herein as a temperature at which the heat-responsive-discolorable coloring composition reaches a middle concentration between a color concentration at 25° C. and a minimum color concentration (equilibrium color concentration), which would not decrease even with further temperature elevation. Specifically, the discoloration initiation temperature (T) is a temperature at which a light absorption ratio of the maximum absorption wavelength in the visible wavelength range (400 nm to 700 nm) is just middle between the light absorption ratio at 25° C. and the light absorption ratio in the minimum color concentration state. The term "discolored" used herein means that a coloring composition loses its color to an extent that its color concentration becomes 40% or less of that at 25° C. The term "does not recover its color" used herein means that even when it is lowered to a temperature lower than the discoloration initiation temperature (T) again after discolored, the color concentration does not return to more than 40% of that at 25° C.

[1] Heat-responsive-discolorable Coloring Composition

The heat-responsive-discolorable coloring layer contains the heat-responsive-discolorable coloring composition, which indispensably comprises a polymer having a glass transition temperature (Tg) of 60° C. to 200° C. The polymer is preferably in the form of dispersed particles having an average particle size of 0.01 μm to 1 μm. The heat-responsive-discolorable coloring composition preferably comprises at least an electron-donating, organic color former and an acidic compound. The acidic compound is preferably a phenol compound. The heat-responsive-discolorable coloring composition may further comprise a decoloring agent.

(A) Polymer

When the heat-responsive-discolorable coloring composition is heated to a temperature equal to or higher than the glass transition temperature (Tg) of the polymer, the polymer hinders interaction between the electron-donating color former and the color-developing agent, resulting in discoloration. Even when the discolored coloring composition is cooled to a lower temperature than the Tg again, the coloring composition does not recover its color, because the interaction between the electron-donating color former and the color-developing agent remains hindered because of the solidification of the polymer having Tg of 60° C. to 200° C. Thus, the polymer used in the present invention has a function to fix the reversible change of discoloration and color development by the electron-donating color former and the color-developing agent on the side of discoloration, namely to keep a discolored state. To exhibit this function effectively, the polymer preferably has a glass transition temperature (Tg) lower than a treatment temperature, more preferably as close to it as possible. Specifically a polymer having Tg of 60° C. to 200° C. is used in the present invention.

The polymer itself may function as a decoloring agent. In this case, because the polymer should keep a dispersed state before temperature elevation, the polymer is preferably in the form of dispersed particles, namely a polymer latex. The term "polymer latex" used herein means a dispersion obtained by dispersing a hydrophobic polymer insoluble in water as fine particles in an aqueous medium. The dispersed state may be any one of a state in which the polymer is emulsified in a dispersion medium, a state obtained by emulsion polymerization, a state obtained by micelle dispersion, a state in which the molecular chains of a polymer partially having a hydrophilic structure are dispersed on a molecule level, etc. The dispersed state is preferably a state in which the polymer is emulsified in a dispersion medium, a state obtained by emulsion polymerization, and a state in which the molecular chains of a polymer partially having a hydrophilic structure are dispersed on a molecule level, more preferably a state obtained by emulsion polymerization. The details of the polymer latex are described in Taira Okuda and Kan Inagaki, "Synthetic Resin Emulsion," issued by Kobunshi Kankokai, 1978; Soichi Muroi, "Chemistry of High-Molecular Latex," issued by Kobunshi Kankokai, 1970; etc.

Examples of polymers used in the polymer latex include acrylic resins, vinyl chloride resins, vinylidene chloride resins, polyolefin resins, condensed polymer resins such as polyurethane resins, polyester resins, polyamide resins, polyurea resins and polycarbonate resins, and copolymers thereof. Preferable among them are acrylic resins, vinyl chloride resins, vinylidene chloride resins, polyolefin resins and copolymers thereof, more preferably acrylic resins.

The polymer may be any of linear, branched or cross-linked polymers. It may be a homopolymer constituted by a single type of repeating units, or a copolymer constituted by plural types of repeating units. The number-average molecular weight of the polymer is advantageously 5,000 to 1,000,000, more advantageously 10,000 to 100,000. When the number-average molecular weight is less than 5,000, the heat-responsive-discolorable coloring layer tends to have insufficient strength. On the other hand, when it is more than 100,000, the heat-responsive-discolorable coloring composition is likely to have poor film-forming properties.

An average particle size of fine polymer particles in the polymer latex is preferably 0.01 to 1 $\mu$m, more preferably 0.01 to 0.5 $\mu$m, most preferably 0.02 to 0.3 $\mu$m. The particle size distribution of the fine polymer particles is not particularly limited, and either of those having a wide particle size distribution and those having a single-dispersion particle size distribution may be used.

The polymer particles in the polymer latex have a glass transition temperature (Tg) of 60° C. to 200° C., preferably 90° C. to 150° C. Tg can be measured by a differential-scanning calorimeter (DSC). Specifically, 10 mg of a sample is heated to 300° C. at a temperature elevation speed of 20° C./minute in a nitrogen stream, quenched to room temperature, and heated again at a temperature elevation speed of 20° C./minute, to measure a temperature at which a DSC curve starts to deviate from a base line and a temperature at which the DSC returns to a new base line temperature, the above two temperatures being arithmetically averaged to obtain Tg.

The polymer latex may be substantially uniform in an entire composition, or may be a so-called core/shell-type latex having different compositions in a center portion and an outer portion. To fully exhibit properties, the core/shell-type latex preferably has different Tg or degree of cross-linking in a core portion and a shell portion.

When their Tg is different, the difference in Tg between the core portion and the shell portion is preferably 30° C. or more. Though the core portion may have higher or lower Tg than that of the shell portion, it is preferable that the core portion has lower Tg than that of the shell portion. The core portion has Tg of preferably 60° C. to 200° C., more preferably 90° C. to 150° C. To provide the core portion and the shell portion with different Tg, different resins may be used for the core portion and the shell portion.

When the core portion and the shell portion have different degrees of cross-linking, it is preferable that one is cross-linked, while the other is not cross-linked, and it is more preferable that the core portion is cross-linked, while the shell portion is not cross-linked. Though monomers constituting the core portion and the shell portion may be at any mass ratio, the monomer mass ratio of the core portion to the shell portion is preferably 20/80 to 80/20, more preferably 50/50 to 70/30 for good film-forming properties.

Explained below as an example is a vinyl polymer latex. The polymer may be a homopolymer of any monomer selected from monomers exemplified below or a copolymer of arbitrarily combined monomers. There are no particular restrictions in usable monomer units, and any monomers can be used as long as they are polymerizable by usual radical polymerization methods.

(a) Monomers (1) Olefins

Ethylene, propylene, isoprene, butadiene, chloroethylene, vinylidene chloride, 6-hydroxy-1-hexene, cyclopentadiene, 4-pentenoic acid, methyl 8-nonenoate, vinyl sulfone acid, trimethylvinylsilane, trimethoxy vinylsilane, butadiene, pentadiene, isoprene, 1,4-divinylcyclohexane, 1,2,5-trivinylcyclohexane, etc.

(2) $\alpha,\beta$-unsaturated Carboxylic Acids and Their Salts

Acrylic acid, methacrylic acid, itaconic acid, maleic acid, sodium acrylate, ammonium methacrylate, potassium itaconate, etc.

(3) $\alpha,\beta$-unsaturated Carboxylic Esters

Alkyl acrylates such as methyl acrylate, ethyl acrylate, t-butyl acrylate and adamantyl acrylate; substituted alkyl acrylates such as 2-chloroethyl acrylate, benzyl acrylate, 2-cyanoethyl acrylate and allyl acrylate; alkyl methacrylate such as methyl methacrylate, t-butyl methacrylate and adamantyl methacrylate; substituted alkyl methacrylates such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, $\omega$-methoxy polyethylene glycol methacrylate (mol of polyoxyethylene added: 2 to 100), polyethylene glycol monomethacrylate (mol of polyoxyethylene added: 2 to 100), polypropylene glycol monomethacrylate (mol of polyoxypropylene added: 2 to 100), 2-carboxyethyl methacrylate, 3-sulfopropyl methacrylate, 4-oxysulfo butyl methacrylate, 3-trimethoxysilyl propyl methacrylate and allyl methacrylate; derivatives of unsaturated dicarboxylic acids such as monobutyl maleate, dimethyl maleate, monomethyl itaconate and dibutyl itaconate; multifunctional esters such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate and 1,2,4-cyclohexane tetramethacrylate; etc.

(4) Amides of $\alpha,\beta$-unsaturated Carboxylic Acids

Acrylamide, methacrylamide, N-methylacrylamide, N,N-dimethylacrylamide, N-methyl-N-hydroxyethyl methacrylamide, N-tert-butylacrylamide, N-tert-octyl methacrylamide, N-cyclohexyl acrylamide, N-phenyl acrylamide, N-(2-acetoacetoxyethyl)acrylamide, N-acryloyl morpholine, diacetone acrylamide, diamide of itaconic acid, N-methyl maleimide, 2-acrylamide-2-methylpropanesulfonic acid, methylene bisacrylamide, dimethacryloyl piperazine, etc.

(5) Styrene and Derivatives Thereof

Styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrene sulfinate, 1,4-divinylbenzene, 4-vinylbenzoic acid-2-acryloyl ethyl ester, etc.

(6) Vinyl Ethers

Methyl vinyl ether, butyl vinyl ether, methoxyethyl vinyl ether, etc.

(7) Vinyl Esters

Vinyl acetate, vinyl propionate, vinyl benzoate, vinyl salicylate, vinyl chloroacetate, etc.

(8) Other Monomers

N-vinylpyrrolidone, 2-vinyl oxazoline, 2-isopropenyl oxazoline, divinyl sulfone, etc.

(b) Specific Examples of Polymers

Specific examples (P-1 to P-29) of polymers in polymer latexes usable for the present invention will be described below without intention of restriction. In the case of copolymers, ratios in parentheses represent the mass ratios of monomers.

P-1) Poly(t-butyl methacrylate) with Tg of 118° C.,

P-2) Polyphenyl methacrylate with Tg of 110° C.,

P-3) Polymethyl methacrylate with Tg of 105° C.,

P-4) Polyacrylonitrile with Tg of 125° C.,

P-5) Polypentachlorophenyl acrylate with Tg of 147° C.,

P-6) Polyadamantyl methacrylate with Tg of 140° C.,

P-7) Poly(t-butyl methacrylamide) with Tg of 160° C.,

P-8) Polystyrene with Tg of 100° C.,

P-9) Polymethacrylonitrile with Tg of 120° C.,

P-10) Acrylonitrile-methacrylic acid copolymer (95:5) with Tg of 123° C.,

P-11) Methyl methacrylate-acrylic acid copolymer (97:3) with Tg of 104° C.,

P-12) Methacrylonitrile-acrylic acid copolymer (95:5) with Tg of 104° C.,

P-13) Methyl methacrylate-acrylic acid copolymer (95:5) with Tg of 100° C.,

P-14) Polyvinyl chloride with Tg of 93° C.,

P-15) Acrylonitrile-ethyl acrylate copolymer (70:30) with Tg of 68° C.,

P-16) Polyethyl methacrylate with Tg of 65° C.,

P-17) Polyisopropyl methacrylate with Tg of 81° C.,

P-18) Polyisobutyl chloroacrylate with Tg of 90° C.,

P-19) Isopropyl methacrylate-acrylic acid copolymer (96:4) with Tg of 80° C.,

P-20) Acrylonitrile-butyl acrylate copolymer (80:20) with Tg of 79° C.,

P-21) Adamantyl methacrylate-methyl methacrylate-acrylic acid copolymer (60:35:5) with Tg of 110° C., P-22) Copolymer of methacrylonitrile, ester of polyethylene glycol monomethyl ether and methacrylic acid (the number of ethyleneoxy chain repetition units: 23), and acrylic acid (90:8:2) with Tg of 104° C., P-23) Methyl methacrylate-divinylbenzene copolymer (97:3) with Tg of 101° C., P-24) Methyl methacrylate-styrenesulfonic acid copolymer (92:8) with Tg of 105° C., P-25) Methyl methacrylate-ethylene glycol dimethacrylate copolymer (95:5) with Tg of 101° C., P-26) Polystyrene-divinylbenzene copolymer (95:5) with Tg of 100° C. for core portion, and methyl methacrylate-methacrylic acid copolymer (97:3) with Tg of 101° C. for shell portion, P-27) Poly(4-chlorostyrene) with Tg of 115° C. for core portion, and acrylonitrile-butyl acrylate-methacrylic acid copolymer (80:17:3) with Tg of 81° C. for shell portion, P-28) Polystyrene with Tg of 100° C. for core portion, and methyl methacrylate-methacrylic acid copolymer (97:3) with Tg of 101° C. for shell portion, and P-29) Poly(4-butylstyrene) with Tg of 7° C. for core portion, and methyl methacrylate-methacrylic acid copolymer (97:3) with Tg of 101° C. for shell portion.

(B) Electron-donating, Organic Color Former

The electron-donating, organic color formers preferably used in the present invention are known in the art, and they are not particularly restrictive. The known electron-donating, organic color formers are described in Moriga and Yoshida, "Dyestuff & Chemicals," Vol. 9, page 84 issued by Kaseihin Kogyo Kyokai (1964), "Handbook of Dyes, New Edition," page 242, issued by Maruzen Co., Ltd. (1970), R. Garner, "Reports on the Progress of Appl. Chem." Vol. 56, page 199 (1971), "Dyestuff & Chemicals" Vol. 19, page 230 issued by Kaseihin Kogyo Kyokai (1974), "Coloring Matters" Vol. 62, page 288 (1989), "Dyeing Industry," Vol. 32, page 208, etc.

The electron-donating, organic color formers are classified into several groups in accordance with their structures. Preferable examples of the electron-donating, organic color formers used in the present invention include diarylphthalide compounds, fluoran compounds, indolylphthalide compounds, acyl leucoazine compounds, leuco auramine compounds, spiropyran compounds, rhodamine lactam compounds, triarylmethane compounds and chromene compounds. Specific examples of the electron-donating, organic color formers usable in the present invention will be illustrated below in structural formulae.

(a) Diarylphthalide compounds (1)

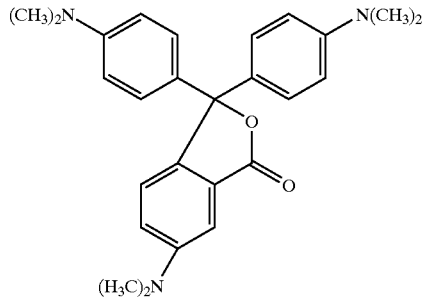

(2)

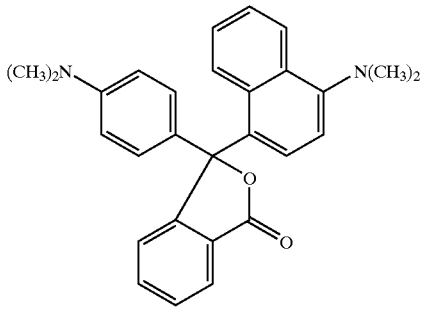

-continued
(3)
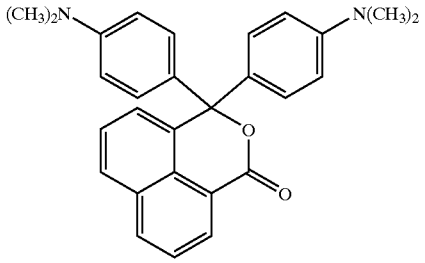
(4)
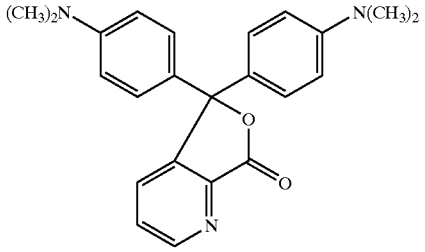
(b) Fluoran compounds
(5)
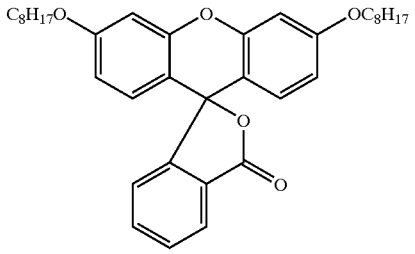
(6)
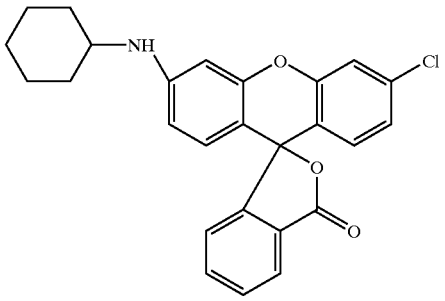
(7)
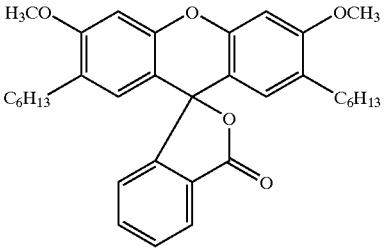
(8)
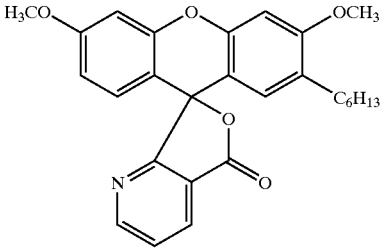
-continued
(9)
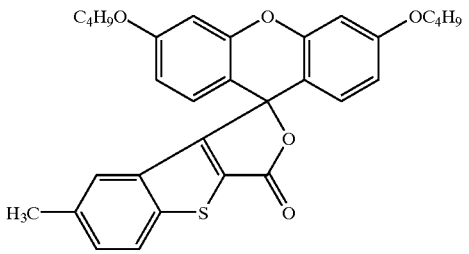
(10)
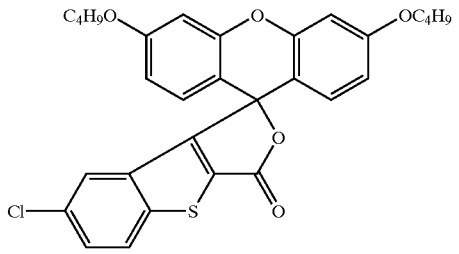
(11)
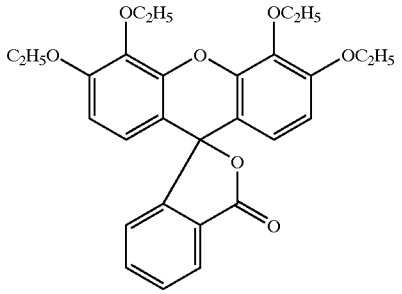
(12)
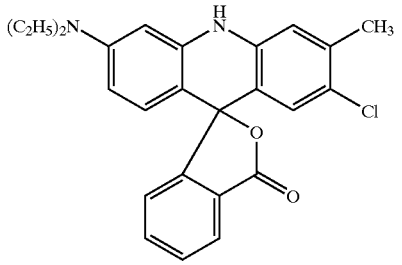
(13)
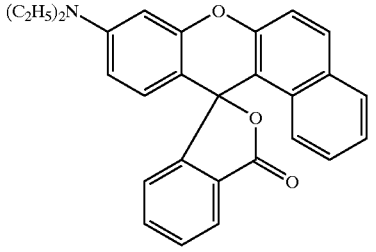

-continued
(14)
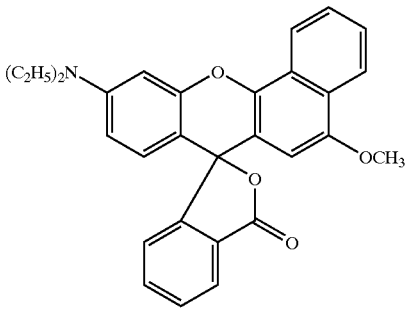
(15)
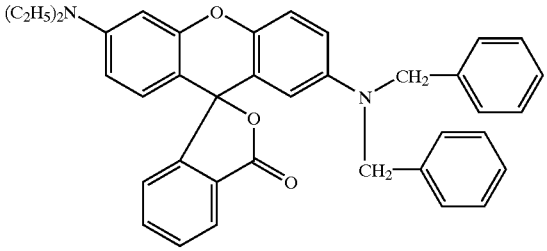
(16)
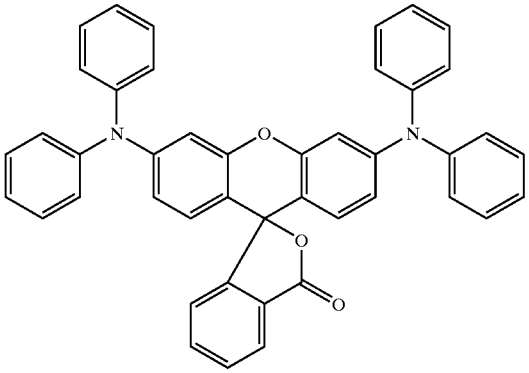
(17)
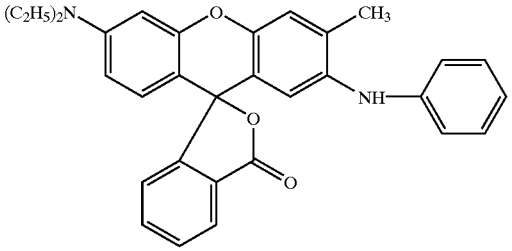
(18)
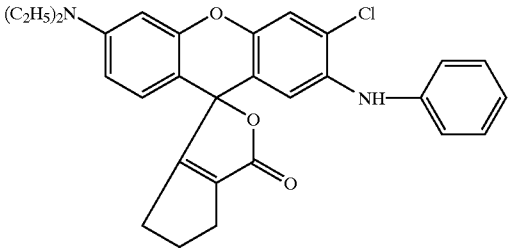
-continued
(19)
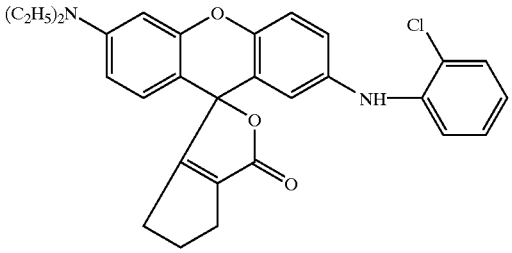
(20)
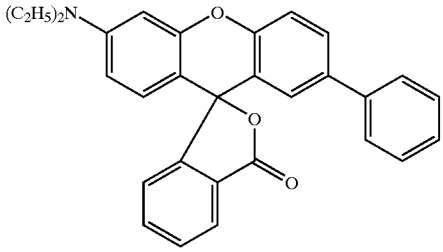
(21)
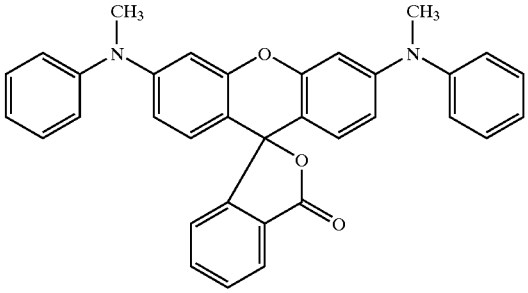
(c) Indolylphthalide compounds
(22)
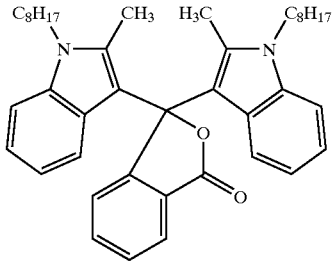
(23)
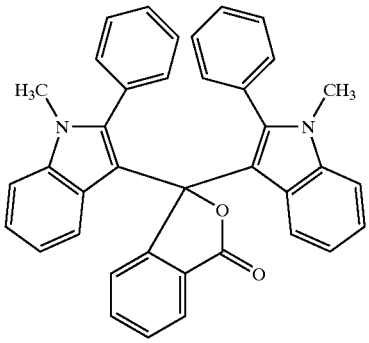

-continued
(24)
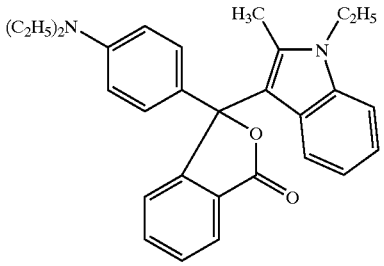
(25)
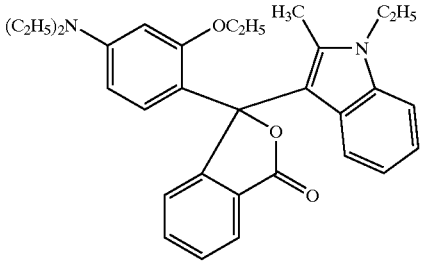
(26)
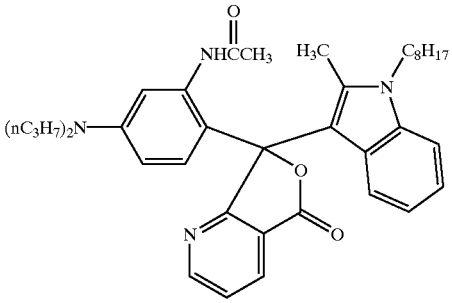
(27)
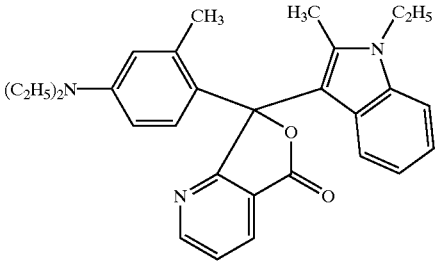
(28)
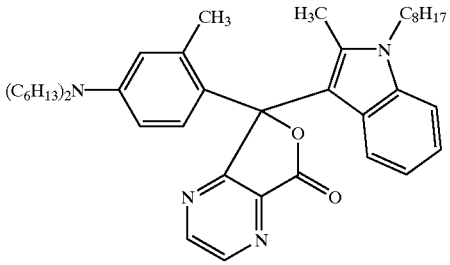
-continued
(29)
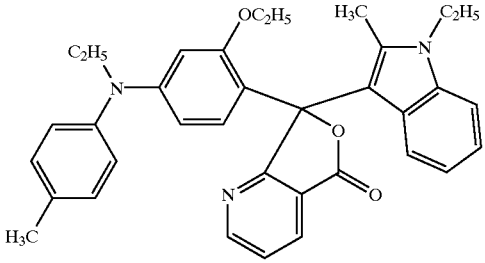
(30)
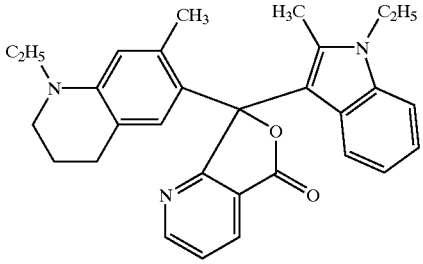
(31)
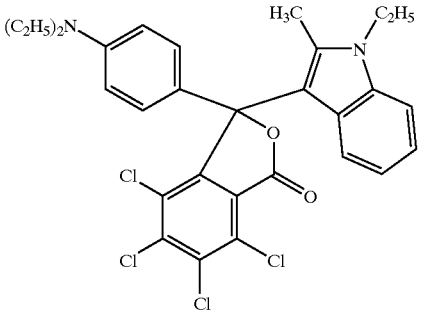
(d) Acyl leucoazine compounds
(32)
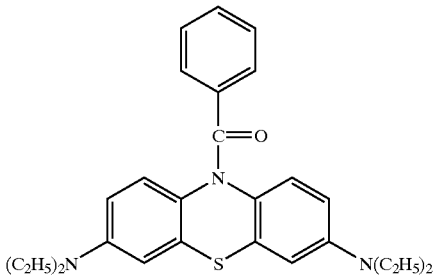
(33)
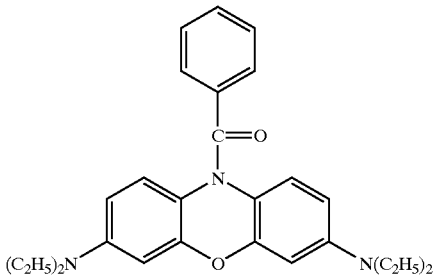
(34)
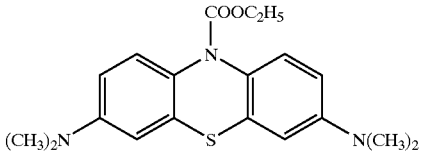

-continued
(35)
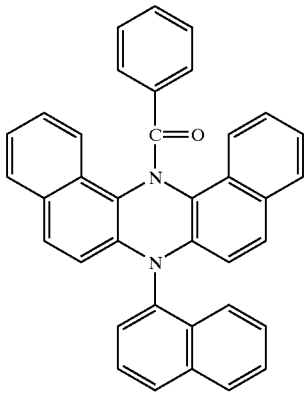
(e) Leuco auramine compounds
(36)
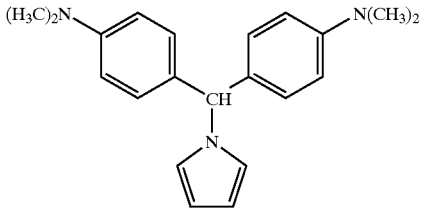
(37)
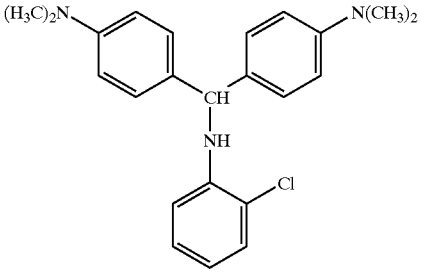
(38)
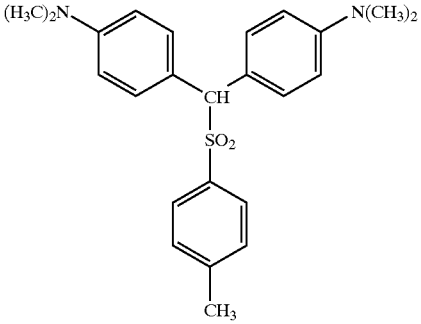
(39)
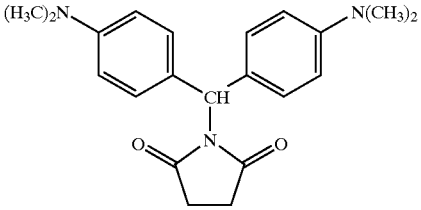
-continued
(f) Spiropyran compounds
(40)
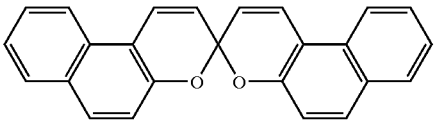
(41)
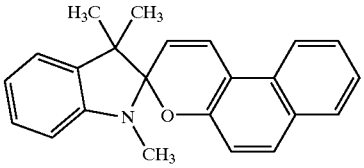
(g) Rhodamine lactam compounds
(42)
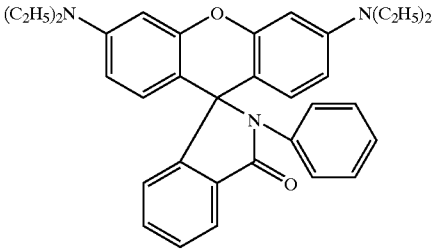
(43)
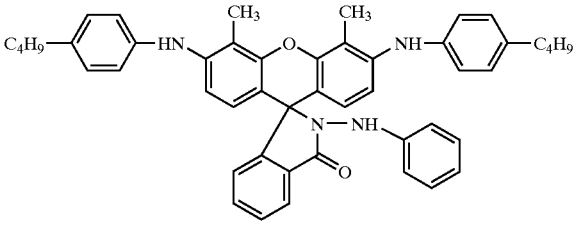
(h) Triarylmethane compounds
(44)
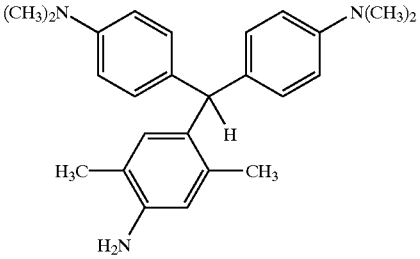
(45)
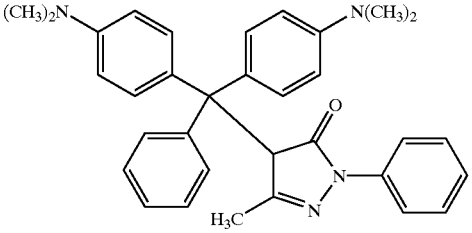

-continued (46)

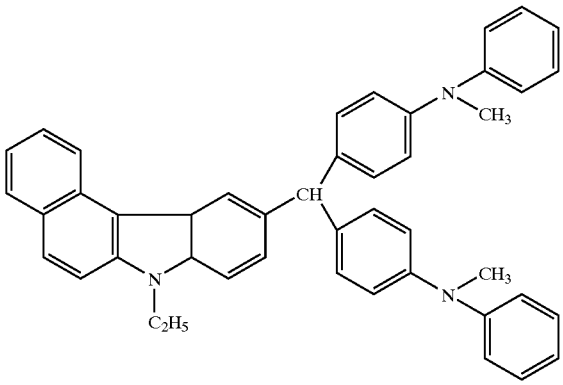

(47)

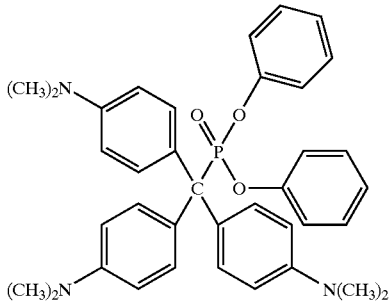

(i) Chromene compounds (48)

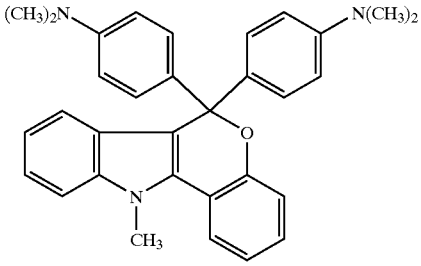

(49)

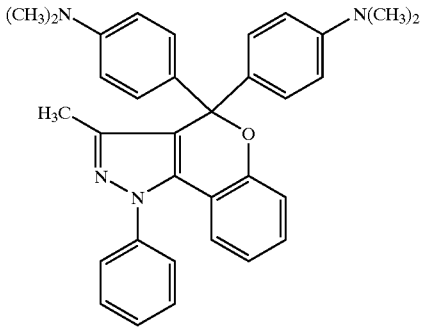

-continued (50)

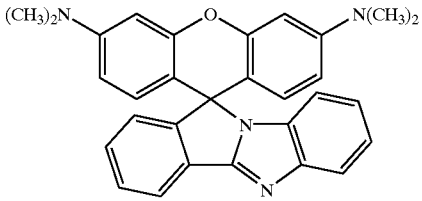

(j) Other compounds (51)

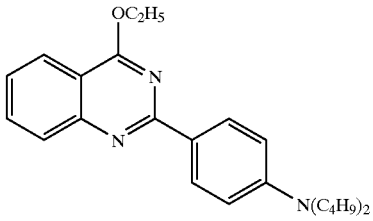

(52)

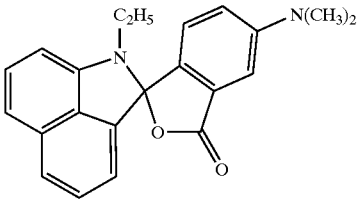

(53)

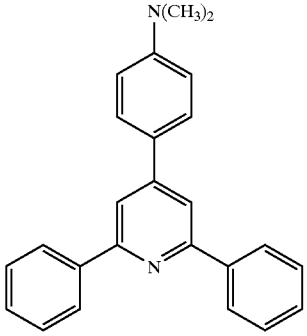

When laser light sources such as semiconductor laser sources, etc. widely used at present are used, it is possible to use electron-donating, organic color formers that cause color development in a range of wavelength longer than 620 nm. Examples of such electron-donating, organic color formers include 2,6-diaminofluoran compounds having a ring structure at 2- and 3-positions disclosed in JP 3-14878 A, JP 3-244587 A and JP 4-173288 A; fluoran compounds having a substituent comprising p-phenylenediamine moiety disclosed in JP 61-284485 A and JP 3-239587 A; thiofluoran compounds disclosed in JP 52-106873 A; 3,3-bis(4-substituted aminophenyl) azaphthalide compounds disclosed in JP 5-139026 A and JP 5-179151 A; phthalide compounds having a vinyl group disclosed in JP 58-5940 B, JP 58-27825 B and JP 62-24365 B; fluorene compounds disclosed in JP 63-94878 A and JP 3-202386 A; sulfonylmethane compounds having a vinyl group disclosed in JP 60-230890 A and JP 60-231766 A; and compounds having a phenothiazine or phenoxazine ring disclosed in JP 63-199268 A. Specific examples of the electron-donating, organic color formers preferably used in the present invention will be illustrated below.

(54)
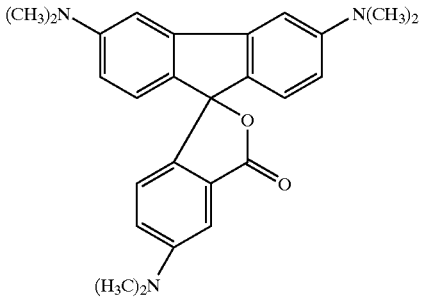
(55)
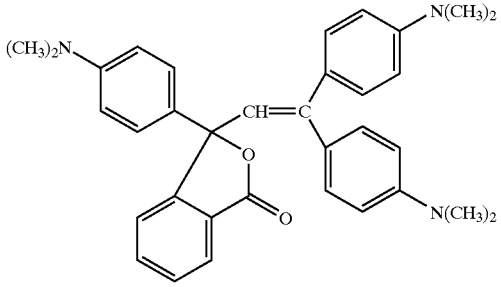
(56)
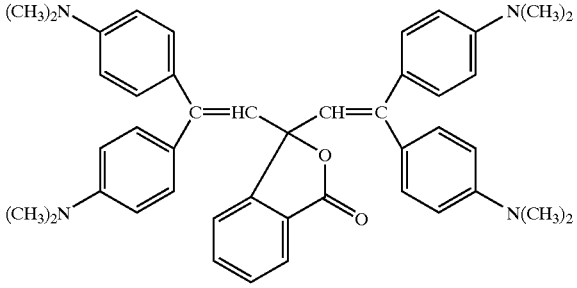
(57)
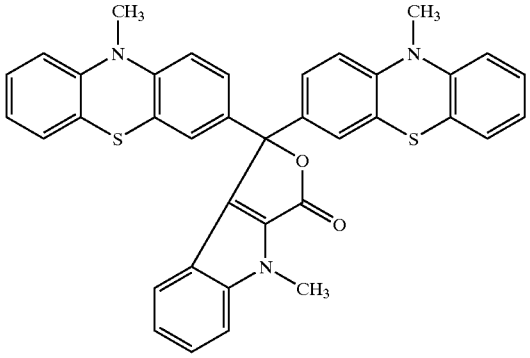
(58)
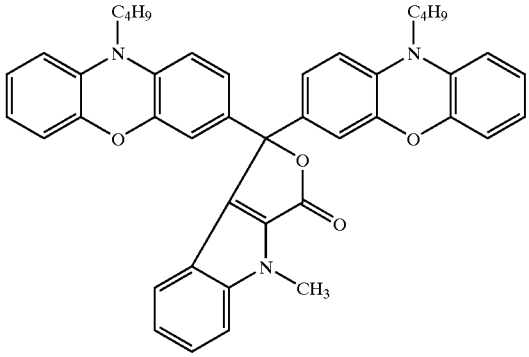
(59)
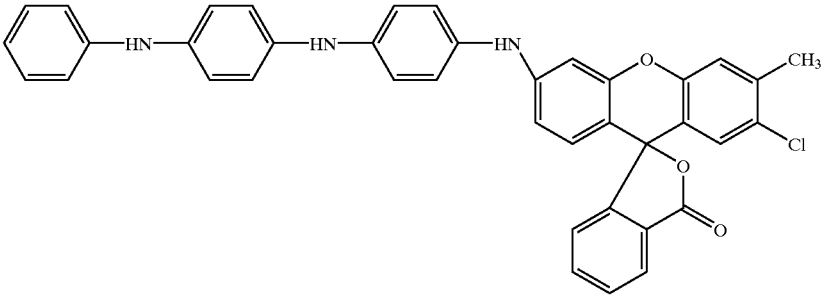
(60)
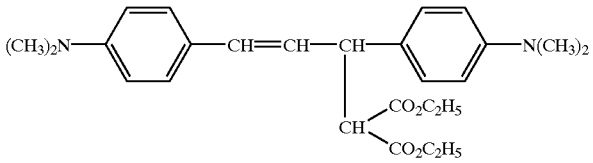
(61)
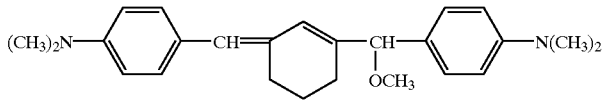

-continued (62)

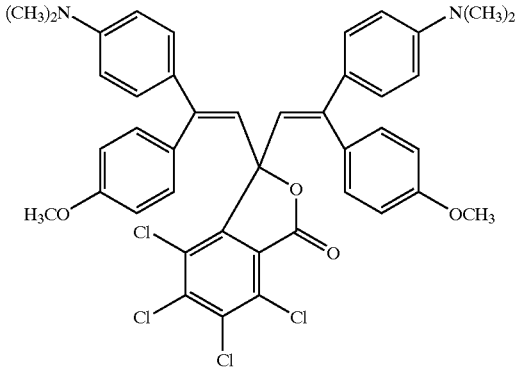

(63)

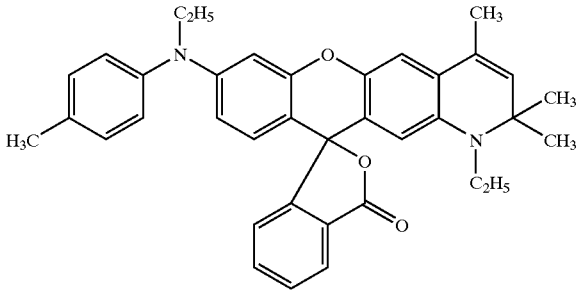

(64)

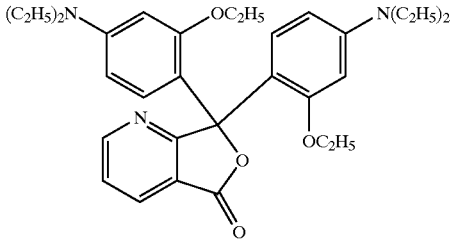

(65)

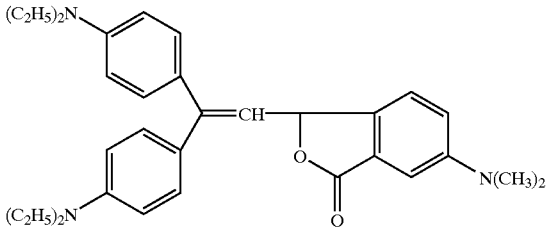

(66)

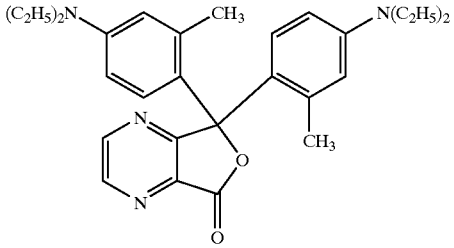

(67)

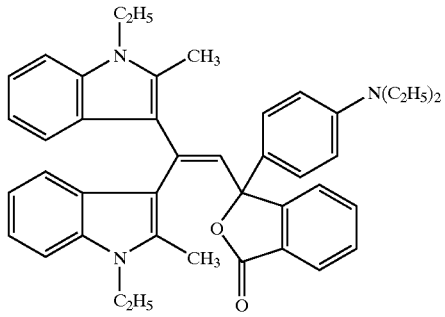

It should be noted that the above specific examples are only part of the electron-donating, organic color formers, and that the electron-donating, organic color formers used in the present invention are not limited thereto. The electron-donating, organic color formers may be used alone or in combination.

(C) Acidic Compounds

The acidic compound acts as a color-developing agent, specifically having a function to cause the above electron-donating, organic color former to develop color. The preferred acidic compounds are phenol compounds. The acidic compounds may be used alone or in combination. For instance, phenol compounds and other acidic compounds than phenol compounds may be combined. Phenol compounds and other acidic compounds than phenol compounds will be described in detail below.

(a) Phenol Compounds

The phenol compounds may be any of monovalent phenols, divalent phenols and polyvalent phenols, and may have substituents on their benzene ring, such as alkyl groups, aryl groups, acyl groups, alkoxycarbonyl groups, carboxyl groups and esters thereof, amide groups, halogens, etc. The phenol compound may have a bisphenol structure or a trisphenol structure.

Preferred examples of the phenolic color-developing agents include, phenol, o-cresol, tert-butylphenol, nonylphenol, n-octyl phenol, n-dodecyl phenol, n-stearyl phenol, p-chlorophenol, p-bromophenol, o-phenylphenol, n-butyl p-hydroxybenzoate, n-octyl p-hydroxybenzoate, n-dodecyl p-hydroxybenzoate, resorcin, dodecyl gallate, 2,2-bis(4'-hydroxyphenyl)propane, 4,4'-dihydroxydiphenylsulfone, 1,1-bis(4'-hydroxyphenyl)ethane, 2,2-bis(4'-hydroxy-3-methylphenyl)-propane, bis(4'-hydroxyphenyl)methane, bis(4-hydroxyphenyl)sulfide, 1-phenyl-1,1-bis(4'-hydroxyphenyl)ethane, 1,1-bis(4'-hydroxyphenyl)-3-methylbutane, 2,2-bis(4'-hydroxyphenyl)butane, 2,2-bis(4'-hydroxyphenyl)ethyl propionate, 2,2-bis(4'-hydroxyphenyl)-4-methylpentane, 1,1-bis(4'-hydroxyphenyl)-2-methylpropane, 2,2-thiobis(6-tert-butyl-3-methylphenol), 2,2-bis(4'-hydroxyphenyl)hexafluoropropane, 1,1-bis(4'-hydroxyphenyl)-n-pentane, 1,1-bis(4'-hydroxyphenyl)-n-hexane, 1,1-bis(4'-hydroxyphenyl)-n-heptane, 1,1-bis(4'-hydroxyphenyl)-n-octane, 1,1-bis(4'-hydroxyphenyl)-n-nonane, 1,1-bis(4'-hydroxyphenyl)-n-decane, 1,1-bis(4'-hydroxyphenyl)-n-dodecane, 1,1-bis(4'-hydroxyphenyl)-4-methylbutane, 2,2-bis(4'-hydroxyphenyl)-n-heptane, 2,2-bis(4'-hydroxyphenyl)-n-nonane, 1,1-bis(3'-methyl-4'-hydroxyphenyl)-n-hexane, etc. These phenolic color developing agents may be used alone or in combination.

(b) Other Acidic Compounds than Phenol Compounds

Preferred examples of other acidic compounds than phenol compounds include boric acid, oxalic acid, maleic acid, tartaric acid, citric acid, succinic acid, benzoic acid, stearic acid, gallic acid, salicylic acid, 1-hydroxy-2-naphthoic acid, o-hydroxybenzoic acid, m-hydroxybenzoic acid, 2-hydroxy-p-toluic acid, benzenesulfinic acid, anthraquinone-1-sulfenic acid, etc. These compounds may comprise various substituents.

(D) Decoloring Agents

The heat-responsive-discolorable coloring composition used in the present invention preferably contains a decoloring agent for the purpose of accelerating discoloration by temperature elevation. Preferably usable as the decoloring agent are compounds functioning as decoloring agents at high temperatures, such as alcohols, esters, ketones, ethers, etc. Polymers and oligomers containing these compounds as repeating units are also effective.

(a) Alcohols

Specific examples of alcohols include decane-1-ol; undecane-1-ol; lauryl alcohol; tridecane-1-ol; myristyl alcohol; pentadecane-1-ol; cetyl alcohol; heptadecane-1-ol; stearyl alcohol; octadecane-2-ol; eicosane-1-ol; docosane-1-ol; 6-(perfluoro-7-methyloctyl)hexanol; cyclododecanol; 1,4-cyclohexanediol, 1,2-cyclohexanediol; 1,2-cyclododecanediol; sterol compounds such as cholesterol, stigmasterol, pregnenolone, methylandrostenediol, estradiol benzoate, epiandrostene, stenolone, β-sitosterol, pregnenolone acetate, β-cholestarol, 5,16-pregnadiene-3β-ol-20-one, 5α-pregnene-3β-ol-20-one, 5-pregnene-3β,17-diol-20-one 21-acetate, 5-pregnene-3β,17-diol-20-one 17-acetate, 5-pregnene-3β,21-diol-20-one 21-acetate, 5-pregnene-3β,17-diol diacetate, rockogenin, tigogenin, esmilagenin, hecogenin and diosgenin; saccharides and derivatives thereof such as glucose and saccharose; alcohols having a cyclic structure such as 1,2:5,6-di-isopropylidene-D-mannitol; etc.

(b) Esters

The esters preferably used in the present invention are classified into the following groups (1) to (4):

(1) Esters with the total number of carbon atoms of 10 or more, which are derived from monovalent aliphatic acids and aliphatic or alicyclic monovalent alcohols;

(2) Polybasic acid esters with the total number of carbon atoms of 28 or more, which are derived from aliphatic divalent or polyvalent carboxylic acids and aliphatic or alicyclic monovalent alcohols;

(3) Esters with the total number of carbon atoms of 26 or more, which are derived from aliphatic divalent or polyvalent alcohols and monovalent aliphatic acids; and (4) Esters with the total number of carbon atoms of 28 or more, which are derived from aromatic divalent alcohols and monovalent aliphatic acids.

Examples of the esters (1) with the total number of carbon atoms of 10 or more, which are derived from monovalent aliphatic acids and aliphatic or alicyclic monovalent alcohols, include ethyl caprylate, n-butyl caprylate, n-octyl caprylate, lauryl caprylate, cetyl caprylate, stearyl caprylate, n-butyl caprate, n-hexyl caprate, myristyl caprate, docosyl caprate, methyl laurate, 2-ethylhexyl laurate, n-decyl laurate, stearyl laurate, ethyl myristate, 3-methylbutyl myristate, 2-methylpentyl myristate, n-decyl myristate, cetyl myristate, stearyl myristate, isopropyl palmitate, neopentyl palmitate, n-nonyl palmitate, n-undecyl palmitate, lauryl palmitate, myristyl palmitate, cetyl palmitate, stearyl palmitate, cyclohexyl palmitate, cyclohexylmethyl palmitate, methyl stearate, ethyl stearate, n-propyl stearate, n-butyl stearate, n-amyl stearate, 2-methylbutyl stearate, n-hexyl stearate, n-heptyl stearate, 3,5,5-trimethylhexyl stearate, n-octyl stearate, 2-ethylhexyl stearate, n-nonyl stearate, n-decyl stearate, n-undecyl stearate, lauryl stearate, n-tridecyl stearate, myristyl stearate, n-pentadecyl stearate, cetyl stearate, stearyl stearate, eicosyl stearate, n-docosyl stearate, cyclohexyl stearate, cyclohexylmethyl stearate, oleyl stearate, isostearyl stearate, n-butyl 1,2-hydroxystearate, n-methyl behenate, n-ethyl behenate, n-propyl behenate, isopropyl behenate, n-butyl behenate, isobutyl behenate, 2-methylbutyl behenate, n-amyl behenate, neopentyl behenate, n-hexyl behenate, 2-methylpentyl behenate, n-heptyl behenate, 2-ethylhexyl behenate, n-nonyl behenate, myristyl behenate, n-undecyl behenate, lauryl behenate, n-tridecyl behenate, myristyl behenate, n-pentadecyl behenate, cetyl behenate, stearyl behenate, behenyl behenate, etc.

Examples of the polybasic acid esters (2) with the total number of carbon, atoms of 28 or more, which are derived from aliphatic divalent or polyvalent carboxylic acids and aliphatic or alicyclic monovalent alcohols, include dimyristyl oxalate, dicetyl oxalate, dilauryl malonate, dicetyl malonate, distearyl malonate, dilauryl succinate, dimyristyl succinate, dicetyl succinate, distearyl succinate, dilauryl glutarate, diundecyl adipate, dilauryl adipate, di-n-tridecyl adipate, dimyristyl adipate, dicetyl adipate, distearyl adipate, di-n-docosyl adipate, di-n-decyl azelate, dilauryl azelate, di-n-tridecyl azelate, di-n-nonyl sebacate, dimyristyl sebacate, distearyl sebacate, di-n-pentyl 1,18-octadecylmethylene dicarboxylate, di-n-octyl 1,18-octadecylmethylene dicarboxylate, dicyclohexylmethyl 1,18-octadecylmethylene dicarboxylate, dineopentyl 1,18-octadecylmethylene dicarboxylate, di-n-hexyl 1,18-octadecylmethylene dicarboxylate, di-n-heptyl 1,18-octadecylmethylene dicarboxylate, di-n-octyl 1,18-octadecylmethylene dicarboxylate, etc.

Examples of the esters (3) of aliphatic bivalent or polyvalent alcohols and monovalent aliphatic acids, the total number of carbon atoms being 26 or more, include ethylene glycol dimyristate, ethylene glycol dipalmitate, ethylene glycol distearate, propylene glycol dilaurate, propylene glycol dimyristate, propylene glycol dipalmitate, butylene glycol distearate, hexylene glycol dilaurate, hexylene glycol dimyristate, hexylene glycol dipalmitate, hexylene glycol distearate, 1,5-pentanediol distearate, 1,2,6-hexanetriol dimyristate, pentaerythritol trimyristate, pentaerythritol tetralaurate, 1,4-cyclohexanediol didecyl, 1,4-cyclohexanediol dimyristyl, 1,4-cyclohexanediol distearyl, dilaurate of 1,4-cyclohexane dimethanol, dimyristate of 1,4-cyclohexane dimethanol, etc.

Examples of the esters (4) with the total number of carbon atoms of 28 or more, which are derived from aromatic divalent alcohols and monovalent aliphatic acids, include xylene glycol dicaprate, xylene glycol di-n-undecanate, xylene glycol dilaurate, xylene glycol dimyristate, xylene glycol dipalmitate, xylene glycol distearate, etc.

(c) Ketones

Ketones are preferably compounds having 10 or more carbon atoms, specifically decane-2-one, undecane-2-one, laurone, stearone, etc.

(d) Ethers

Examples of ethers include butyl ether, hexyl ether, di-isopropyl benzyl ether, diphenyl ether, dioxane, ethylene glycol dibutyl ether, diethylene glycol dibutyl ether, ethylene glycol diethyl ether, diethylene glycol diethyl ether, ethylene glycol diphenyl ether, etc.

The above decoloring agents may be used alone or in combination. Stabilizers described later and the above polymers may be provided with a discoloration function by having structures of alcohols, ketones, esters, ethers, etc. therein, thereby doing without decoloring agents.

(E) Amounts of Components (a) Amount of Polymer

In the heat-responsive-discolorable coloring composition, the amount of the polymer added is preferably 1 to 1,000 parts by mass, more preferably 5 to 500 parts by mass, based on 1 part by mass of the electron-donating, organic color former. When the amount of the polymer added is less than 1 part by mass, there is an insufficient function to fix a reversible change between discoloration and color development on the side of discoloration. On the other hand, when the amount of polymer added is more than 1,000 parts by mass, it is not easy to obtain change between discoloration and color development.

(b) Amount of Electron-donating Color Former

When the heat-responsive-discolorable coloring composition is used in the coloring layer, the amount of the electron-donating color former added is preferably 0.01 to 10 mmol/$m^2$, more preferably 0.05 to 5 mmol/$m^2$.

(c) Amount of Acidic Compound

The amount of the acidic compound (color-developing agent) added is preferably 0.1 to 10 parts by mass, more preferably 1 to 4 parts by mass, based on 1 part by mass of the electron-donating, organic color former. When the amount of the color-developing agent added is less than 0.1 parts by mass, insufficient coloring tends to be obtained by interaction between the electron-donating, organic color former and the color-developing agent. On the other hand, when the amount of the color-developing agent added is more than 10 parts by mass, it is difficult to fully prevent the interaction therebetween.

(d) Amount of Decoloring Agent

The amount of the decoloring agent added is preferably 0.1 to 100 parts by mass, more preferably 1 to 10 parts by mass, based on 1 part by mass of the electron-donating, organic color former. When the decoloring agent is less than 0.1 parts by mass, other materials, namely a stabilizer and a polymer are needed in the change from a colored state to a discolored state. On the other hand, when the decoloring agent is more than 100 parts by mass, color development is difficult.

(F) Formulating Method

Though an electron-donating color former forming the heat-responsive-discolorable coloring composition, a polymer having a glass transition temperature (Tg) of 60° C. to 200° C., a color-developing agent, a decoloring agent, etc. may be formulated at the same time, it is preferable that the electron-donating color former and the color-developing agent are mixed in advance to cause color development. The polymer is added preferably in the form of an aqueous dispersion. The decoloring agent may be mixed with other components in advance or may be separately added at the time of heating. It is presumed that color development is caused by strong interaction between the electron-donating, organic color former and the color-developing agent due to interaction between the color-developing agent and the decoloring agent at a low temperature. However, the above three components are uniformly mixed at a high temperature, resulting in strong interaction between the color-developing agent and the decoloring agent, thereby causing discoloration.

Though the formulation method of the electron-donating color former, the color-developing agent and the decoloring agent is not restrictive, preferable is a method in which fine particles containing these compounds are dispersed in a hydrophilic binder such as gelatin, PVA, etc. In this case, particles may be capsulated.

The electron-donating color former, the color-developing agent and the decoloring agent may be in the form of so-called oligomers and polymers in which two or more molecules are bonded. The decoloring agent may preferably be a polymer dispersed in an aqueous liquid. This aqueous dispersion may be prepared by emulsion polymerization and suspension polymerization, or by finely dispersing those bulk-polymerized in an aqueous solution.

In the present invention, a time period until the coloring composition of the present invention changes from a discoloration initiation temperature (T) to an equilibrium color concentration, which is referred to as "discoloring time," is preferably within 20 seconds, more preferably within 10 seconds. Accordingly, the types and amounts of the electron-donating color former, the color-developing agent and the decoloring agent are preferably selected to meet this criterion.

(G) Stabilizers

To keep a colored state before treatment, a stabilizer may be added to the heat-responsive-discolorable coloring composition. Useful as the stabilizers are discoloration-preventing agents for photographs described in Research Disclosure (hereinafter referred to as RD) No. 17,643 (1978) page 25, RD No. 18,716 (1979) page 650, and RD No. 307,105 (1989) page 72. Preferable among them are hindered phenols. Also useful are discoloration-preventing agents (stability-improving agents) for heat-sensitive recording papers described in "Paper Pulp Technology Times," March, 1995, pages 4 to 5. Preferable among them are hydroxybisphenol compounds, phenol compounds, 3-hydroxy-2-naphthamide derivatives, thiobenzoate derivatives, gallic acid derivatives, hindered phenol derivatives, diphenylpropane derivatives, novolak-type epoxy resins, etc., more preferable among them are hindered phenol derivatives.

Though the method for adding a stabilizer is not particularly restrictive, it is preferable to introduce the stabilizer into fine particles or microcapsules together with the electron-donating color former and the color-developing agent.

[2] Other Elements than the Heat-responsive-discolorable Coloring Composition (A) Silver Halide The silver halide may be silver iodobromide, silver bromide, silver chlorobromide, silver iodochloride, silver chloride, silver iodochlorobromide, etc. The size of the silver halide grains is preferably 0.1 to 2 μm, more preferably 0.2 to 1.5 μm, when converted to diameters of spheres having the same volumes. These silver halides may be used not only as photosensitive silver halide grains, but also as non-photosensitive silver halide grains, which are not chemically sensitized.

The shape of the silver halide grains may be a normal crystal shape such as cube, octahedron, tetradecahedron, etc., and a planar shape such as hexagon, rectangle, etc. Preferable among them are planar grains. The aspect ratios of grains, values of their projection diameters divided by their thickness are preferably 2 or more, more preferably 8 or more, most preferably 20 or more. The thickness of the planar grains is preferably 0.3 μm or less, more preferably 0.2 μm or less, most preferably 0.1 μm or less. A silver halide emulsion is preferably such that such planar grains occupy 50% or more, preferably 80% or more, more preferably 90% or more of the projection area of all grains.

Also preferable are such grains that are thinner than 0.07 μm with a high aspect ratio, as described in U.S. Pat. Nos. 5,494,789, 5,503,970, 5,503,971 and 5,536,632, etc. Further usable are high-silver-halide planar grains having (111) face as a major face described in U.S. Pat. Nos. 4,400,463, 4,713,323 and 5,217,858, etc., and high-silver-halide planar grains having a (100) face as a major face described in U.S. Pat. Nos. 5,264,337, 5,292,632, 5,310,635, etc.

Examples of these silver halide grains actually used are described in JP 9-274295 A, JP 9-319047 A, JP 10-115888 A, JP 10-221827 A, etc. The silver halide grains used in the present invention are preferably so-called monodisperse grains having uniform grain sizes. The measure of "monodisperse" is that a variation coefficient obtained by dividing a standard deviation of a grain size distribution by an average diameter is preferably 25% or less, more preferably 20% or less. It is also preferable that a halogen composition is uniform between the grains.

The silver halide grains may be those having a uniform halogen composition therein, or may intentionally contain portions having a different halogen composition. To achieve high sensitivity, it is preferable to use grains each having a laminate structure comprising a core and a shell with different halogen compositions from each other. It is also preferable that after introducing regions of a different halogen composition into the grains, the grains are caused to grow further so that transformation lines are intentionally introduced. It is further preferable that guest crystals of different halogen compositions are epitaxially bonded to apexes and edges of host grains.

Multivalent transition metal ions or multivalent anions may be doped as impurities in the silver halide grains. The preferred multivalent transition metal ions are halogeno complexes, cyano complexes, organic ligand complexes respectively having iron-group elements as center metals, etc.

The silver halide grains of the present invention may be prepared by known methods, that are described in P. Glafkides, Chimie et Phisique Photographique, Paul Montel, 1967, G. F. Duffin, Photographic Emulsion, Chemistry, Focal Press, 1966, V. L. Zelikman et al., Making and Coating of Photographic Emulsion, Focal Press, 1964, etc.

The silver halide emulsion may be prepared by an acid process, a neutral process or an ammonia process. Methods for reacting water-soluble silver salts with water-soluble halides may be a method of pouring one component into the other component, a method of pouring both components simultaneously, or a combination thereof, etc. Usable as one type of the simultaneous pouring method is a method of keeping the pAg of a liquid phase in which a silver halide is formed, so-called a controlled double jet method. By this method, it is possible to form a silver halide emulsion of a regular crystal system having almost uniform grain size distribution and halogen composition. The pH value of the reaction solution may be kept uniform during the reaction. The silver halide grains may be prepared while controlling the solubility of the silver halide by changing the temperature, pH value and/or pAg value of the reaction mixture. Examples of solutions used for the silver halide emulsion include such solution as thioethers, thioureas or rhodanine. These methods are disclosed in JP 47-11386 B, JP 53-144319 A, etc.

The preparation of the silver halide grains are usually carried out by supplying a solution of a water-soluble silver salt such as silver nitrate and a solution of a water-soluble halide such as an alkali halide into an aqueous solution of a water-soluble binder such as gelatin under the controlled conditions. After the preparation of the silver halide grains, the excess water-soluble salts are preferably removed. The excess water-soluble salts may be removed by a noodle water-washing method where a gelatin solution comprising the silver halide grains are gelled and cut into strings, and then the water-soluble salts therein are washed away by cold water; a sedimentation method comprising adding to a gelatin solution an inorganic salt comprising a polyvalent anion such as sodium sulfate, an anionic surfactant, an anionic polymer such as sodium polystyrenesulfonate, a gelatin derivative such as an aliphatic acylated gelatin, an aromatic acylated gelatin and an aromatic carbamoylated gelatin, etc. to aggregate the gelatin, thereby removing the water-soluble salts; etc. The sedimentation method is preferable from the viewpoint of rapidity for removing excess water-soluble salts.

The silver halide emulsion used in the present invention is preferably chemically or spectrally sensitized. The chemical sensitization method may be a chemical sensitization method using a chalcogen such as sulfur, selenium, tellurium, etc.; a sensitization method using a noble metal such as gold, platinum, indium, etc.; a so-called reduction sensitization method using a reducing compound to introduce proper reducing silver nuclei during the formation of grains to achieve high sensitivity; combinations thereof; etc. The silver halide emulsion used in the present invention may be spectrally sensitized by a spectral sensitizing dye. The spectral sensitizing dye is adsorbed to the silver halide grains, so that the grains are sensitized to light in their absorption wavelength range. Examples of the spectral sensitizing dyes include cyanine dyes, merocyanine dyes, composite cyanine dyes, composite merocyanine dyes, holopolar dyes, hemicyanine dyes, styryl dyes, hemioxonol dyes, etc. This spectral sensitizing dye may be used alone or in combination, preferably used with a super-sensitizer.

The amount of silver used is preferably 0.05 to 15 g/m$^2$, more preferably 0.1 to 8 g/m$^2$, per a unit area of the layer comprising the silver halide emulsion.

(B) Antifoggant or Stabilizer (Precursor Thereof)

An antifoggant, a stabilizer or a precursor thereof may be added to the silver halide emulsion to prevent the fogging or the reduction of sensitivity during storage of the silver halide photosensitive material. Examples of the antifoggants and the stabilizers include nitrogen-containing heterocyclic compounds such as azaindene compounds, triazole compounds, tetrazole compounds and purine compounds; mercapto compounds such as mercaptotetrazole compounds, mercaptotriazole compounds, mercapto imidazole compounds and mercapto thiadiazole compounds; etc. Particularly, triazole or mercaptoazole compounds having alkyl groups or aromatic rings having 5 or more of carbon atoms as substituents are remarkably effective in preventing fogging in thermal development, thereby increasing developability in an exposure portion and thus providing high discrimination. Described in RD, No. 17643 (1978), RD, No. 18716 (1979), RD, No. 307105 (1989), RD, No. 38957 (1996) may be used as photographic additives for the silver halide emulsion.

Examples of the antifoggants, the stabilizers and the stabilizer precursors further include thiazonium salts described in U.S. Pat. Nos. 2,131,038 and 2,694,716; azaindene compounds described in U.S. Pat. Nos. 2,886,437 and 2,444,605; urazole compounds described in U.S. Pat. No. 3,287,135; mercury salts described in U.S. Pat. No. 2,728,663; sulfocatechol compounds described in U.S. Pat. No. 3,235,652; oxime compounds, nitron compounds and nitroindazole compounds described in GB 623,448; multivalent metal salts described in U.S. Pat. No. 2,839,405; thiuronium salts described in U.S. Pat. No. 3,220,839; palladium salts, platinum salts and gold salts described in U.S. Pat. Nos. 2,566,263 and 2,597,915; halogen-substituted organic compounds described in U.S. Pat. Nos. 4,108,665 and 4,442,202; triazine compounds described in U.S. Pat. Nos. 4,128,557, 4,137,079, 4,138,365 and 4,459,350; phosphorus compounds described in U.S. Pat. No. 4,411,985; organic halogenated compounds described in JP 50-119624 A, JP 54-58022 A, JP 56-70543 A, JP 56-99335 A, JP 61-129642 A, JP 62-129845 A, JP 6-208191 A, JP 7-5621 A, JP 8-15809 A, U.S. Pat. Nos. 5,340,712, 5,369,000 and 5,464,737, etc.

The antifoggant, the stabilizer and the stabilizer precursor may be added at any time during the preparation of the silver halide emulsion, for example, during the preparation of the emulsion after the chemical sensitization; at the time of completing the chemical sensitization; during the chemical sensitization; before the chemical sensitization; after the formation of the silver halide grains and before the desalinization; during the formation of the silver halide grains; and/or before the formation of the silver halide grains.

The amount of each of the antifoggant, the stabilizer and the stabilizer precursor may be determined depending on the halogen composition and the use of the silver halide emulsion, though it is preferably $10^{-6}$ to $10^{-1}$ mol, more preferably $10^{-5}$ to $10^{-2}$ mol, per one mol of the silver halide.

The antifoggant used for the silver halide photosensitive material of the present invention is preferably represented by any of the following general formulae (F-1) and (F-2), and general formula (F-1) is more preferable.

General Formula (F-1)

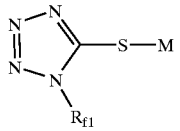

General Formula (F-2)

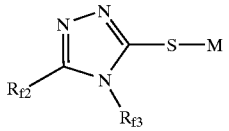

In the general formula (F-1), $R_{f1}$ represents an alkyl group having 4 to 20 carbon atoms, an aryl group having 6 to 20 carbon atoms, or an aralkyl group having 7 to 20 carbon atoms.

In the general formula (F-2), $R_{f2}$ represents a hydrogen atom, an alkyl group having 4 to 20 carbon atoms, an aryl group having 6 to 20 carbon atoms, or an aralkyl group having 7 to 20 carbon atoms, and $R_{f3}$ represents an alkyl group having 4 to 20 carbon atoms, an aryl group having 6 to 20 carbon atoms, or an aralkyl group having 7 to 20 carbon atoms. The total number of carbon atoms in $R_{f2}$ and $R_{f3}$ is 4 to 30.

The alkyl group having 4 to 20 carbon atoms, represented by $R_{f1}$, may have a substituent and may be straight, blanched or cyclic. Examples of the alkyl groups include an n-butyl group, an n-hexyl group, an n-octyl group, an n-decyl group, an n-dodecyl group, a 2-ethylhexyl group, an n-hexadecyl group, a 6-methoxyhexyl group, a 6-hydroxyhexyl group, a cyclohexyl group, etc.

The aryl group having 6 to 20 carbon atoms, represented by $R_{f1}$, may have a substituent. Examples of the aryl groups include a phenyl group, a naphthyl group, a 4-methoxyphenyl group, etc.

The aralkyl group having 7 to 20 carbon atoms, represented by $R_{f1}$, may have a substituent. Examples of the aralkyl groups include a benzyl group, a phenethyl group, a 4-chlorobenzyl group, etc.

$R_{f1}$ is preferably an alkyl group having 6 to 12 carbon atoms or an aralkyl group having 7 to 12 carbon atoms, more preferably an alkyl group having 6 to 12 carbon atoms, particularly a normal alkyl group having 8 to 12 carbon atoms.

In the general formula (F-2), $R_{f2}$ is preferably a hydrogen atom, an alkyl group having 6 to 12 carbon atoms, an aryl group having 6 to 12 carbon atoms, or an aralkyl group having 7 to 12 carbon atoms, and $R_{f3}$ is preferably an alkyl group having 6 to 12 carbon atoms, an aryl group having 6 to 12 carbon atoms, or an aralkyl group having 7 to 12 carbon atoms. The total number of carbon atoms in $R_{f2}$ and $R_{f3}$ is preferably 6 to 20. $R_{f2}$ is more preferably an alkyl group having 6 to 12 carbon atoms, an aryl group having 6 to 12 carbon atoms, or an aralkyl group having 7 to 12 carbon atoms, and $R_{f3}$ is more preferably an aryl group having 6 to 12 carbon atoms, or an aralkyl group having 7 to 12 carbon atoms, the total number of carbon atoms in $R_{f2}$ and $R_{f3}$ being 6 to 16. $R_{f2}$ is particularly an alkyl group having 6 to 12 carbon atoms, or an aryl group having 6 to 12 carbon atoms, and $R_{f3}$ is particularly an aryl group having 6 to 12 carbon atoms, or an aralkyl group having 7 to 12 carbon atoms, the total number of carbon atoms in $R_{f2}$ and $R_{f3}$ being 6 to 14.

In the general formulae (F-1) and (F-2), M represents a hydrogen atom or a cation. Examples of the cations include alkali metal ions such as a sodium ion and a potassium ion; alkaline earth metal ions such as a magnesium ion, a calcium ion and a barium ion; ammonium ions such as an unsubstituted ammonium ion and a tetramethylammonium ion; etc. M is preferably a hydrogen atom. Further, a water-insoluble metal salt composed of the compound represented by the general formula (F-1) or (F-2) may be used as the antifoggant. The metal ion of M forming a water-insoluble metal salt as a counter cation may be Fe ion, Cu ion, Ag ion, Hg ion, etc. Among the metal ions, Ag ion is the most preferred.

As described above, $R_{f1}$, $R_{f2}$ and $R_{f3}$ may have substituents, and preferred examples of the substituents include halogen atoms such as a chlorine atom, a bromine atom and an iodine atom; substituted or unsubstituted alkyl groups preferably having 1 to 10 carbon atoms, which may be straight, branched or cyclic, such as a methyl group, an ethyl group, an n-propyl group, an isopropyl group, a t-butyl group, an n-octyl group, a 2-chloroethyl group, a 2-cyanoethyl group and a 2-ethylhexyl group; substituted or unsubstituted cycloalkyl groups preferably having 3 to 10 carbon atoms, such as a cyclohexyl group and a cyclopentyl group; substituted or unsubstituted alkenyl groups preferably having 2 to 10 carbon atoms, which may be straight, branched or cyclic, such as a vinyl group and an allyl group; substituted or unsubstituted cycloalkenyl groups preferably having 3 to 10 carbon atoms, such as a 2-cyclopenten-1-yl group and 2-cyclohexen-1-yl group; alkynyl groups; aralkyl groups; aryl groups; substituted or unsubstituted, aromatic or non-aromatic, heterocyclic groups having 3 to 10 carbon atoms, which may preferably be aromatic or non-aromatic with a 5- or 6-membered ring structure and preferably aromatic, such as a 2-furyl group, a 2-thienyl group, a 2-pyrimidinyl group and a 2-benzthiazolyl group; a cyano group; a hydroxyl group; a nitro group; a carboxyl group; substituted or unsubstituted alkoxy groups preferably having 1 to 10 carbon atoms, such as a methoxy group, an ethoxy group, an isopropoxy group, a t-butoxy group, an n-octyloxy group, and a 2-methylhexyloxy group; substituted or unsubstituted aryloxy groups preferably having 6 to 10 carbon atoms, such as a phenoxy group, a 2-methylphenoxy group, a 4-t-butylphenoxy group and 3-nitrophenoxy group; silyloxy groups preferably having 3 to 10 carbon atoms, such as a trimethylsilyloxy group and a t-butyldimethylsilyloxy group; substituted or unsubstituted heterocyclic oxy groups preferably having 2 to 10 carbon atoms, such as a 1-phenyltetrazole-5-oxy group and a 2-tetrahydropyranyloxy group; acyloxy groups, which may be substituted or unsubstituted alkylcarbonyloxy groups having 2 to 10 carbon atoms and substituted or unsubstituted arylcarbonyloxy groups having 6 to 10 carbon atoms, such as a formyloxy group, an acetoxy group, a pivaloyloxy group, a benzoyloxy group, and p-methoxyphenylcarbonyloxy group, and preferably a formyloxy group; substituted or unsubstituted carbamoyl groups preferably having 1 to 10 carbon atoms, such as an N,N-dimethylcarbamoyloxy group, an N,N-diethylcarbamoyloxy group, and a morpholinocarbonyloxy group; substituted or unsubstituted alkoxycarbonyloxy groups preferably having 2 to 10 carbon atoms, such as a methoxycarbonyloxy group, an ethoxycarbonyloxy group, a t-butoxycarbonyloxy group, and an n-octylcarbonyloxy group; substituted or unsubstituted aryloxycarbonyloxy groups preferably having 7 to 10 carbon atoms, such as a phenoxycarbonyloxy group, and a p-methoxyphenoxycarbonyloxy group; amino groups, which may be substituted or unsubstituted alkylamino groups having 1 to 10 carbon atoms and substituted or unsubstituted anilino groups having 6 to 10 carbon atoms, such as a unsubstituted amino group, a methylamino group, a dimethylamino group, a unsubstituted anilino group and an N-methylanilino group, preferably a unsubstituted amino group; acylamino groups, which may be substituted or unsubstituted alkylcarbonylamino groups having 1 to 10 carbon atoms and substituted or unsubstituted arylcarbonylamino groups having 6 to 10 carbon atoms, such as a formylamino group, an acetylamino group, a pivaloylamino group and a benzoylamino group, preferably a formylamino group; substituted or unsubstituted aminocarbonylamino groups preferably having 1 to 10 carbon atoms, such as a carbamoylamino group, an N,N-dimethylaminocarbonylamino group, an N,N-diethylaminocarbonylamino group, and a morpholinocarbonylamino group; substituted or unsubstituted alkoxycarbonylamino groups preferably having 2 to 10 carbon atoms, such as a methoxycarbonylamino group, an ethoxycarbonylamino group, a t-butoxycarbonylamino group, an n-octadecyloxycarbonylamino group, and an N-methylmethoxycarbonylamino group; substituted or unsubstituted aryloxycarbonylamino groups preferably having 7 to 10 carbon atoms, such as a phenoxycarbonylamino group and a p-chlorophenoxycarbonylamino group; substituted or unsubstituted sulfamoylamino groups preferably having 0 to 10 carbon atoms, such as a unsubstituted sulfamoylamino group, an N,N-dimethylaminosulfonylamino group, and an N-n-octylaminosulfonylamino group; substituted or unsubstituted alkylsulfonylamino groups preferably having 1 to 10 carbon atoms, such as a methylsulfonylamino group, and a butylsulfonylamino group; substituted or unsubstituted arylsulfonylamino group preferably having 6 to 10 carbon atoms, such as a phenylsulfonylamino group, a 2,3,5-trichlorophenylsulfonylamino group, and a p-methylphenylsulfonylamino group; a mercapto group; substituted or unsubstituted alkylthio groups preferably having 1 to 10 carbon atoms, such as a methylthio group and an ethylthio group; substituted or unsubstituted arylthio groups preferably having 6 to 10 carbon atoms, such as a phenylthio group, a p-chlorophenylthio group and an m-methoxyphenylthio group; substituted or unsubstituted heterocyclic thio groups preferably having 2 to 10 carbon atoms, such as a 2-benzothiazolylthio group, and a 1-phenyltetrazole-5-ylthio group; substituted or unsubstituted sulfamoyl groups preferably having 0 to 10 carbon atoms, such as an N-ethylsulfamoyl group, an N-(3-dodecyloxypropyl)sulfamoyl group, an N,N-dimethylsulfamoyl group, an N-acetylsulfamoyl group, an N-benzoylsulfamoyl group, and an N-(N'-phenylcarbamoyl)sulfamoyl group; a sulfo group; substituted or unsubstituted alkylsulfinyl groups preferably having 1 to 10 carbon atoms, such as a methylsulfinyl group and an ethylsulfinyl group; substituted or unsubstituted arylsulfinyl groups preferably having 6 to 10 carbon atoms, such as a phenylsulfinyl group, and a p-methylphenylsulfinyl group; substituted or unsubstituted alkylsulfonyl groups preferably having 1 to 10 carbon atoms, such as a methylsulfonyl group and an ethylsulfonyl group; substituted or unsubstituted arylsulfonyl groups preferably having 6 to 10 carbon atoms, such as a phenylsulfonyl group, and a p-methylphenylsulfonyl group; acyl groups, which may be substituted or unsubstituted alkylcarbonyl groups having 2 to 10 carbon atoms and substituted or unsubstituted arylcarbonyl groups having 7 to 10 carbon atoms, such as a formyl group, an acetyl group, a pivaloyl group, a 2-chloroacetyl group, and a benzoyl group, preferably a formyl group; substituted or unsubstituted aryloxycarbonyl groups preferably having 7 to 10 carbon atoms, such as a phenoxycarbonyl group, an o-chlorophenoxycarbonyl group, and an m-nitrophenoxycarbonyl group; substituted or unsubstituted alkoxycarbonyl groups preferably having 2 to 10 carbon atoms, such as a methoxycarbonyl group, an ethoxycarbonyl group and a t-butoxycarbonyl group; substituted or unsubstituted carbamoyl groups preferably having 1 to 10 carbon atoms, such as a carbamoyl group, an N-methylcarbamoyl group, an N,N-dimethylcarbamoyl group and an N-(methylsulfonyl)carbamoyl group; substituted or unsubstituted arylazo groups preferably having 6 to 10 carbon atoms, such as a phenylazo group and a p-chlorophenylazo group; substituted or unsubstituted heterocyclic azo groups preferably having 3 to 10 carbon atoms, such as a 5-ethylthio-1,3,4-thiadiazole-2-ylazo group; imide groups, which may be an N-succinimide group, and an N-phthalimide group; substituted or unsubstituted phosphino groups preferably having 2 to 12 carbon atoms, such as a dimethylphosphino group, a diphenylphosphino group, and a methylphenoxyphosphino group; substituted or unsubstituted phosphinyl groups preferably having 2 to 12 carbon atoms, such as a unsubstituted phosphinyl group, and a diethoxyphosphinyl group; substituted or unsubstituted phosphinyloxy group preferably having 2 to 12 carbon atoms, such as a diphenoxyphosphinyloxy group; substituted or unsubstituted phosphinylamino groups preferably having 2 to 10 carbon atoms, such as a dimethoxyphosphinylamino group, and a dimethylaminophosphinylamino group; substituted or unsubstituted silyl group preferably having 3 to 10 carbon atoms, such as a trimethylsilyl group, a t-butyldimethylsilyl group and a phenyldimethylsilyl group; etc.

The compound represented by the general formula (F-1) or (F-2) may be synthesized by a known method. The photographic additives for the photosensitive materials including the above-mentioned additives are described in detail in RD, No. 17643 (1978), RD, No. 18716 (1979) and RD, No. 307105 (1989) as follows.

| Additives | RD 17643 | RD 18716 | RD 307105 |
|---|---|---|---|
| Chemical Sensitizer | p. 23 | p. 648, Right Column | p. 866 |
| Sensitivity-Increasing Agent | — | p. 648, Right Column | — |
| Spectral Sensitizer | pp. 23 to 24 | p. 648, Right Column | pp. 866 to 868 |
| Super-Sensitizer | — | p. 649, Right Column | — |
| Brightening Agent | p. 24 | p. 648, Right Column | p. 868 |
| Antifoggant | pp. 24 to 26 | p. 649, Right Column | pp. 868 to 870 |
| Light Absorbent | pp. 25 to 26 | p. 649, Right Column | p. 873 |
| Filter Dye | — | p. 650, Left Column | — |
| Dye Image Stabilizer | p. 25 | p. 650, Left Column | p. 872 |
| Hardening Agent | p. 25 | p. 651, Left Column | pp. 874 to 875 |
| Binder | p. 26 | p. 651, Left Column | pp. 873 to 874 |
| Plasticizer or Lubricant | p. 27 | p. 650, Right Column | p. 876 |
| Coating Aid | pp. 26 to 27 | p. 650, Right Column | pp. 875 to 876 |
| Antistatic Agent | p. 27 | p. 650, Right Column | pp. 876 to 877 |
| Matting Agent | — | — | pp. 878 to 879 |

(C) Organic Silver Salt

The organic silver salt that can be reduced is relatively stable to light and generates a silver ion when heated at 80° C. or higher in the presence of an exposed photocatalyst such as an latent image of the photosensitive silver halide, a reducing agent, etc. The organic silver salt is preferably an organic or inorganic complex comprising a ligand with a gross stability constant against silver ion of 4.0 to 10.0.

Preferably usable as the above organic silver salts are silver salts of organic compounds having carboxyl groups, such as silver salts of aliphatic carboxylic acids and silver salts of aromatic carboxylic acids. Further, silver salts that can be substituted by halogen atoms or a hydroxyl group are also preferred. Preferred examples of the aliphatic carboxylic acids include behenic acid, stearic acid, oleic acid, lauric acid, capric acid, myristic acid, palmitic acid, maleic acid, fumaric acid, tartaric acid, arachidic acid, linoleic acid, butanoic acid, camphoric acid, thioether group-containing aliphatic carboxylic acids disclosed in U.S. Pat. No. 3,330,663, etc. These aliphatic carboxylic acids may be combined. Preferred examples of the aromatic carboxylic acids include benzoic acid; substituted benzoic acids such as 3,5-dihydroxybenzoic acid, o-methylbenzoic acid, m-methylbenzoic acid, p-methylbenzoic acid, 2,4-dichlorobenzoic acid, acetoamidobenzoic acid and p-phenylbenzoic acid; gallic acid; tannic acid; phthalic acid; terephthalic acid; salicylic acid; phenylacetic acid; pyromellitic acid; 3-carboxymethyl-4-methyl-4-thiazoline-2-thione; carboxylic acids disclosed in U.S. Pat. No. 3,785,830; etc.

Silver salts of compounds having a mercapto group or a thione group and derivatives thereof may be also used as the above-mentioned organic silver salt. Such silver salt preferably has a 5- or 6- membered heterocyclic skeleton having carbon atoms and 2 or less heteroatoms selected from the group consisting of oxygen, sulfur and nitrogen, at least one nitrogen atom being preferably contained. The 5- or 6-membered heterocyclic skeleton is preferably a triazole ring skeleton, an oxazole ring skeleton, a thiazole ring skeleton, a thiazoline ring skeleton, an imidazoline ring skeleton, an imidazole ring skeleton, a diazole ring skeleton, a pyridine ring skeleton, or a triazine ring skeleton. Preferred examples of the silver salt having the heterocyclic skeleton include a silver salt of 3-mercapto-4-phenyl-1,2,4-triazole; a silver salt of 2-mercaptobenzimidazole; a silver salt of 2-mercapto-5-aminothiadiazole; a silver salt of 2-(ethylglycolamido)-benzothiazole; a silver salt of 5-carboxyl-1-methyl-2-phenyl-4-thiopyridine; a silver salt of mercaptotriazine; a silver salt of 2-mercaptobenzoxazole; silver salts of 1-mercapto-5-alkyltetrazole; a silver salt of 1-mercapto-5-phenyltetrazole described in JP 1-100177 A; silver salts of 1,2,4-mercaptothiazole derivatives such as a silver salt of 3-amino-5-benzylthio-1,2,4-thiazole described in U.S. Pat. No. 4,123,274; silver salts of thione compounds such as a silver salt of 3-(2-carboxyethyl)-4-methyl-4-thiazoline-2-thione; silver salts of 3-amino-1,2,4-triazole compounds described in JP 53-116144 A; silver salts of substituted or unsubstituted benzotriazole compounds; silver salts of benzotriazole compounds and fatty acids described in U.S. Pat. No. 4,500,626, columns 52 to 53; etc.

Examples of the silver salt comprising a mercapto group or a thione group without the heterocyclic skeleton include silver salts of thioglycolic acid compounds such as silver salts of an S-alkylthioglycolic acid having an alkyl group with 12 to 22 carbon atoms; silver salts of dithiocarboxylic acid compounds such as a silver salt of dithioacetic acid; silver salts of thioamide compounds; etc.

Silver salts of compounds having an imino group may be used as the above organic silver salt, and preferred examples thereof include silver salts of benzotriazole and derivatives thereof; silver salts of benzotriazole compounds such as a silver salt of methylbenzotriazole; silver salts of halogen-substituted benzotriazole compounds such as a silver salt of 5-chlorobenzotriazole; silver salts of 1,2,4-triazole compounds; silver salts of 1H-tetrazole compounds described in U.S. Pat. No. 4,220,709; silver salts of imidazole and derivatives thereof; etc. Further, silver acetylide compounds disclosed in U.S. Pat. No. 4,775,613 may be used as the above organic silver salt.

A plurality of the above-mentioned organic silver salts may be used in combination. The amount of the organic silver salt is preferably 0.01 to 10 mol, more preferably 0.01 to 1 mol, per one mol of the photosensitive silver halide. The total amount of silver in the photosensitive silver halide emulsion and the organic silver salt per 1 $m^2$ of the photosensitive material is preferably 0.1 to 20 $g/m^2$, more preferably 1 to 10 $g/m^2$. The organic silver salt is preferably 5 to 70% by mass based on the photosensitive silver halide grains in the photosensitive silver halide emulsion layer.

The organic silver salt used in the present invention is preferably desalted. The desalting method is not particularly limited and may preferably be a known filtration method such as a centrifugal filtration method, a vacuum filtration method, an ultrafiltration method, a washing method with water for forming flock by flocculation, etc. The ultrafiltration method disclosed in JP 2000-305214 A may be used in the present invention.

The organic silver salt is preferably used as a solid dispersion. The solid dispersion of the organic silver salt is preferably prepared by a reaction between a solution or a suspension of an organic compound or an alkali metal salt thereof (sodium salt, potassium salt, lithium salt, etc.) and silver nitrate. The solid dispersion of the organic silver salt may be prepared by a method disclosed in JP 1-100177 A, JP 2001-033907 A, JP 2000-292882 A, etc. A water-soluble dispersant may be added to a solution or a suspension of the organic compound or the alkali metal salt thereof, or to an aqueous silver nitrate solution. The types and amounts of the dispersants are described in JP 2000-305214 A. In the present invention, the solid dispersion of the organic silver salt is particularly preferably prepared with pH controlled by a method disclosed in JP 1-100177 A.

Preferably used to prepare a solid dispersion of an organic silver salt having a small grain size free from flocculation is a dispersing method, in which an aqueous dispersion comprising an organic silver salt as an image-forming medium and substantially free from a photosensitive silver salt is turned to a high-speed fluid, and then subjected to pressure drop. This dispersing method is disclosed in JP 2000-292882 A.

The shape and size of the organic silver salt are not particularly limited. The average grain size of the organic silver salt in the organic silver salt solid dispersion is preferably 0.001 to 5.0 $\mu$m, more preferably 0.005 to 1.0 $\mu$m. The solid dispersion of the organic silver salt is preferably mono-dispersion in a grain size distribution. A percentage (variation coefficient) obtained by dividing the standard deviation of a volume-weighted average diameter of the organic silver salt by the volume-weighted average diameter is preferably 80% or less, more preferably 50% or less, particularly 30% or less.

The organic silver salt solid dispersion generally comprises an organic silver salt and water. Although the mass ratio of the organic silver salt to water is not particularly limited, the mass ratio of the organic silver salt to the entire dispersion is preferably 5 to 50% by mass, particularly 10 to 30% by mass. The amount of the dispersant is preferably as small as possible to lower the grain size of the organic silver salt, and the mass ratio of the dispersant to the organic silver salt is preferably 0.5 to 30% by mass, particularly 1 to 15% by mass. A metal ion selected from Ca, Mg and Zn, an antifoggant or a stabilizer, etc. may be added to the solid dispersion of the organic silver salt.

(D) Dye-providing Compound (Coupler)

The silver halide photosensitive material of the present invention comprises a coupler on the substrate on the same side as the photosensitive silver halide. The coupler used in the present invention may be a known two-equivalent or four-equivalent coupler. Examples of the couplers known in the field of photography are disclosed in Nobuo Furutachi, "Organic Compounds For Conventional Color Photography," the Journal of Synthetic Organic Chemistry, Japan, Vol. 41, page 439, 1983; RD No. 37038, February 1995, pages 80 to 85 and 87 to 89; etc.

Examples of the yellow image-forming couplers include pivaloylacetamide couplers; benzoylacetamide couplers; malonic diester couplers; malonic diamide couplers; dibenzoylmethane couplers; benzthiazolylacetamide couplers; malonic ester monoamide couplers; benzoxazolylacetamide couplers; benzimidazolylacetamido couplers; cycloalkylcarbonylacetamide couplers; indoline-2-yl-acetamide couplers; quinazoline-4-one-2-yl-acetamide couplers described in U.S. Pat. No. 5,021,332; benzo-1,2,4-thiadiazine-1,1-dioxide-3-yl-acetamide couplers described in U.S. Pat. No. 5,021,330; couplers described in EP 421 221 B; couplers described in U.S. Pat. No. 5,455,149; couplers described in EP 622 673 A; and 3-indoloylacetamide couplers described in EP 953 871 A, EP 953 872 A and EP953 873 A.

Examples of the magenta image-forming couplers include 5-pyrazolone couplers; 1H-pyrazolo[1,5-a]benzimidazole couplers; 1H-pyrazolo[5,1-c][1,2,4]triazole couplers; 1H-pyrazolo[1,5-b][1,2,4]triazole couplers; 1H-imidazo[1,2-b]pyrazole couplers; cyanoacetophenone couplers; active propene couplers described in WO 93/01523; enamine couplers described in WO 93/07534; 1H-imidazo[1,2-b][1,2,4] triazole couplers; and couplers described in U.S. Pat. No. 4,871,652.

Examples of the cyan image-forming couplers include phenol couplers; naphthol couplers; 2,5-diphenylimidazole couplers described in EP 249 453 A; 1H-pyrrolo[1,2-b][1,2,4] triazole couplers; 1H-pyrrolo[2,1-c][1,2,4] triazole couplers; pyrrole couplers described in JP 4-188137 A and JP 4-190347 A; 3-hydroxypyridine couplers described in JP 1-315736 A; pyrrolopyrazole couplers described in U.S. Pat. No. 5,164,289; pyrroloimidazole couplers described in JP 4-174429 A; pyrazolopyrimidine couplers described in U.S. Pat. No. 4,950,585; pyrrolotriazine couplers described in JP 4-204730 A; couplers described in U.S. Pat. No. 4,746,602; couplers described in U.S. Pat. No. 5,104,783; couplers described in U.S. Pat. No. 5,162,196; and couplers described in EP 556 700 B; etc.

The amount of the coupler is preferably 0.2 to 200 mmol, more preferably 0.3 to 100 mmol, and particularly 0.5 to 30 mmol, per one mol of silver in silver halide. The coupler may be used alone or in combination with other couplers.

In the present invention, a functional coupler may be used in addition to the above-mentioned coupler contributing to coloring. Examples of the functional couplers include couplers forming dyes having appropriate diffusion properties described in U.S. Pat. Nos. 4,366,237, GB 2,125,570, EP 096 873 B and DE 3,234,533; couplers for compensating the useless absorption of dyes, such as yellow-colored cyan couplers and yellow-colored magenta couplers described in EP 456 257 A1, magenta-colored cyan couplers described in U.S. Pat. No. 4,833,069 and colorless masking couplers represented by (2) of U.S. Pat. No. 4,837,136 or formula (A) of WO 92/11575, particularly, exemplified compounds in pages 36 to 45; etc. Further, methine dye-releasing couplers described in U.S. Pat. Nos. 5,447,819 and 5,457,004, and JP 2000-206655 A are also preferably used in the present invention as yellow couplers.

Specific examples of couplers usable for the present invention are illustrated below without intention of restriction.

CP-101
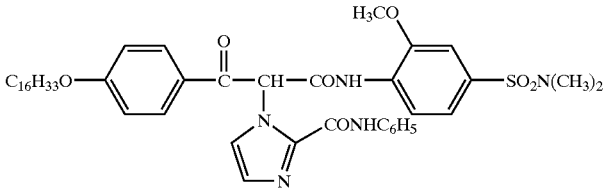
CP-102
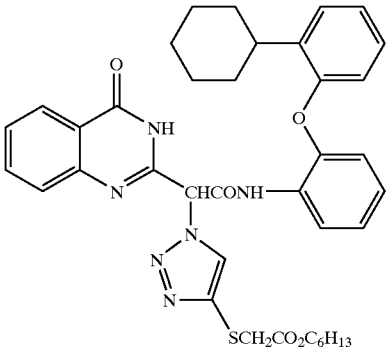
CP-103
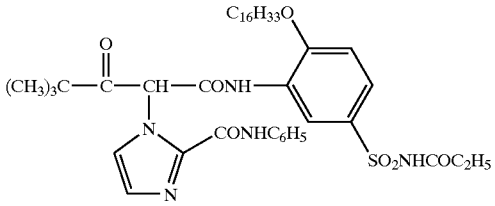
CP-104
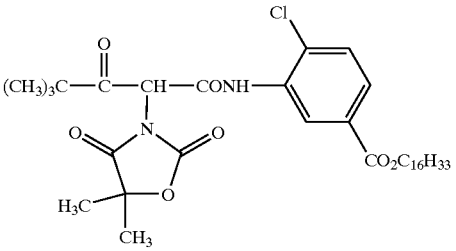
CP-105
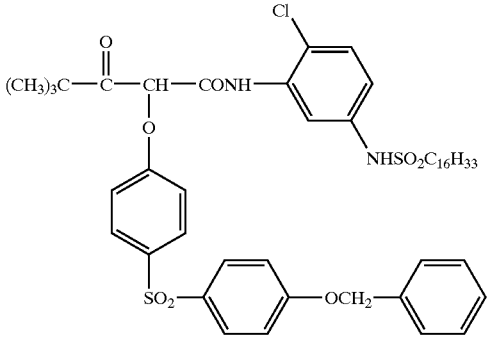
CP-106
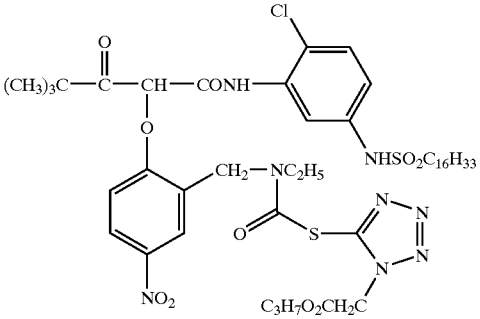
CP-107
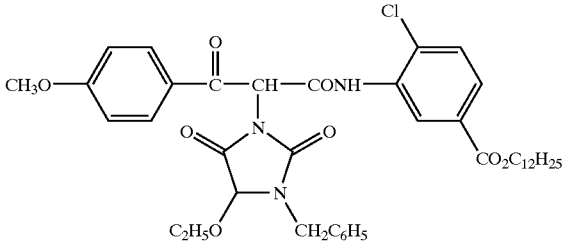
CP-108
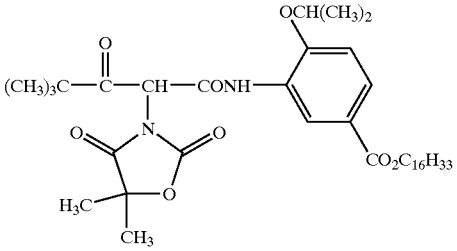
CP-109
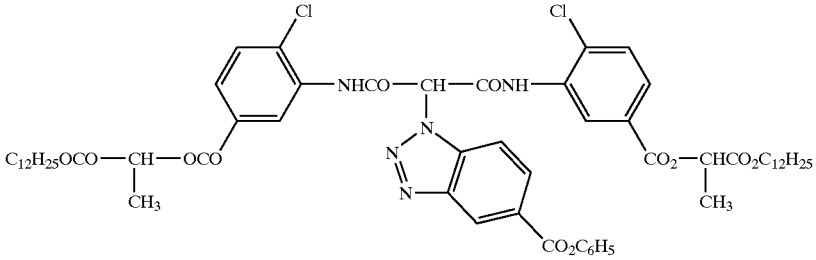

-continued
CP-110
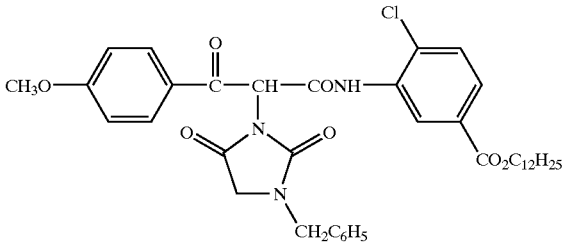
CP-111
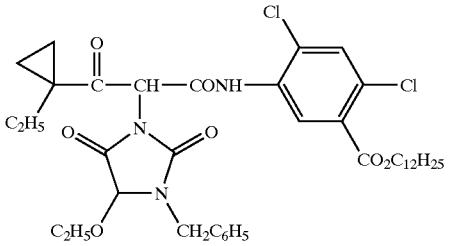
CP-112
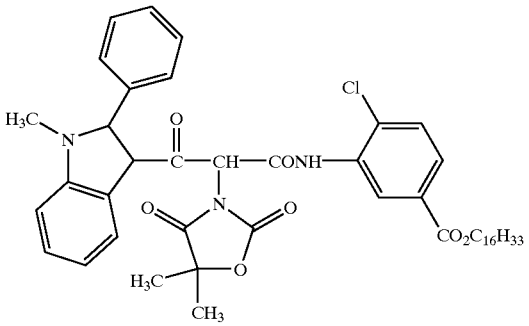
CP-113
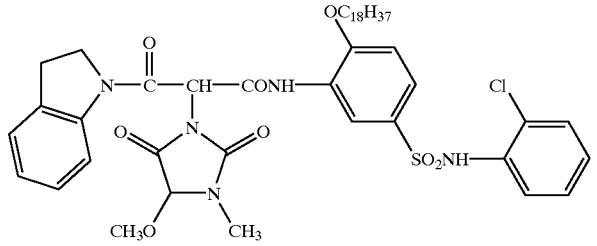
CP-114
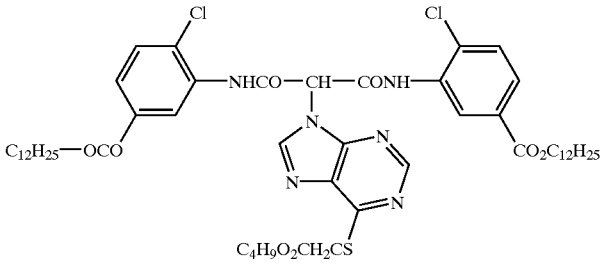
CP-115
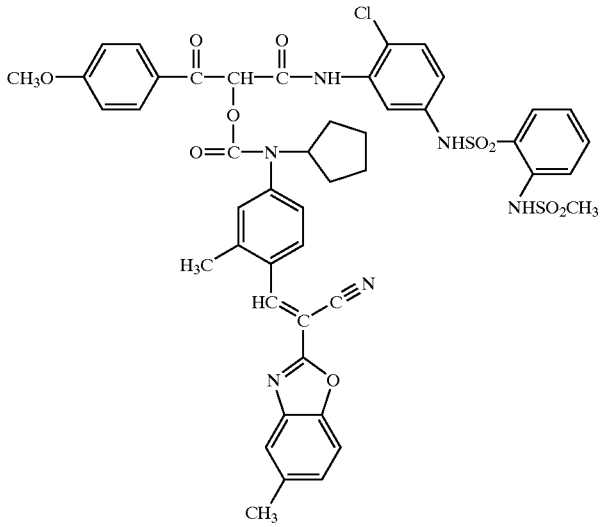
CP-116
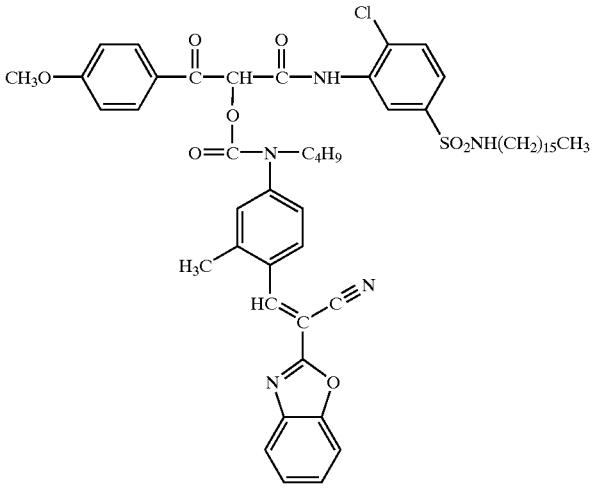
CP-117
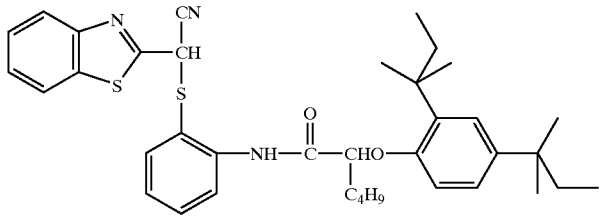

-continued
CP-201
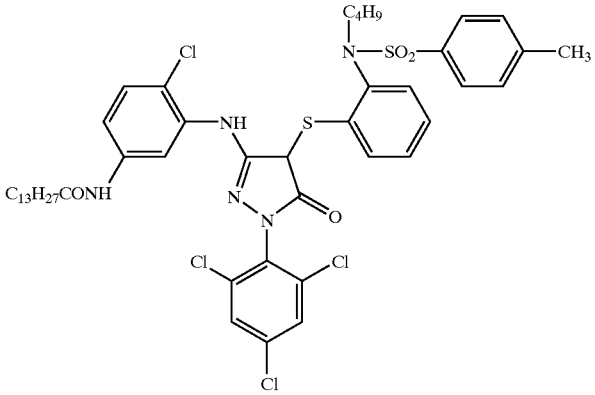
CP-202
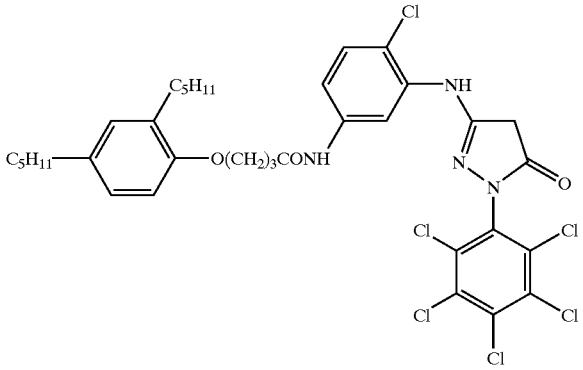
CP-203
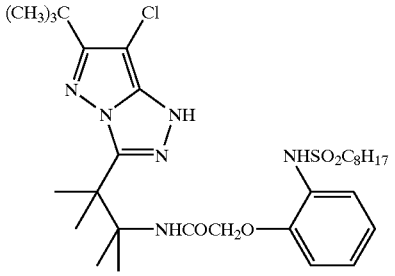
CP-204
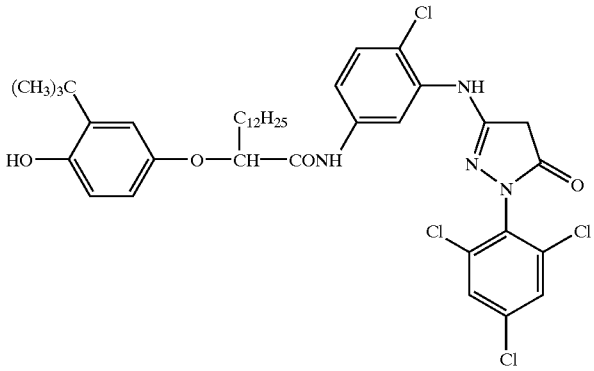
CP-205
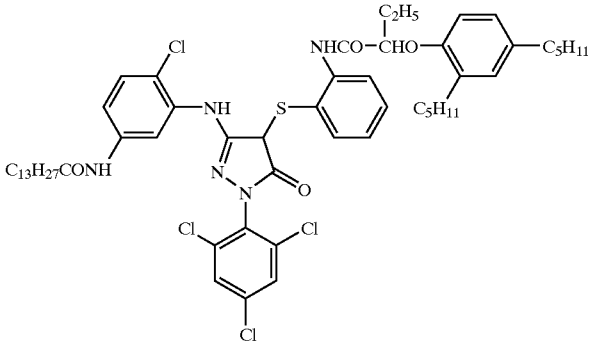
CP-206
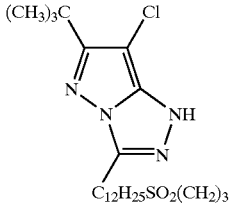
CP-207
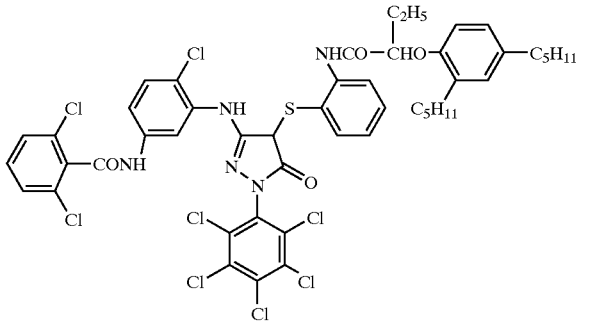
CP-208
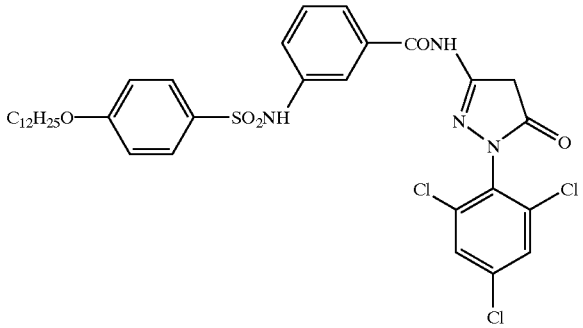

-continued
CP-209
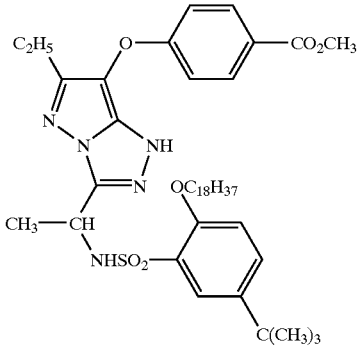
CP-210
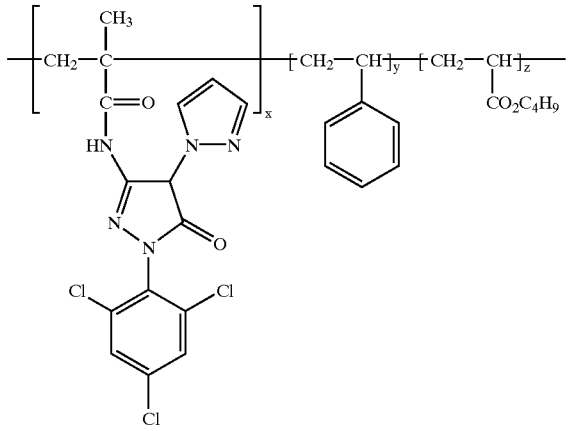
CP-211
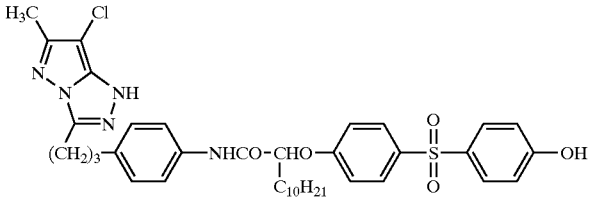
CP-212
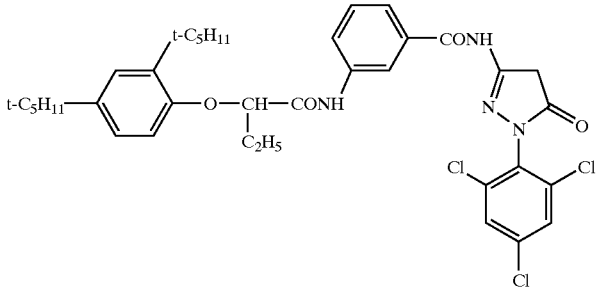
CP-213
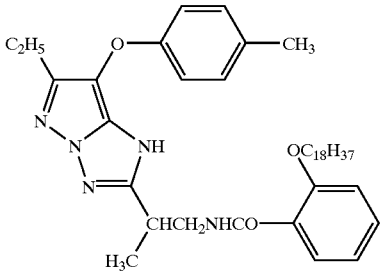
CP-214
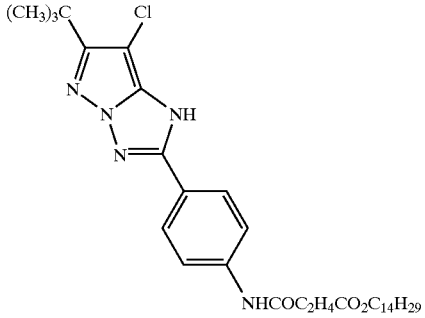
CP-215
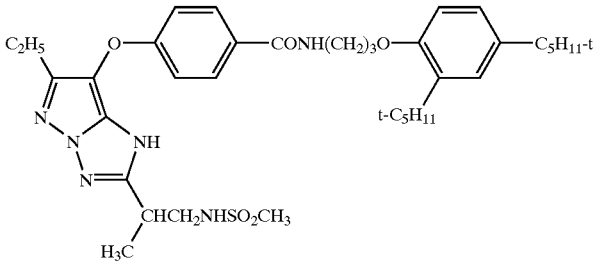
CP-216
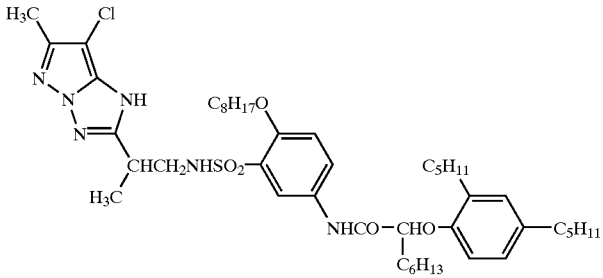

-continued
CP-217
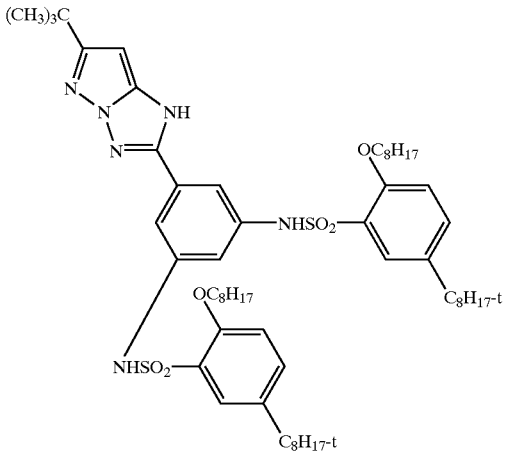
CP-218
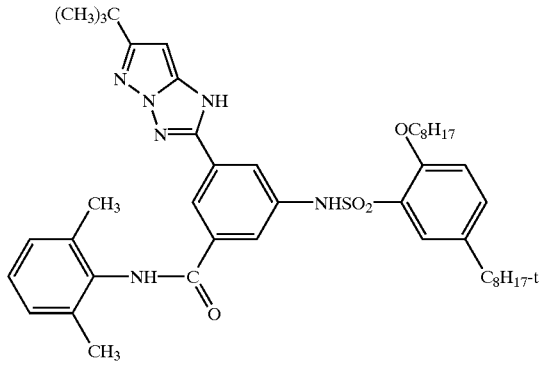
CP-219
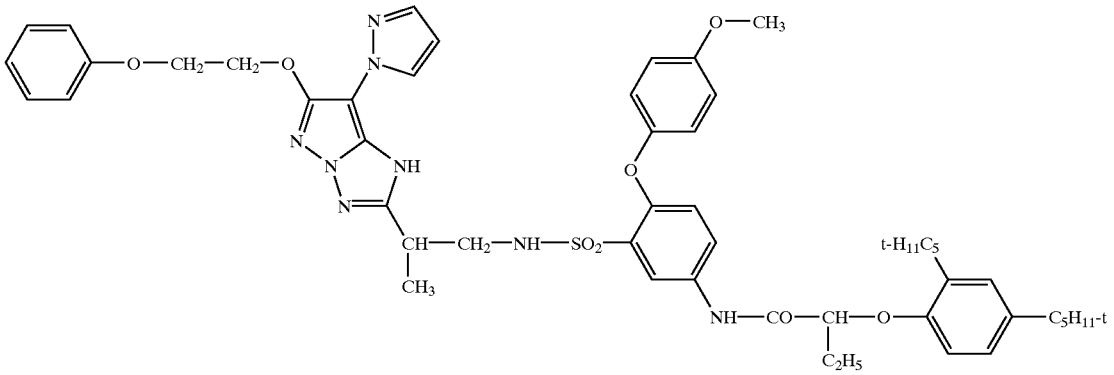
CP-220
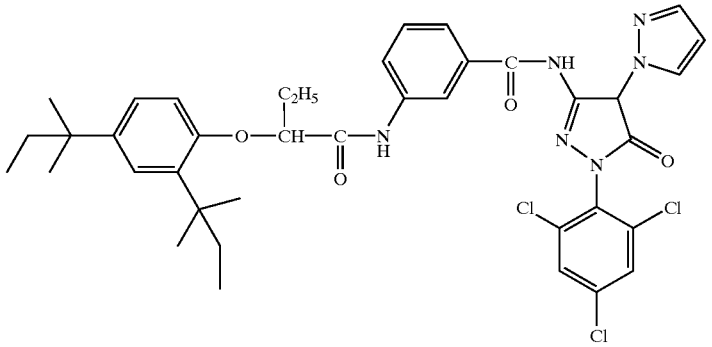
CP-301
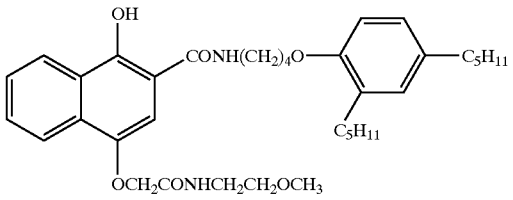
CP-302
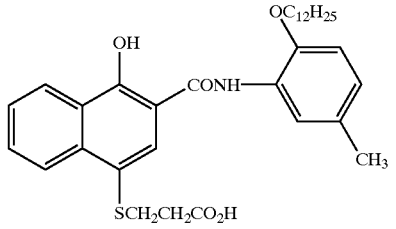
CP-303
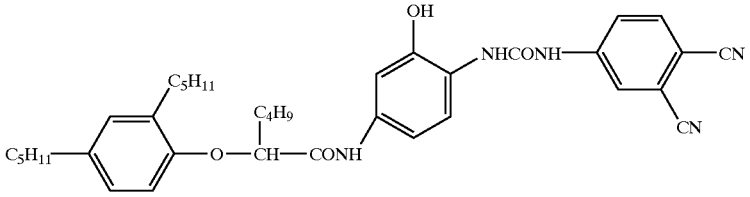

-continued
CP-304
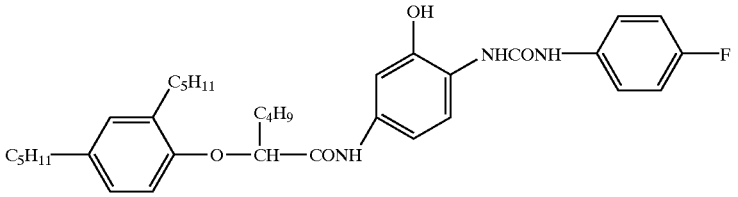
CP-305
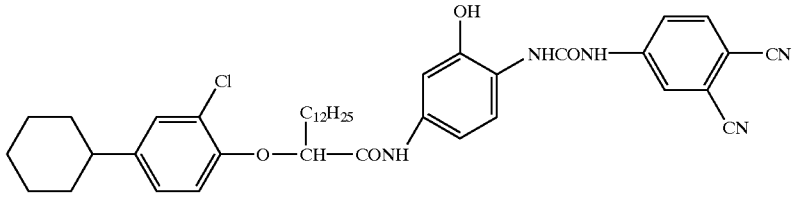
CP-306
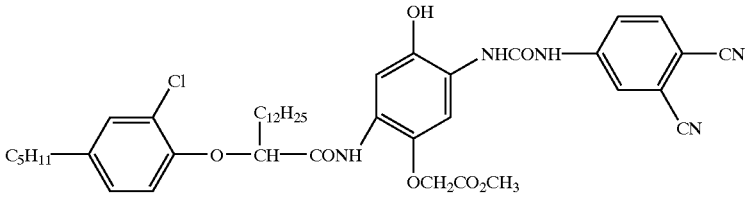
CP-307
CP-308
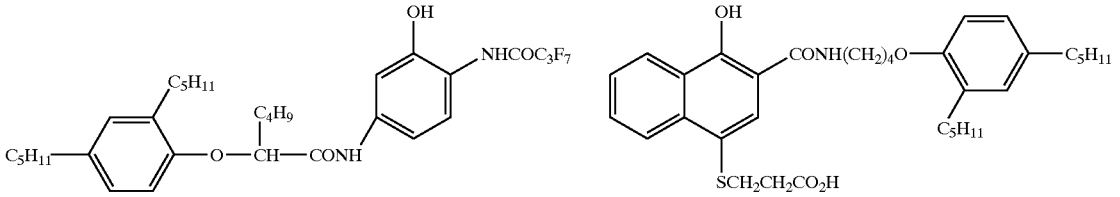
CP-309
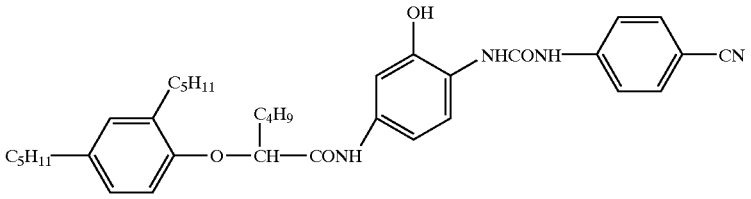
CP-310
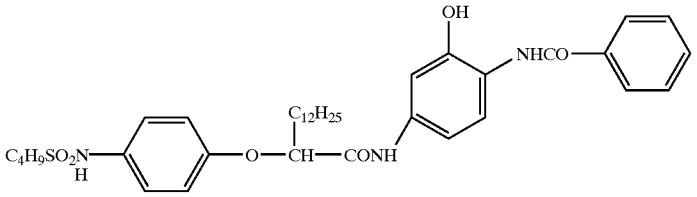
CP-311
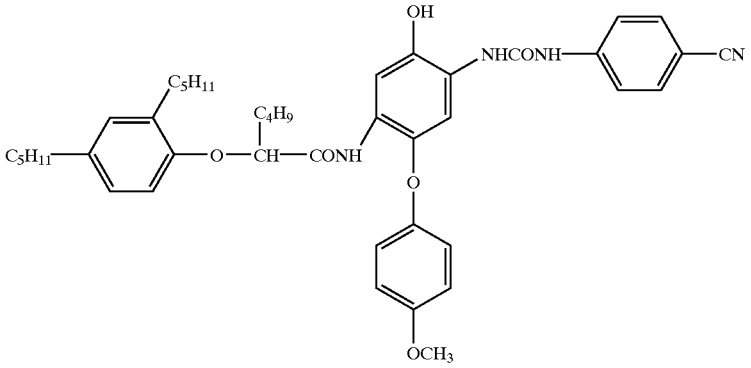

-continued
CP-312
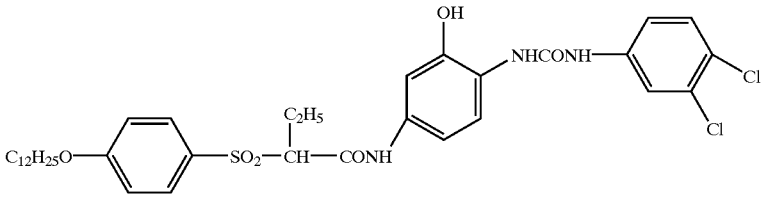
CP-313
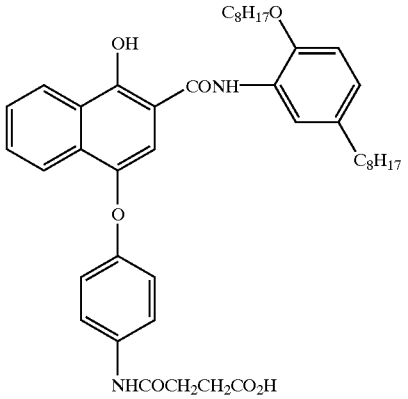
CP-314
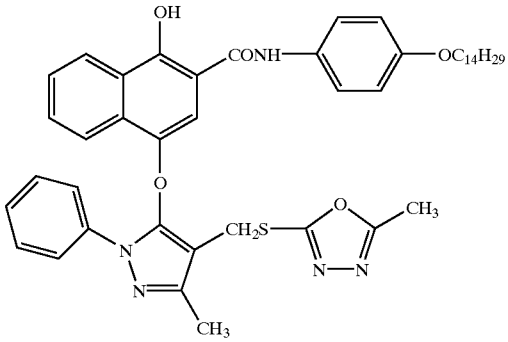
CP-315
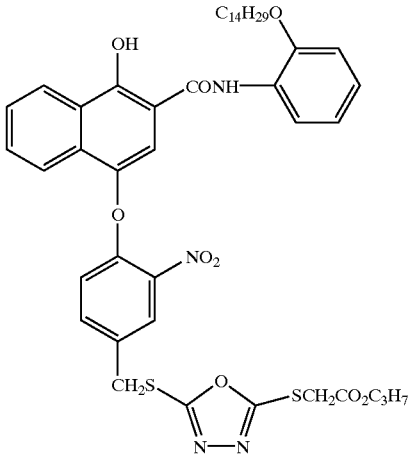
CP-316
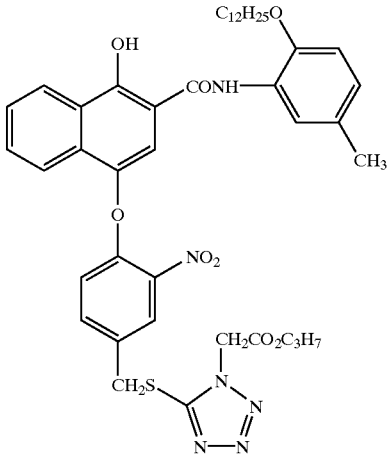
CP-317
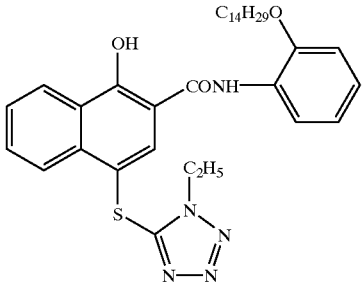
CP-318
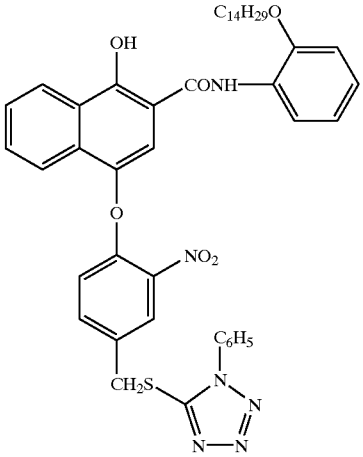

-continued
CP-319
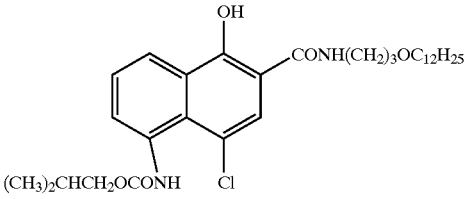
CP-320
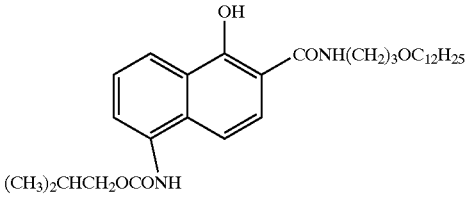
CP-321
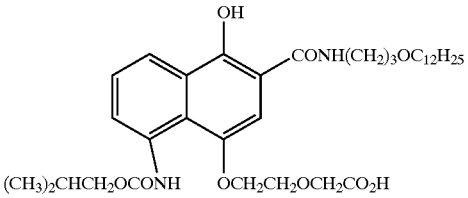
CP-322
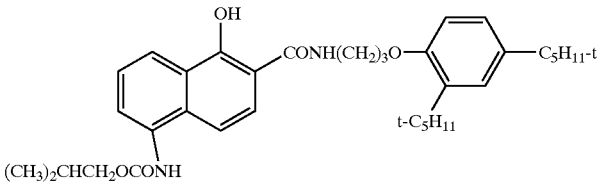
CP-323
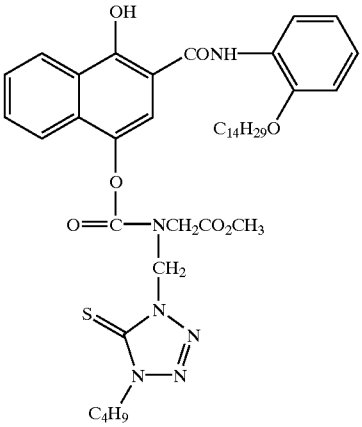
CP-324
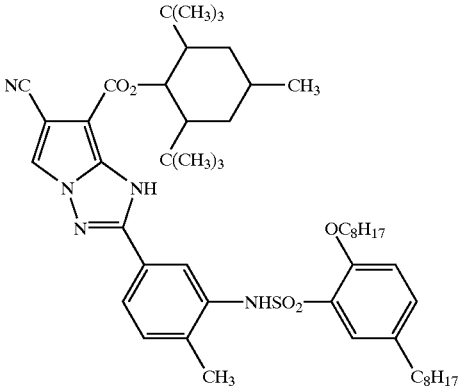
CP-325
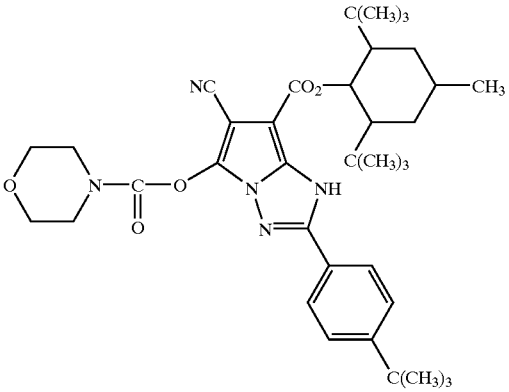
CP-326
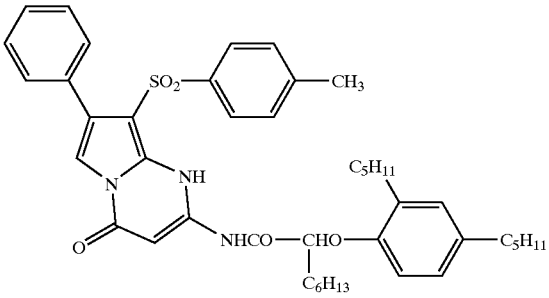
CP-327
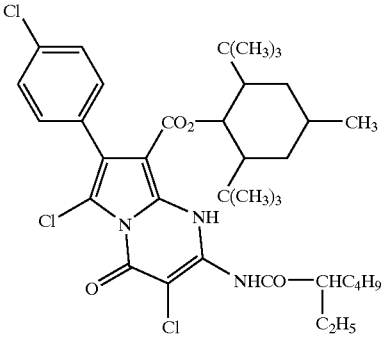
CP-328
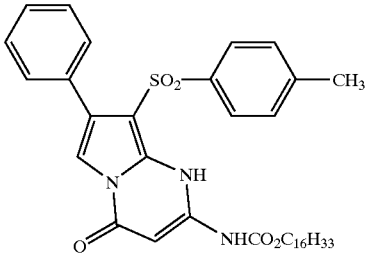

-continued

CP-329

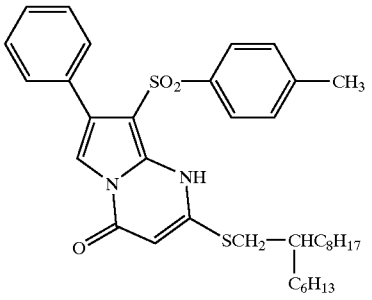

CP-330

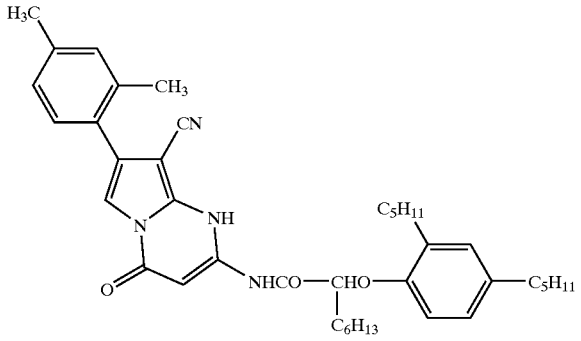

CP-331

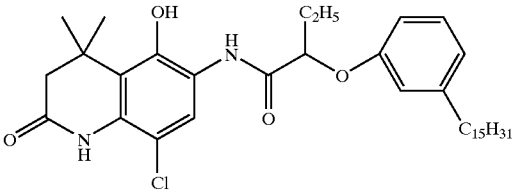

The coupler is easily synthesized by a known method described in the above patent specifications related to couplers.

The coupler used in the present invention may be dissolved in water or an organic solvent. Examples of the organic solvents include alcohols such as methanol, ethanol, propanol, fluorinated alcohol; ketones such as acetone, methyl ethyl ketone; dimethylformamide; dimethylsulfoxide; methyl cellosolve; etc.

Though the coupler may be added to any layer on the substrate as long as at the same side of the silver halide or the organic silver salt, the coupler is preferably added to the layer comprising the silver halide or the layers adjacent thereto.

When the silver halide photosensitive material of the present invention is used as a photographic material, the amount of the coupler is preferably 0.5 to 1 mmol, more preferably 0.2 to 10 mmol, per one mol of silver in silver halide.

(E) Developing Agent p-phenylenediamine compounds, p-aminophenol compounds, etc. may be used as developing agents. Preferred examples of the developing agents include sulfonamidephenol compounds disclosed in JP 8-110608 A, JP 8-122994 A, JP 9-15806 A, JP 9-146248 A, etc.; sulfonylhydrazine compounds disclosed in EP 545 491 A, JP 8-166664 A, JP 8-227131 A, etc.; carbamoylhydrazine compounds disclosed in JP 8-286340 A; sulfonylhydrazone compounds disclosed in JP 8-202002 A, JP 10-186564 A, JP 10-239793 A; carbamoylhydrazone compounds disclosed in JP 8-234390 A; sulfamic acid compounds disclosed in JP 63-36487 B; sulfohydrazone compounds disclosed in JP 4-20177 B; 4-sulfonamidepyrazolone compounds disclosed in JP 5-48901 B; p-hydroxyphenylsulfamic acid compounds disclosed in JP 4-69776 B; sulfamic acid compounds having a benzene ring substituted by an alkoxy group disclosed in JP 62-227141 A; hydrophobic salts composed of a color-developing agent having an amino group and an organic acid disclosed in JP 3-15052 A; hydrazone compounds disclosed in JP 2-15885 B; ureidoaniline compounds disclosed in JP 59-111148 A; sulfamoylhydrazone compounds disclosed in U.S. Pat. No. 4,430,420; aromatic primary amine derivatives having a sulfonylaminocarbonyl group or an acylaminocarbonyl group disclosed in JP 3-74817 B; compounds releasing an aromatic primary amine developing agent via a reverse Michael reaction disclosed in JP 62-131253 A; aromatic primary amine derivatives having a fluorine-substituted acyl group disclosed in JP 5-33782 B; aromatic primary amine derivatives having an alkoxycarbonyl group disclosed in JP 5-33781 B; oxalic acid amide-type, aromatic primary amine derivatives disclosed in JP 63-8645 A; Schiff base-type, aromatic primary amine derivatives disclosed in JP 63-123043 A; etc. Particularly preferable among them are sulfonamidephenol compounds disclosed in JP 8-110608 A, JP 8-122994 A, JP 8-146578 A, JP 9-15808 A, JP 9-146248 A, etc.; carbamoylhydrazine compounds disclosed in JP 8-286340 A; and aromatic primary amine derivatives disclosed in JP 3-74817 B and JP 62-131253 A.

Specific examples of the developing agent used in the present invention are illustrated below without intention of restricting the scope of the present invention.

(a) Specific Examples of the Carbamoylhydrazine Developing Agents D-1 to D-23

D-1
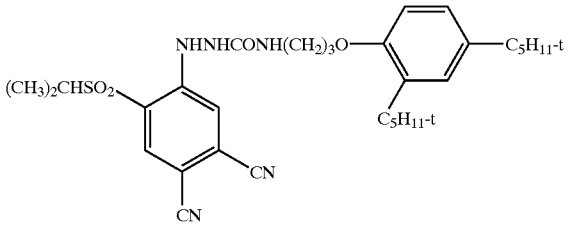
D-2
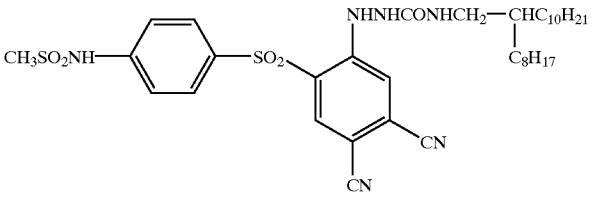
D-3
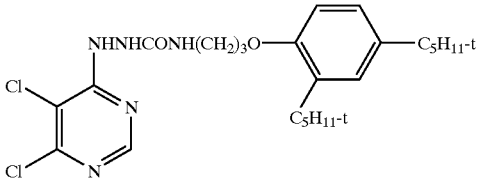
D-4
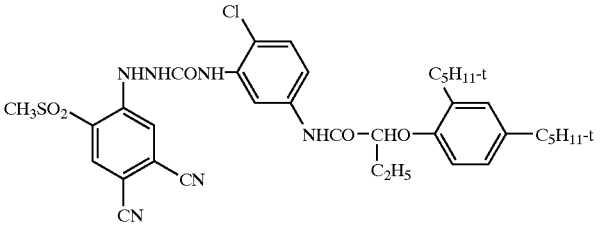
D-5
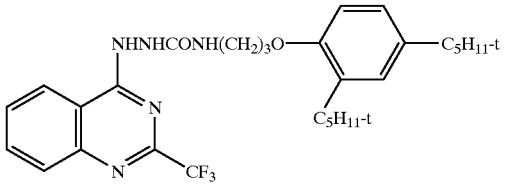
D-6
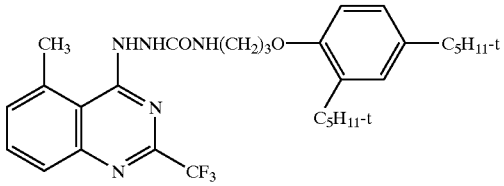
D-7
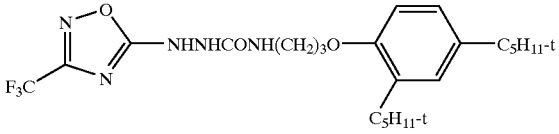
D-8
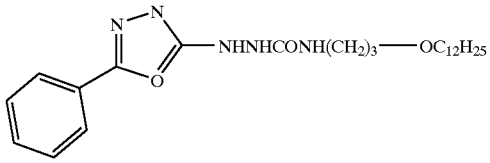
D-9
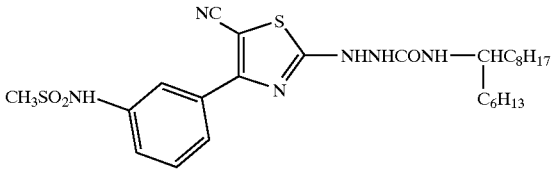
D-10
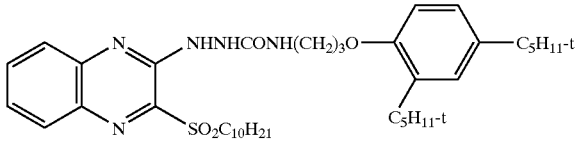
D-11
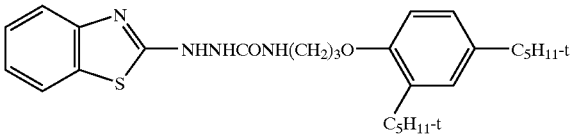
D-12
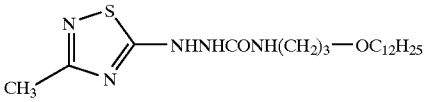
D-13
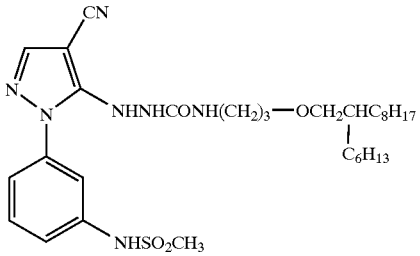
D-14
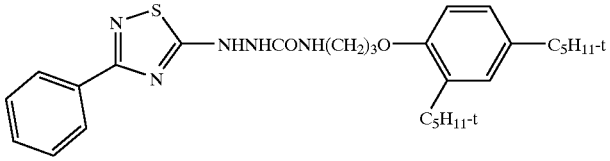

-continued

D-15

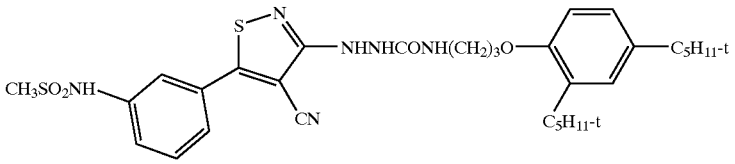

D-16

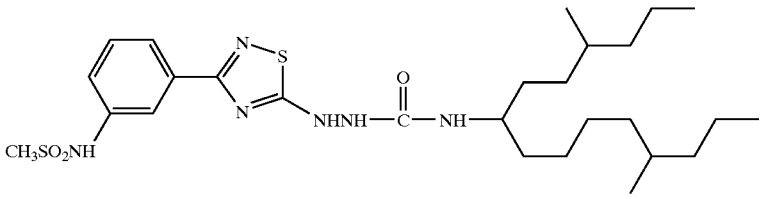

D-17

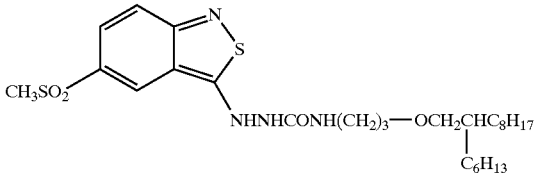

D-18

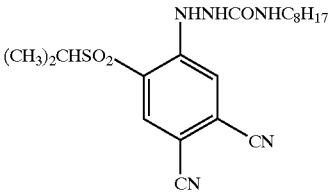

D-19

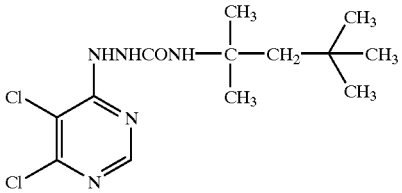

D-20

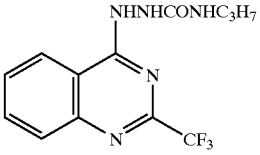

D-21

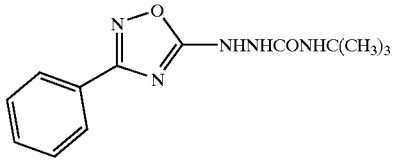

D-22

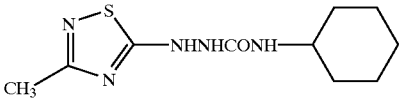

D-23

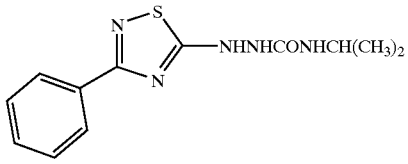

Compounds (1) to (80) disclosed in JP 8-286340 A, pages 7 to 22; Compounds H-1 to H-72 disclosed in JP 9-152700 A, pages 9 to 26; Compounds D-1 to D-19 disclosed in JP 9-152701 A, pages 7 to 11; Compounds D-1 to D-39 disclosed in JP 9-152702 A, pages 6 to 13; Compounds D-1 to D-49 disclosed in JP 9-152703 A, pages 7 to 17; Compounds (1) to (45) disclosed in JP 9-152704 A, pages 6 to 18; Compounds (1) to (65) disclosed in JP 9-152705 A, pages 5 to 17; and Compounds D-1 to D-29 disclosed in JP 9-211818 A, pages 7 to 15, may be also used as the carbamoylhydrazine developing agent in the present invention.

(b) Specific Examples of Sulfonamidephenol Developing Agents SA-1 to SA-15

SA-1

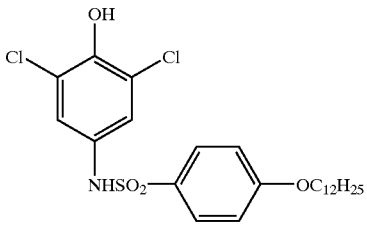

-continued
SA-2
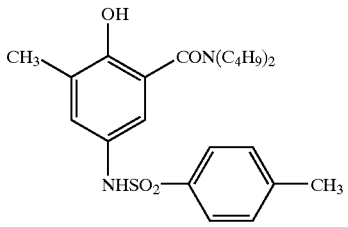
SA-3
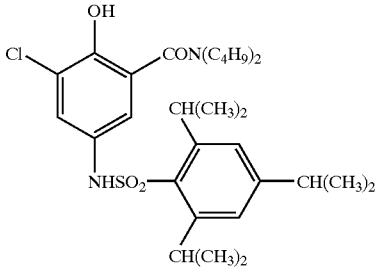
SA-4
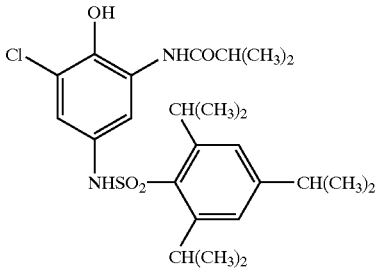
SA-5
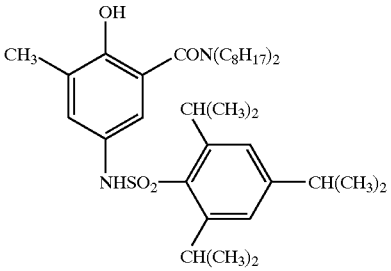
SA-6
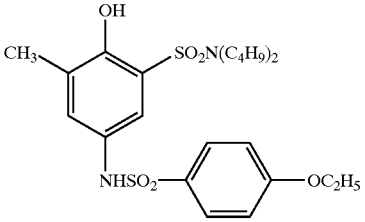
SA-7
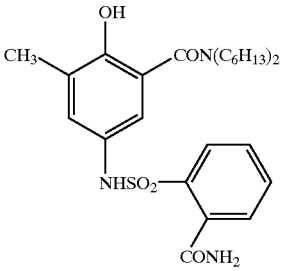
-continued
SA-8
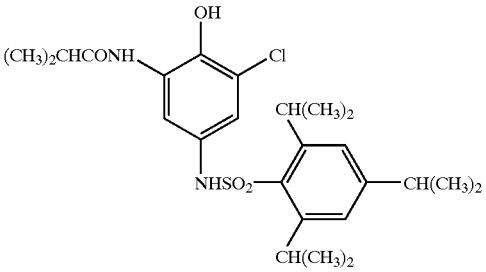
SA-9
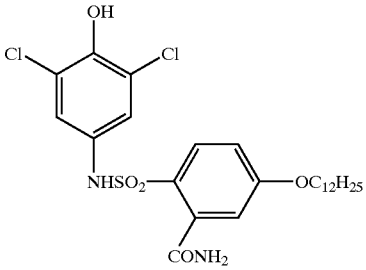
SA-10
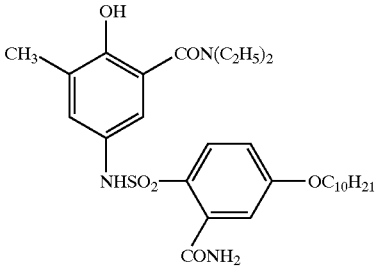
SA-11
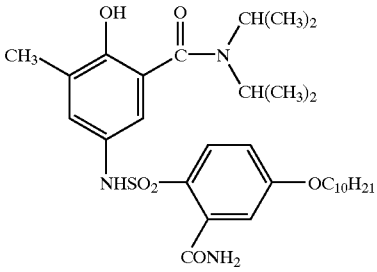
SA-12
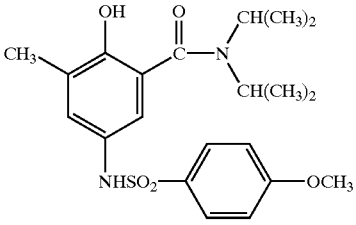
SA-13
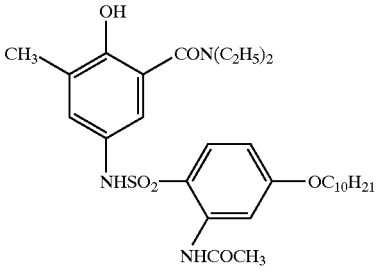

-continued

SA-14

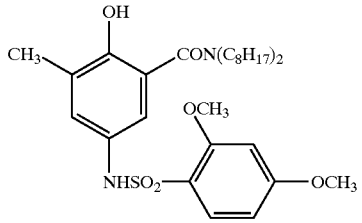

SA-15

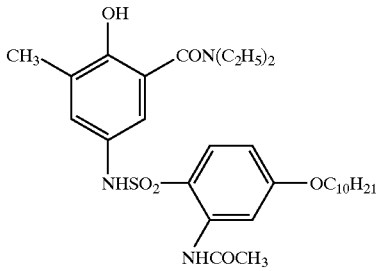

Compounds I-1 to I-23 disclosed in JP 8-110608 A, pages 13 to 16; Compounds I-1 to I-21 disclosed in JP 8-122994 A, page 27; Compounds D-1 to D-30 disclosed in JP 9-15806 A, pages 4 to 7; Compounds D-1 to D-35 disclosed in JP 9-146248 A, pages 9 to 15; Compounds D-1 to D-38 disclosed in JP 10-186564 A, pages 9 to 15; Compounds D-1 to D-37 disclosed in JP 10-239793 A, pages 9 to 16; Compounds D-1 to D-42 disclosed in JP 11-125886 A, pages 5 to 9; Compounds D-1 to D-25 disclosed in JP 11-143037 A, pages 6 to 13; and Compounds D-1 to D-56 disclosed in JP 11-149146 A, pages 5 to 12 may be also used as the sulfonamidephenol developing agent in the present invention.

(c) Specific Examples of the Developing Agents of Aromatic Primary Amine Derivatives DEVP-1 to DEVP-27

DEVP-1

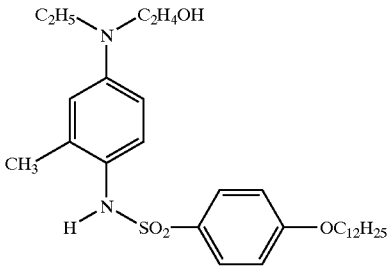

DEVP-2

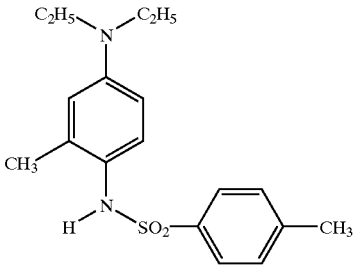

-continued

DEVP-3

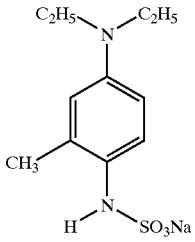

DEVP-4

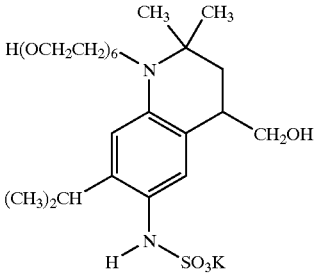

DEVP-5

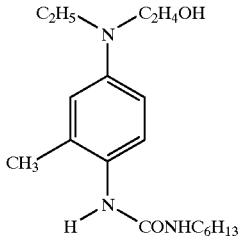

DEVP-6

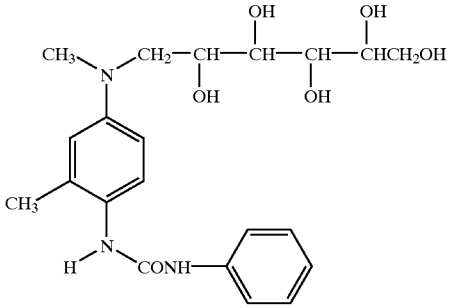

DEVP-7

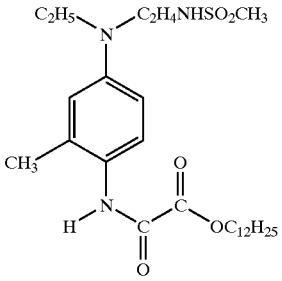

-continued
DEVP-8
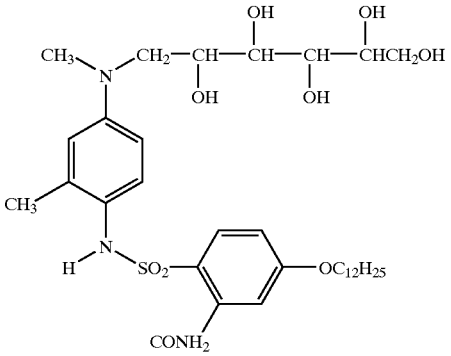
DEVP-9
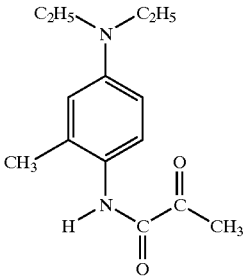
DEVP-10
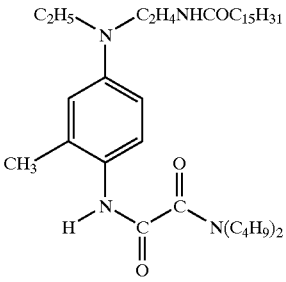
DEVP-11
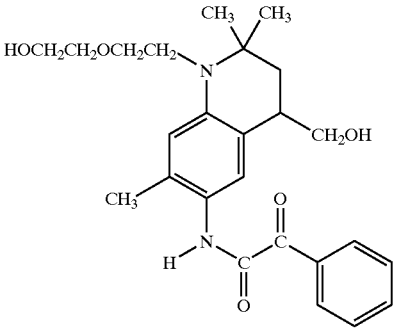
DEVP-12
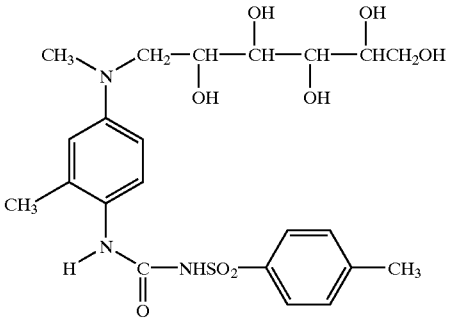
-continued
DEVP-13
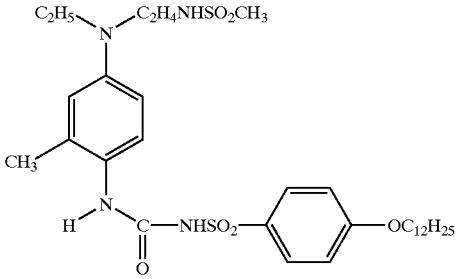
DEVP-14
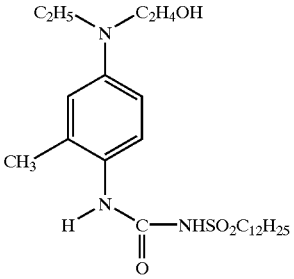
DEVP-15
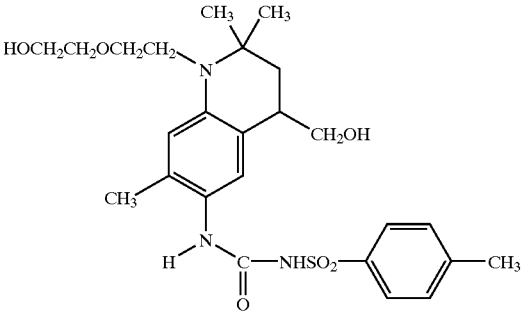
DEVP-16
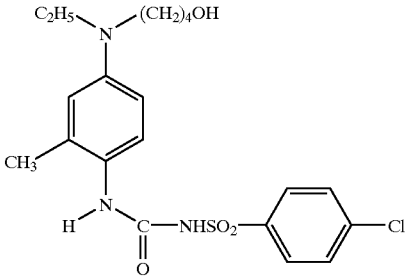
DEVP-17
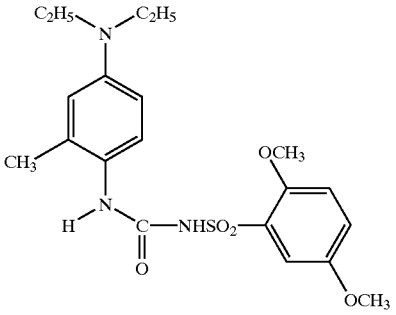

-continued
DEVP-18
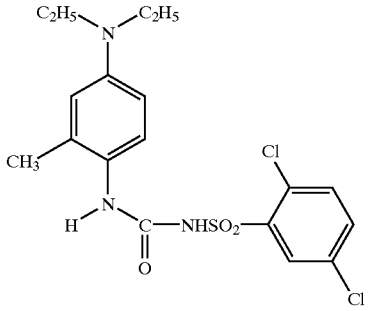
DEVP-19
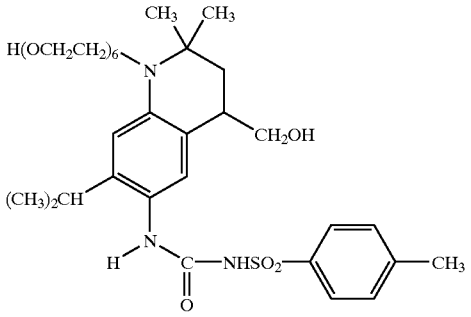
DEVP-20
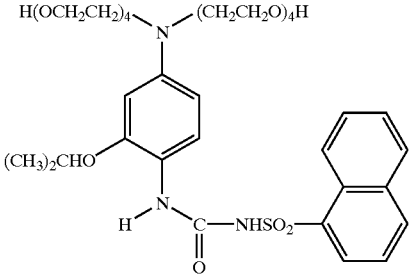
DEVP-21
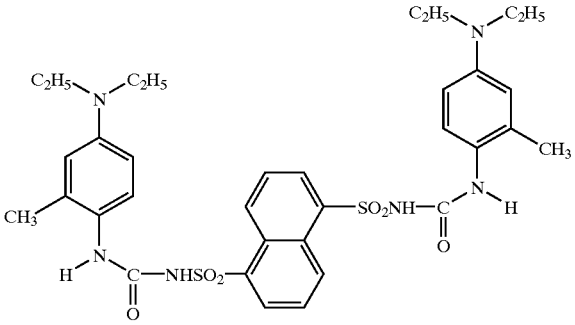
DEVP-22
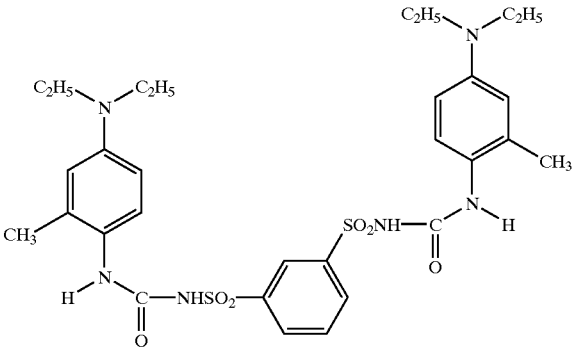
-continued
DEVP-23
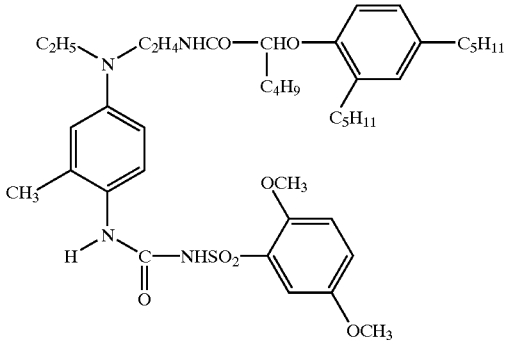
DEVP-24
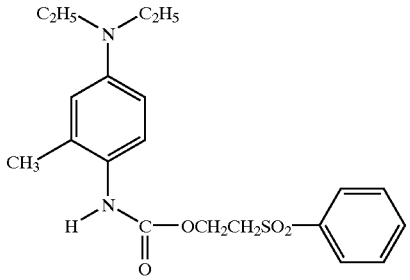
DEVP-25
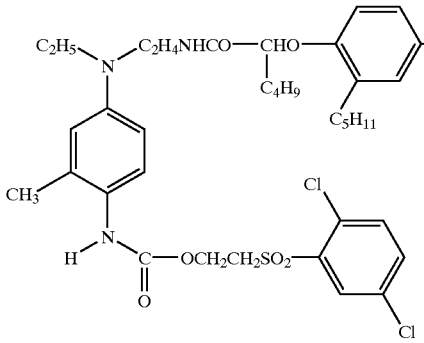
DEVP-26
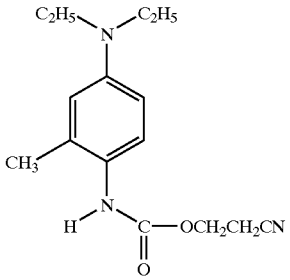
DEVP-27
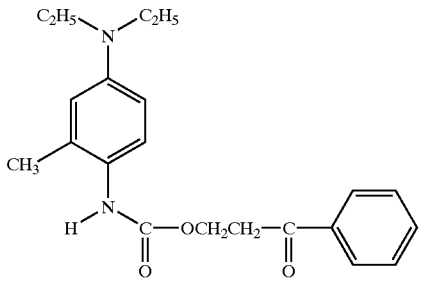
Also usable as the developing agents of aromatic primary amine derivatives are Compounds 1 to 36 disclosed in JP 61-34540 A, pages 3 to 7; Compounds 1 to 32 disclosed in JP 62-131253 A, pages 5 to 6; Compounds 1 to 53 disclosed in JP 5-257225 A, pages 5 to 11; and Compounds 1 to 53 disclosed in JP 5-249602 A, pages 5 to 12, and solid grain dispersions thereof. Preferable as the aromatic primary amine derivative developing agent is a blocked p-phenylenediamine compound, whose p-phenylenediamine moiety has a formula weight of 300 or more. Further, a derivative prepared by substituting the block group of the p-phenylenediamine compound by a hydrogen atom preferably exhibits an oxidation potential of 5 mV or less (vs. SCE) in an aqueous solution at pH of 10.

(d) Other Developing Agents

Developing agents DEVP-28 to DEVP-35 disclosed in EP 1 113 322 A, EP 1 113 323 A, EP 1 113 324 A, EP 1 113 325 A and EP 1 113 326 A are also preferably used in the present invention.

DEVP-28

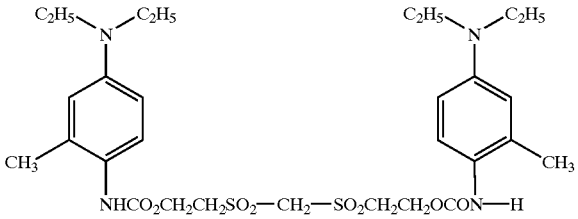

DEVP-29

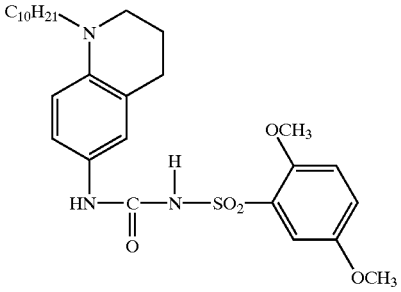

DEVP-30

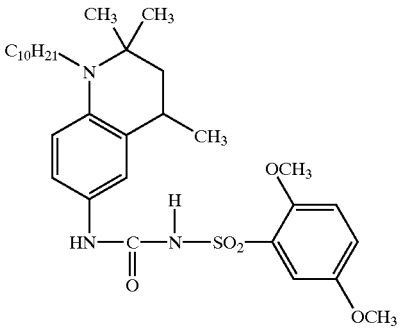

-continued

DEVP-31

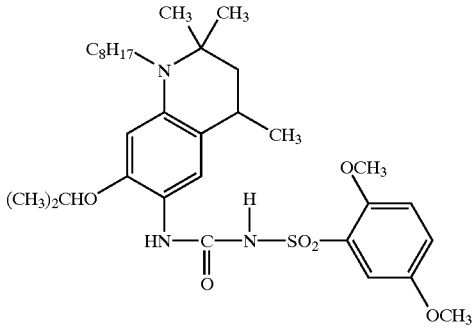

DEVP-32

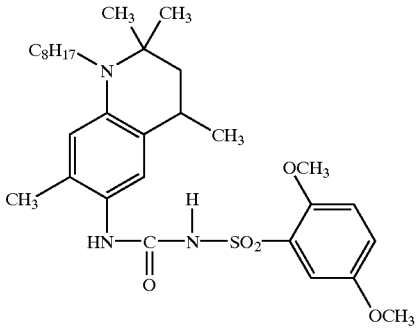

DEVP-33

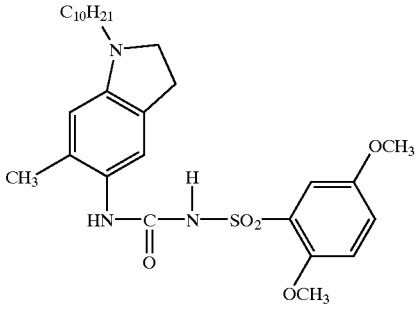

DEVP-34

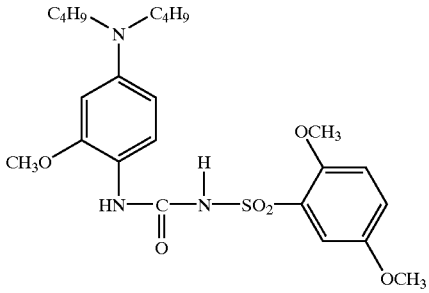

DEVP-35

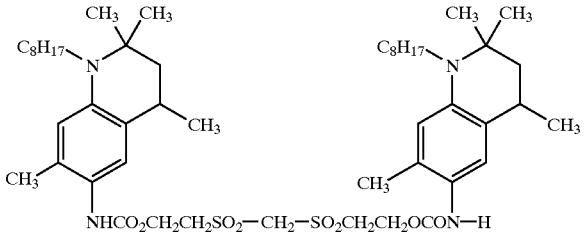

The developing agent may be added to the coating liquid in the form of a solution, powder, a solid dispersion of fine grains, an emulsion, an oil-protected dispersion, etc. The solid dispersion of fine grains may be prepared by a known method using a ball mill, a vibration ball mill, a sand mill, a colloid mill, a jet mill, a roller mill, etc. A dispersant may be used in the preparation of the solid fine grain dispersion.

A molar ratio of the developing agent to the dye-providing compound (coupler) is preferably 0.01 to 100, more preferably 0.1 to 10.

Hydrophobic additives such as the coupler, the color-developing agent, etc. may be introduced into the photosensitive material by a known method as described in U.S. Pat. No. 2,322,027, etc. When the hydrophobic additives are introduced into the photosensitive material, a low-boiling organic solvent having a boiling point of 50 to 160° C. may be used in combination with a high-boiling organic solvent disclosed in U.S. Pat. Nos. 4,555,470, 4,536,466, 4,536,467, 4,587,206, 4,555,476 and 4,599,296, JP 3-62256 B, etc., if necessary.

A plurality of the couplers, the high-boiling organic solvents, etc. may be used in combination therewith. The amount of the high-boiling-point organic solvent is generally 0.1 g to 10 g, preferably 0.1 g to 5 g, more preferably 0.1 g to 1 g, per 1 g of the hydrophobic additives. Further, the amount of the high-boiling-point organic solvent per 1 g of the binder is preferably 1 ml or less, more preferably 0.5 ml or less, particularly preferably 0.3 ml or less.

The hydrophobic additives may be added to the photosensitive material by a dispersion method using a polymer described in JP 51-39853 B and JP 51-59943 A; or a method where the hydrophobic additives are formed into a dispersion of fine particles to be added described in JP 62-30242 A, etc. The hydrophobic additives substantially insoluble in water may be added and dispersed in the binder as fine particles. Various surfactants may be used when the hydrophobic additives are dispersed in a hydrophilic colloid. The surfactants disclosed in JP 59-157636 A, pages 37 to 38, in RD, etc. may be used in the present invention. Further, phosphate surfactants described in JP 7-56267A and JP 7-228589A, and West German Patent 1,932,299A may also be used in this invention. The coupler may be dispersed in water as fine particles by a known solid dispersion method using a ball mill, a colloid mill, a sand grinder mill, a mantongaulin, a microfluidizer or ultrasonic wave.

Compounds that react with an oxidized developing agent to release a photographically useful residue may be used in the present invention. Examples of such compounds include development inhibitor-releasing compounds such as compounds represented by any of formulae (I) to (IV) described in EP 378 236 A1, compounds represented by formula (1) described in EP 436,938A2, page 7, compounds represented by formula (1) described in EP 568 037 A and compounds represented by formula (I), (II) or (III) described in EP 440 195 A2; bleach accelerator-releasing compounds such as compounds represented by formula (I) or (I') described in EP 310 125 A2 and compounds represented by formula (I) described in JP 6-59411 A; ligand-releasing compounds such as compounds represented by LIG-X described in U.S. Pat. No. 4,555,478; leuco dye-releasing compounds such as compounds 1 to 6 described in columns 3 to 8 of U.S. Pat. No. 4,749,641; fluorescent dye-releasing compounds such as compounds represented by COUP-DYE described in U.S. Pat. No. 4,774,181; development accelerator development accelerator- or fogging agent-releasing compounds such as compounds represented by formula (1), (2) or (3) described in U.S. Pat. No. 4,656,123 and compounds represented by ExZK-2 described in EP 450 637 A2; and compounds releasing a group acting as a dye such as compounds represented by formula (I) of U.S. Pat. No. 4,857,447, compounds represented by formula (1) of JP 5-307248 A, compounds represented by formula (I), (II) or (III) described in EP 440 195 A2, compounds represented by formula (I) of JP 6-59411 A and compounds represented by LIG-X of U.S. Pat. No. 4,555,478.

The amount of each of the functional couplers and the compounds reactable with the oxidized developing agent to release the residue is preferably 0.05 to 10 mol, preferably 0.1 to 5 mol, per one mol of the above-mentioned coupler that acts to color.

(F) Development Accelerator

Heterocyclic compounds having ClogP sufficient to improve sensitivity disclosed in EP 1 016 902 A are preferably used in the present invention. A compound X is shown below as an example of the heterocyclic compound. Also preferably used are triazole compounds having ClogP of 4.75 to 9.0 disclosed in JP 2001-051383 A; purine compounds having ClogP from 2 to less than 7.2 disclosed in JP 2001-051384 A; mercapto-1,2,4-thiadiazole compounds and mercapto-1,2,4-oxadiazole compounds having ClogP from 1 to less than 7.6 disclosed in JP 2001-051385 A; and tetrazole compounds having ClogP from 2 to less than 7.8 disclosed in JP 2001-051386 A. These compounds may be added to the silver halide photosensitive material in the form of fine drops of a high-boiling-point organic solvent in which they are dissolved, or to the binder in the form of a solution in a water-miscible solvent, like the other oil-soluble compounds such as the developing agent and the coupler. Further, the compounds may be converted to silver salts and then added to the photosensitive material. In this case, it may be added to the photosensitive material in the form of a solid dispersion.

Though the amount of the above compound may be determined in a wide range depending on use, it is generally $1\times10^{-5}$ to 1 mol per one mol of the silver halide. The amount of the above compound is preferably $10^{-3}$ to $10^{-1}$ mol per one mol of the silver halide, in the case of using the compound in a free state or in the form of an alkali metal salt, and preferably $10^{-2}$ to 1 mol per one mol of the silver halide in the case of using the compound in the form of a silver salt.

(G) Thermal Solvent

The thermal solvent used in the present invention is an organic material, which is in a solid state at an ambient temperature, exhibits an eutectic point in combination with the other components at a temperature equal to or slightly lower than a thermal development temperature of the silver halide photosensitive material, and is turned to a liquid state during the thermal development to promote the thermal development or thermal transfer of the dye. Usable as the thermal solvents are compounds that can be solvents for the developing agent, compounds having high dielectric constants and promoting the physical development of the silver salt, compounds compatible with binders and capable of swelling them, etc.

Examples of the thermal solvents include compounds described in U.S. Pat. Nos. 3,347,675, 3,667,959, 3,438,776 and 3,666,477; RD, No. 17643; JP 51-19525 A, JP 53-24829 A, JP 53-60223 A, JP 58-118640 A, JP 58-198038 A, JP 59-229556 A, JP 59-68730 A, JP 59-84236 A, JP 60-191251 A, JP 60-232547 A, JP 60-14241 A, JP 61-52643 A, JP 62-78554 A, JP 62-42153 A, JP 62-44737 A, JP 63-53548 A, JP 63-161446 A, JP 1-224751 A, JP 2-863 A, JP 2-120739 A, JP 2-123354 A and JP 4-289856 A; etc. More specifically, low-water-solubility thermal solvents suitable for the dispersion of fine crystals may be selected from urea derivatives such as urea, dimethylurea and phenylmethyl urea; amide derivatives such as acetoamide, stearylamide, p-toluamide, salicylanilide and p-propanoyloxyethoxybenzamide; sulfonamide derivatives such as p-toluenesulfonic amide; polyalcohols such as 1,6-hexanediol, pentaerythritol, D-sorbitol, polyethylene glycol; etc.

Specific examples of the thermal solvent usable for the present invention are illustrated below together with melting point thereof, without intention of restricting the scope of the present invention.

TS-1

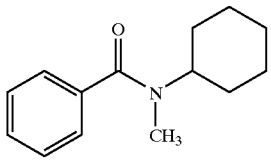

mp: 76° C.

TS-2

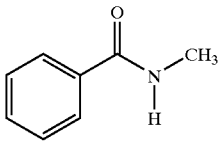

mp: 76° C.

TS-3

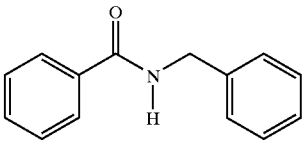

mp: 104° C.

TS-4

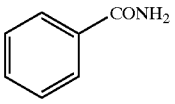

mp: 128° C.

TS-5

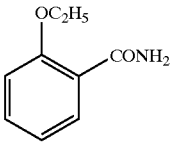

mp: 131° C.

TS-6

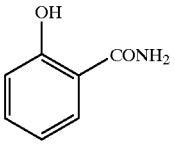

mp: 140° C.

TS-7

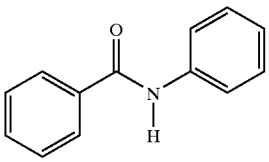

mp: 164° C.

-continued

TS-8

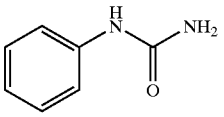

mp: 146° C.

TS-10

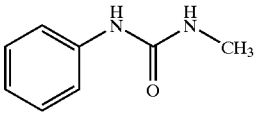

mp: 149° C.

TS-11

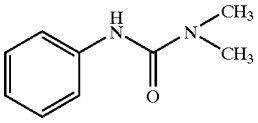

mp: 134° C.

TS-12

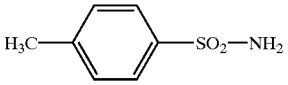

mp: 139° C.

TS-13

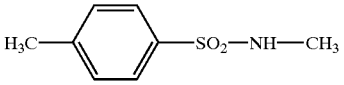

mp: 80° C.

(H) Base Precursor

The silver halide photosensitive material of the present invention may comprise a base precursor or a nucleophilic reagent precursor. A base precursor that is heated to form (or release) a base in the thermal development process is preferably used for the silver halide photosensitive materials. A typical example of such base precursors is a thermal decomposition-type (decarboxylation-type) base precursor of a salt prepared from a carboxylic acid and a base. When the decarboxylation-type base precursor is heated, the carboxyl group is decomposed by a decarboxylation reaction to release a base. The carboxylic acid may be sulfonylacetic acid, propiolic acid, etc., which are easily decarboxylated. The sulfonylacetic acid and the propiolic acid preferably have an aromatic group such as an aryl group and an unsaturated heterocyclic group that accelerates the decarboxylation. The base precursors of the sulfonyl acetic acid salt are described in JP 59-168441 A, and the base precursors of the propiolic acid salt are described in JP 59-180537 A. The base composing the decarboxylation-type base precursor is preferably an organic base, more preferably amidine, guanidine or a derivative thereof. The organic base is preferably a diacidic base, a triacidic base or a tetracidic base, more preferably a diacidic base, particularly a diacidic base of an amidine derivative or a guanidine derivative.

The precursors of the diacidic base, the triacidic base and the tetracidic base of the amidine derivative are described in JP 7-59545 B. The precursors of the diacidic base, the triacidic base and the tetracidic base of the guanidine derivative are described in JP 8-10321 B.

The diacidic base of the amidine derivative or the guanidine derivative is composed of: (a) two amidine moieties or two guanidine moieties, (b) a substituent in the amidine moieties or the guanidine moieties, and (c) a divalent group linking the amidine moieties or the guanidine moieties.

Examples of the substituents (b) include alkyl groups that may be cyclic, alkenyl groups, alkynyl groups, aralkyl groups and heterocyclic groups. A plurality of substituents may be bonded to each other to form nitrogen-containing heterocycles. The divalent linking group (c) is preferably an alkylene group or a phenylene group. Preferred examples of the diacidic base precursors of the amidine or guanidine derivatives include BP-1 to BP-41 disclosed in JP 11-231457 A, pages 19 to 26. Particularly preferable among them are salts of p-(phenylsulfonyl)-phenylsulfonyl acetic acid such as BP-9, BP-32, BP-35, BP-40 and BP-41.

When the decarboxylation-type base precursor is used, bubbles are likely to be formed in the photosensitive material depending on treatment conditions. Accordingly, a molar ratio of the decarboxylation-type base precursor to the electron-donating, organic color former is generally 0.3 or less.

(I) Binder

A binder is generally contained in all layers composing photograph-constituting layers. The binder may be selected from known natural or synthetic resins such as gelatin, polyvinyl acetal, polyvinyl chloride, polyvinyl acetate, cellulose acetate, polyolefins, polyesters, polystyrene, polyacrylonitrile, polycarbonate, an SBR latex purified by ultrafiltration (UF), combinations thereof, etc.

The binder is preferably hydrophilic. Examples of the hydrophilic binders are described in RD, JP 64-13546 A, pages 71 to 75. The hydrophilic binder is preferably transparent or translucent. Specific examples of the hydrophilic binders include proteins such as gelatin and gelatin derivatives; natural resins such polysaccharide as cellulose derivatives, starch, gum arabic, dextran and pullulan; synthetic, high-molecular compounds such as polyvinyl alcohol, modified polyvinyl alcohol, polyvinylpyrrolidone and poly acrylamide. Preferable hydrophilic binders are gelatin and combinations of gelatin and other water-soluble binders such as polyvinyl alcohol, modified polyvinyl alcohol, cellulose derivatives, polyacrylamide, etc.

The amount of the binder per 1 $m^2$ of the photograph-constituting layers is preferably 1 to 25 $g/m^2$, more preferably 3 to 20 $g/m^2$, particularly 5 to 15 $g/m^2$. The binder contains a gelatin in an amount of preferably 50 to 100% by mass, more preferably 70 to 100% by mass.

(J) Substrate

The substrate comprises a supporting film, which is provided with an undercoat layer, if necessary. The substrate preferably has a glass transition temperature (Tg) of 65° C. to 400° C. Examples of the polymers forming substrates usable for the present invention include polyethylene terephthalate (PET), polyphenylene sulfide (PPS), syndiotactic polystyrene (SPS), polymethyl methacrylate (PMMA), polyethylene naphthalate (PEN), polycarbonate (PC), polysulfone (PSU), polyarylate (PAR), polyethersulfone (PES), polyparabanic acid (PPA), thermoplastic polyimide (TPI), polyamide-imide (PAI), polyetheretherketone (PEEK), polyetherimide (PEI), all aromatic polyamide (APA), partly aromatic polyamide, etc.

Among them, polyethylene terephthalate (PET) and polyethylene naphthalate (PEN) are generally used for silver halide color photosensitive materials. These materials usable for the substrate are described in detail in "Basics of Photographic Engineering—Silver Salt Photography—(revised edition)" edited by the Society of Photographic Science and Technology of Japan, issued by Corona Publishing Co., Ltd., 1998, etc.

In the present invention, known methods are usable to attach various kinds of layers such as a silver halide emulsion layer, an antihalation layer, intermediate layer and backing layer, to the substrate. Examples of those methods include:

(1) A method of directly applying a coating layer to a substrate after a surface activation treatment such as a chemical treatment, a mechanical treatment, a corona discharge treatment, a flame treatment, an ultraviolet treatment, a high-frequency wave treatment, a glow discharge treatment, an activated plasma treatment, a laser treatment, a mixed acid treatment, an ozone oxidation treatment;

(2) A method of forming an undercoat layer on a substrate and then applying a coating layer with or without the above surface activation treatment.

Examples of polymers used for the undercoat layer with affinity for the substrate include water-soluble polymers such as gelatin, gelatin derivatives, casein, agar, sodium alginate, starch, polyvinyl alcohol, polyacrylic acid copolymer and maleic anhydride copolymer; cellulose ester such as carboxymethyl cellulose and hydroxyethyl cellulose; latex polymers such as vinyl chloride-containing copolymer, vinylidene chloride-containing copolymer, acrylate-containing copolymer, vinyl acetate-containing copolymer and butadiene-containing copolymer; water-soluble polyester; etc. Preferable among them is gelatin.

The undercoat may comprise a matting agent such as $SiO_2$, $TiO_2$, fine inorganic particles and fine polymethyl methacrylate copolymer particles. The perticle diameter of the fine polymethyl methacrylate copolymer particles is preferably 1 to 10 $\mu$m. An undercoat solution applied for the formation of the undercoat layer may contain various other additives such as a surfactant, an antistatic agent, an antihalation agent, a coloring dye, a pigment, a coating aid and an anti-fogging agent, if necessary.

The undercoat layer may be formed by a known method such as a dipping method, an air-knife method, a curtain method, roller method, a wire-bar method, a gravure method, and an extrusion method using a slide-hopper method described in U.S. Pat. No. 2,681,294. A plurality of layers may be coated simultaneously by a method described in U.S. Pat. Nos. 2,761,791, 3,508,947, 2,941,898, 3,526,528, and in Yuji Harazaki, Coating Technology, page 253, issued by Asakura Shoten (1973), etc., if necessary.

(K) Layer Structure

The photosensitive material is generally composed of three or more photosensitive layers having different color sensitivities from each other. Each photosensitive layer comprises one or more of silver halide emulsion layer. The photosensitive unit generally has color sensitivity to any of blue, green and red lights. In the multi-layered, photographic, silver-halide-type, color photosensitive material, a red-sensitive layer, a green-sensitive layer and a blue-sensitive layer are generally disposed in this order from the substrate side, though the order of the layers may be reversed. Further, another color-sensitive layer may be disposed between a plurality of the same color-sensitive layers. The total thickness of the photosensitive layers is generally 2 to 40 $\mu$m, preferably 5 to 25 $\mu$m. The typical photosensitive layer comprises a plurality of silver halide emulsion layers having substantially the same color sensitivity and different photosensitivity. The larger the projected diameter of a silver halide grain, the larger an aspect ratio of the projected diameter to the thickness of the grain is preferable.

The heat-responsive-discolorable coloring layer may be used as a yellow filter layer, a magenta filter layer or an antihalation layer. When a red-photosensitive layer, a green-photosensitive layer and a blue-photosensitive layer are disposed in this order from the substrate side, a yellow filter layer may be disposed between the blue photosensitive layer and the green photosensitive layer, a magenta filter layer may be disposed between the green photosensitive layer and the red photosensitive layer, and a cyan filter layer (an antihalation layer) may be disposed between the red photosensitive layer and the substrate. These coloring layers may be contacted with the emulsion layer directly or via an intermediate layer such as a gelatin. The amount of each dye used is determined such that the transmittance concentration of each layer for blue, green and red lights is preferably 0.03 to 3.0, more preferably 0.1 to 1.0. Specifically, the amount of each dye added is preferably 0.005 to 2.0 mmol/$m^2$, more preferably 0.05 to 1.00 mmol/$m^2$ though it may vary depending on its $\epsilon$ and molecular weight.

One coloring layer may contain two or more dyes. For instance, the above antihalation layer may contain three types of dyes; yellow, magenta and cyan.

The photosensitive unit is preferably composed of a low-photosensitive silver halide emulsion layer and a high-photosensitive silver halide emulsion layer, which are disposed in this order from the substrate side, as described in DE 1,121,470 and GB 923,045. Further, the high-photosensitive emulsion layer and the low-photosensitive emulsion layer may be disposed in this order from the substrate side, as described in JP 57-112751 A, JP 62-200350 A, JP 62-206541 A and JP 62-206543 A.

Specifically, a low-photosensitive, blue-sensitive layer (BL), a high-photosensitive, blue-sensitive layer (BH), a high-photosensitive, green-sensitive layer (GH), a low-photosensitive, green-sensitive layer (GL), a high-photosensitive, red-sensitive layer (RH) and a low-photosensitive, red-sensitive layer (RL) may be disposed from the substrate side in such order as RL/RH/GL/GH/BH/BL; RL/RH/GH/GL/BL/BH; RH/RL/GL/GH/BL/BH; etc. Further, these layers may be disposed from the substrate side in the order of RL/GL/RH/GH/BH or BL as described in JP 55-34932 B, or in the order of RH/GH/RL/GL/BH or BL as described in JP 56-25738 A and JP 62-63936 A.

A low-photosensitive silver halide emulsion layer, a middle-photosensitive silver halide emulsion layer and a high-photosensitive silver halide emulsion layer may be disposed in this order from the substrate side, such that the sensitivity of the silver halide emulsion layers becomes lower toward the substrate, as described in JP 49-15495 B. Further, as described in JP 59-202464 A, the low-photosensitive layer, the high-photosensitive layer and the middle-photosensitive layer may be disposed in this order from the substrate side. Also, these layers may be disposed in the order of the middle-photosensitive layer/the low-photosensitive layer/the high-photosensitive layer; the high-photosensitive layer/the middle-photosensitive layer/the low-photosensitive layer; etc. Four or more photosensitive layers having different sensitivities may be disposed in the photosensitive material in such order as above.

To improve the color reproducibility of the photosensitive material, a donor layer (CL), which has a different spectral sensitivity distribution from those of the main photosensitive layers such as BL, GL and RL, to provide an interlayer effect, is preferably disposed adjacent to or in the close vicinity of the photosensitive layers, as described in U.S. Pat. Nos. 4,663,271, 4,705,744 and 4,707,436, JP 62-160448 A, JP 63-89850 A.

In the present invention, the silver halide, the dye-providing compound (coupler), and the color developing agent (or its precursor) may be contained in the same layer, though they may be contained in separate layers in a reactable state. Though the relationship between the spectral sensitivity of each layer and hue provided by the coupler is not limited, it is general that a cyan coupler is used in a red photosensitive layer, that a magenta coupler is used in a green photosensitive layer, and that a yellow coupler is used in a blue photosensitive layer.

The coloring layer or other constituent layers may contain other dyes in addition to the coupler. Specific examples of the dyes added include those described in EP 549 489 A, ExF-2 to 6 in JP 7-152129 A, etc. It is also possible to use dyes dispersed in a solid state as described in JP 8-101487 A. It is also possible to use mordants or binder mordanted with dyes. In this case, known mordants and dyes may be used, and examples of the mordants are described in U.S. Pat. No. 4,500,626, columns 58 to 59, JP 61-88256 A, pages 32 to 41, JP 62-244043 A, JP 62-244036 A, etc.

It is further possible to use as dyes those losing their colors by treatments in the presence of decoloring agents. Such dyes include, for instance, cyclic ketomethylene compounds described in JP 11-207027 A, JP 2000-89414 A; cyanine dyes described in EP 911 693 A1; polymethine dyes described in U.S. Pat. No. 5,324,627; merocyanine dyes described in JP 2000-112058 A; etc.

The dye is preferably dispersed in fine crystal grains by the above method, etc., and added to a photosensitive material. An oil and/or oil particles having an oil-soluble polymer dissolved therein may be dispersed in a hydrophilic binder. The dye can be dissolved in a polymer by a latex dispersion method, and specific examples of the steps, latexes, etc. are described in U.S. Pat. No. 4,199,363, West German Patents 2,541,274 and 2,541,230, JP 53-41091 B1, and EP 029104.

Decoloring agents used together with the discolorable dyes may be alcohols, phenols, amines, aniline, sulfinic acids and salts thereof, sulfurous acid and its salts, thiosulfuric acid and its salts, carboxylic acid and its salts, hydrazines, guanidine, aminoguanidine, amidine, thiols, cyclic or linear, active methylene compounds, cyclic or linear, active methine compounds, anionic species derived from the above compounds, etc. Preferable among them are hydroxyamine, sulfinic acid, sulfurous acid, guanidine, aminoguanidine, heterocyclic thiols, cyclic or linear, active methylene compounds, cyclic or linear, active methine compounds, and particularly preferable among them are guanidine and aminoguanidine. The above base precursors may also be preferably used as decoloring agents.

It is presumed that the above decoloring agent is brought into contact with a dye at the time of treatment, so that the decoloring agent is nucleophilically added to a dye molecule to decolor the dye. After or during image exposure, a silver halide photosensitive material containing a dye and a treatment membrane containing a decoloring agent are overlapped and heated in the presence of water, and then peeled to obtain colored image on the silver halide photosensitive material and discolor the dye. In this case, the concentration of the decolored dye is ⅓ or less, preferably ⅕ or less based on the original concentration. The molar ratio of the decoloring agent added to the dye is preferably 0.1 to 200 times, more preferably 0.5 to 100 times.

(L) Form of Photosensitive Material

The silver halide photosensitive material of the present invention can be cut to a predetermined size to provide photographic films. Main materials for a patrone (or a cartridge) may be metals or synthetic plastics. Preferable examples of synthetic plastics include polystyrene, polyethylene, polypropylene, polyphenyl ether, etc. The patrone may further contain various kinds of antistatic agents such as carbon black; metal oxide particles; nonion, anion, cation or betaine surfactants; polymers; etc. These antistatic patrones are described in JP 1-312537 A, JP 1-312538 A, etc. The patrone preferably has a resistance of 1012 Ω or less at 25° C. and 25% RH. Generally, plastic patrones are produced by plastics into which carbon black, pigments, etc. are blended to have light-blocking characteristics. The patrone may be at a present size of 135, or the diameter of a 135-size-cartridge, at present 25 mm, may effectively be reduced to 22 mm or less according to the miniaturization of cameras. The volume of a patrone case is preferably 30 $cm^3$ or less, more preferably 25 $cm^3$ or smaller. The amount of the plastics used in the patrone and its case is preferably 5 g to 15 g.

Usable for the photosensitive materials of the present invention is a film patrone having a structure feeding a film out by rotating a spool. The film patrone may also have a structure in which a front edge of a film is accommodated in the film patrone body and fed through a port of the film patrone by rotating a spool shaft in a film-feeding direction. These film patrones are disclosed in U.S. Pat. Nos. 4,834,306 and 5,226,613, etc. Photographic films used in the present invention may be undeveloped films or developed films. Also, the undeveloped photographic film and the developed photographic film may be contained in the same patrone or in different patrones. The photosensitive materials of the present invention may preferably be in the form of negative films for advanced photo systems.

[3] Method for Forming Image

The silver halide photosensitive material of the present invention may be used as a heat-developable, silver halide photosensitive material that is developed at a development temperature of 60 to 200° C. after exposure. The silver halide photosensitive material may be heated by bringing it into contact with a heated block or plate; by using a hot plate, a hot presser, a hot roller, a hot drum, a halogen lamp heater, an infrared or far-infrared lamp heater, etc.; or by passing it through a high-temperature atmosphere, etc. In addition to usual electric heaters and lamp heaters, a heated liquid, a dielectric heater, a microwave heater, etc. may be used as a heat source. The first and second silver halide photosensitive materials of the present invention are preferably heat-developed in contact with the heat source such as a hot roller or a hot drum. Such thermal development is described in JP 5-56499 B, Japanese Patent 684453, JP 9-292695 A and JP 9-297385 A, WO 95/30934, etc. Non-contact-type thermal development methods described in JP 7-13294 A, WO 97/28489, WO 97/28488, WO 97/28487, etc. may also be used in the present invention. The developing temperature after the exposure is 60 to 200° C., preferably 100 to 200° C., more preferably 120 to 160° C. The developing period is preferably 1 to 60 seconds, more preferably 5 to 60 seconds, particularly 5 to 30 seconds.

An electroconductive heating element layer may be formed in the silver halide photosensitive material of the present invention and/or a processing member thereof as a heating means for the thermal development. The heating element layer described in JP 61-145544 A, etc. may be used in the present invention.

Generally, the film of the silver halide photosensitive material is separated from the film patrone or cartridge to be thermally developed after shooting. A method disclosed in JP 2000-171961 A is also preferably used in the present invention, in which the thermal development is carried out while pulling the film out of a thrust cartridge and the developed film is reset in the thrust cartridge after the development is finished. Further, the entire patrone or cartridge containing the silver halide photosensitive material may be heated to thermally develop the photosensitive material.

In the present invention, it is not necessary to remove the developed silver and the undeveloped silver halide after the development. To reduce image-reading load and to improve image-keeping properties, an image may be obtained after the developed silver and the undeveloped silver halide are removed or processed to reduce optical load. The process for reducing optical load may be, for example, complexing or solubilization of the silver halide, thereby reducing light scattering by the silver halide grains. The process may be carried out during or after the development. To remove the developed silver or to complex or solubilize the silver halide in the photosensitive material after the development, the silver halide photosensitive material may be soaked in a liquid comprising a silver-oxidizing agent, a re-halogenation agent or a solvent for a silver halide, or such a liquid may be sprayed or applied to the photosensitive material. It is also possible to remove the developed silver and to complex or solubilize the silver halide, by attaching a processing member containing such a liquid to the photosensitive material and heating it.

In the present invention, the image formed on the thermally developed silver halide photosensitive material may be read and converted to a digital signal. In this case, the image is preferably read at a temperature of 60° C. or lower. The image may be read by a known image input device. The image input device is described in detail in Takao Ando, "Fundamentals of Digital Image Input," Corona Co., Ltd., 1998, pages 58 to 98. A photographic image scanner is specially described in "Fine Imaging and Digital Photograph," edited by the Society of Photographic Science and Technology of Japan, issued by Corona Co., 2001, pages 54 to 75. The image input device should take vast image information efficiently, and are classified to a linear sensor type and an area sensor type in terms of the arrangement of extremely small point sensors. The point sensors in the linear sensor are arranged linearly, and either one of the silver halide photosensitive material and the linear sensor should be scanned to take image information on a sheet. Thus, although it takes longer time to read the image, the linear sensor can be produced at a low cost. On the other hand, because the area sensor can read the image information without scanning, it is high in an information-reading speed. However, the area sensor is expensive because it uses a large sensor. Which sensor is used may be determined depending on its purposes.

Usable as the above sensors are electron tube-type sensors such as an image pickup tube, an image tube, etc., and solid image pickup-type sensors such as a CCD sensor, a MOS sensor, etc. Preferable from the viewpoint of cost and simplicity in handling are the solid image pickup-type sensors, particularly the CCD sensor. An apparatus comprising such an image input device may be a digital still camera, a drum scanner, a flatbed scanner, a film scanner, etc. Among them, the film scanner is preferable to read image at high quality with ease.

Preferred examples of the film scanners are a scanner comprising a linear CCD, such as "Film Scanner LS-1000" available from Nikon Corporation, "Duo Scan HiD" available from Agfa-Gevaert Japan, Ltd., and "Flextight Photo" available from Imacon, Inc.; a scanner comprising an area CCD, such as "RFS3570" available from Eastman Kodak Company; etc. An image input device comprising an area CCD, which is installed in a digital printing system "Frontier" available from Fuji Photo Film Co., Ltd., is also preferably used in the present invention. An image input device of "Frontier F350" described in Yoshio Ozawa, "Fuji Photo Film Research Report," No. 45, pages 35 to 41 can rapidly read image information with high quality by a linear CCD sensor, thus particularly suitable for reading the photosensitive material of the present invention.

After forming image on the photosensitive material according to the image forming method of the present invention, color image can be formed on another recording medium according to its information. Specifically, image information is photoelectrically read by measurement of the concentration of transmitted light, converted to a digital signal, and image-treated so that it can be output onto another recording medium. The recording media, onto which the image information is output, are, for instance, photosensitive materials using silver halide, sublimation-type thermal recording materials, full-color direct thermal recording materials, inkjet printing materials, electrophotographic materials, etc.

The image formed on the silver halide photosensitive material may be treated by an image-treating method described in JP 6-139323 A, in which a subject image formed on a color negative is converted to image data by a scanner, etc. and the color of the subject is faithfully reproduced from the demodulated color information of the negative film. Usable as the image-treating method to reduce granulation or noise of the digitalized image and to increase the sharpness are a method described in JP 10-243238 A, in which weighting of edge and noise, a subdivision treatment, etc. are carried out based on sharpness-enhanced image data, smoothed image data and edge-detected data; and a method described in JP 10-243239 A, in which the edge component is evaluated based on the sharpness-enhanced image data and the smoothed image data to achieve weighting, subdivision, etc.

To correct the change of color reproducibility in a final print depending on the storage and development conditions of the photosensitive material, etc., a method described in JP 10-255037 A may be used in the present invention. This method comprises the steps of: exposing patches of 4 or more stages or colors on the unexposed portions of the photosensitive material; developing the photosensitive material; measuring the concentrations of the patches to obtain a look-up table and a color-conversion matrix for the correction; correcting the colors of the image using the look-up table conversion or the matrix operation. To convert the color reproductive region of the image data, for example, a method described in JP 10-229502 A may be used, in which image data are expressed by color signals generating a color visually recognized as a neutral color when the numerals of respective components are arranged in order, and the color signals are decomposed to chromatic color components and achromatic color components, which are separately treated.

An image-processing method described in JP 11-69277 A may be used to eliminate the deterioration of image quality resulting from the aberration of a camera lens and reduction in peripheral lamination in image taken by the camera. In this method, a grating correction pattern for producing data for correcting the deterioration of image quality is recorded on the film in advance, and image and the correction pattern are read by a film scanner after shooting to produce data for correcting deterioration factors by a camera lens, which is used to correct the digital image data.

Excess sharpness in a skin color and a blue-sky color results in large granular noise, giving unpleasant impression. Thus, the level of sharpness in a skin color and a blue sky color in the image is preferably controlled, and usable for this purpose is, for instance, a method described in JP 11-103393 A, in which a sharpness-emphasizing processing using an un-sharp masking (USM) is performed with a USM coefficient as a function of (B-A)(R-A). The skin color, the grass green color and the sky blue color are important in color reproduction and thus require selective color-reproducing treatment. As for the reproduction of brightness, it appears visually preferable that the skin color is finished brighter and the sky blue color is finished darker. The reproduction of important colors with visually preferable brightness may be achieved by a method described in JP 11-177835 A, in which chrominance signals of each pixel are converted by using a coefficient that is comparatively small when hue corresponding to chrominance signal is yellowish red, and comparatively large when the hue is cyan blue such as (R-G) and (R-B).

Usable to compress color image data is a method described in JP 11-113023 A, in which signals of each pixel are separated into a luminance component and a chrominance component, and a hue template having a numeric pattern most adapted to a concerned chrominance component is selected from a plurality of a hue templates prepared for the chrominance component in advance, thereby coding the chrominance information. To perform image emphasis in a treatment for increasing saturation or sharpness without decoloration, highlight jump, paint-out of colors in a high-density portion and the formation of data outside a defined region, image-processing method and apparatus described in JP 11-177832 A may be used in the present invention. In this method, the density data of colors are converted to exposure density data using characteristic curves, the exposure density data are subjected to image processing including the color emphasis, and the processed exposure density data are converted to processed density data using characteristic curves.

The present invention will be specifically described below with reference to Examples without intention of restricting the scope of the present invention.

EXAMPLES 1 AND 2, AND COMPARATIVE EXAMPLES 1 AND 2

A. Preparation of Dye Composition 101

10 g of a leuco dye (L1), 4 g of stearyl alcohol, 10 g of a color-developing agent (SD-1), 10 g of a color image stabilizer (HP-1), and 300 g of a 20-%-by-mass aqueous dispersion of P-13 (copolymer of methyl methacrylate and 2-carboxyethyl acrylate at 95:5 having Tg of 100° C., average particle size: 80 nm) were mixed in 200 ml of ethyl acetate. The resultant dispersion was mixed with 600 g of an aqueous solution containing 2.0 g of a surfactant, and emulsified by a dissolver stirrer at 10,000 rpm over 20 minutes. After emulsification, it was stirred in a nitrogen stream at 50° C. for 30 minutes to remove ethyl acetate, and distilled water was added thereto such that the total amount became 1,000 g, followed by mixing at 2,000 rpm for 10 minutes. A yellow dye composition 101 (Y-101) was thus obtained.

A magenta dye composition 101(M-101) and a cyan dye composition 101(C-101) were produced in the same manner as Y-101 except that a leuco dye (L1) was replaced by a leuco dye (L2) and a leuco dye (L3), respectively.

Y-102, M-102 and C-102 were prepared in the same manner as Y-101, M-101 and C-101 except that the amount of stearyl alcohol added was changed to 20 g and a 20-%-by-mass aqueous dispersion of P-13 was not added.

Leuco dye (L1)

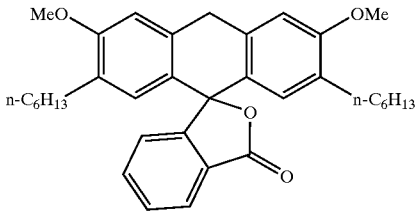

Color-developing agent (SD-1)

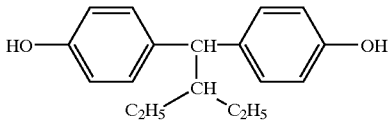

Leuco dye (L2)

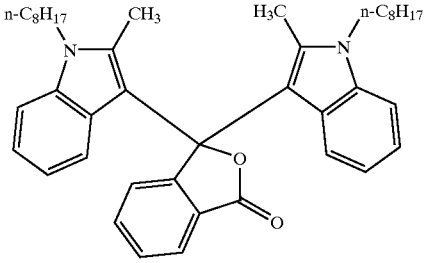

Leuco dye (L3)

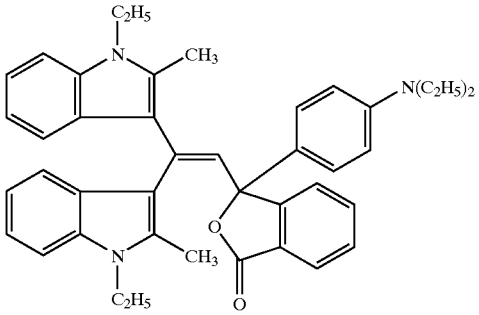

Color Image Stabilizer (HP-1)

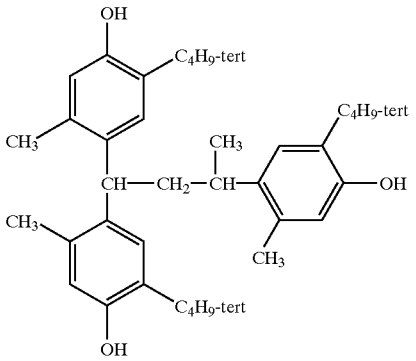

B. Preparation of Supersensitive Silver Halide Emulsion

A mixture of 0.37 g of gelatin having an average molecular weight of 15,000, 0.37 g of an acid-treated gelatin, 0.7 g of potassium bromide and 930 ml of distilled water was charged into a reaction vessel and heated to 38° C. Added to the resultant mixture over 20 seconds while strongly stirring were 30 ml of an aqueous solution containing 0.34 g of silver nitrate, and 30 ml of an aqueous solution containing 0.24 g of potassium bromide. The mixture was maintained at 40° C. for 1 minute after addition, and heated to 75° C. 200 ml of distilled water and 27.0 g of gelatin having a trimellitic acid-modified amino group, and further 100 ml of an aqueous solution containing 23.36 g of silver nitrate and 80 ml of an aqueous solution containing 16.37 g of potassium bromide were added thereto over 36 minutes while increasing their flow rates.

Added then to the resultant mixture were 250 ml of an aqueous solution containing 83.2 g of silver nitrate, and an aqueous solution containing potassium iodide and potassium bromide (a molar ratio of potassium iodide/potassium bromide was 3/97, and concentration of potassium bromide was 26%) over 60 minutes while increasing their flow rates, such that the resultant mixture exhibited a silver potential of −50 mV with reference to a saturated calomel electrode. Further added to the resultant mixture were 75 ml of an aqueous solution containing 18.7 g of silver nitrate, and a 21.9-% aqueous potassium bromide solution over 10 minutes while controlling a silver potential of the mixture to 0 mV with reference to a saturated calomel electrode. The mixture was maintained at 75° C. for 1 minute and cooled to 40° C.

100 ml of an aqueous solution containing 10.5 g of sodium p-iodoacetamidobenzene sulfonate monohydrate was added thereto to adjust the pH value of the mixture to 9.0. Next, the resultant mixture was added to 50 ml of an aqueous solution containing 4.3 g of sodium sulfite, maintained at 40° C. for 3 minutes, and heated to 55° C. After adjusting pH of the mixture to 5.8, the mixture was mixed with 0.8 mg of sodium benzenethiosulfinate, 0.04 mg of potassium hexachloro iridate (IV) and 5.5 g of potassium bromide. The mixture was maintained at 55° C. for 1 minute, and then mixed with 80 ml of an aqueous solution containing 44.3 g of silver nitrate and 160 ml of an aqueous solution containing 34.0 g of potassium bromide and 8.9 mg of potassium hexacyano ferrite (II) over 30 minutes. The resulting mixture was then cooled and desalted, and mixed with gelatin in an amount of 7% by mass based on the entire mixture to adjust the pH value of the mixture to 6.2, to prepare an emulsion A-1.

The emulsion A-1 was composed of hexagonal tabular grains having an average grain size that was defined as the average diameter of spheres having an equal grain volume (hereinafter referred to as "equivalent sphere diameter") of 1.15 μm, an average thickness of 0.12 μm, and an aspect ratio of 24.0.

Emulsions A-2 and A-3 were prepared in the same manner as the emulsion A-1, except that the number of nuclei was changed by controlling the amounts of silver nitrate and potassium bromide added at the initial stage of grain formation. Incidentally, the amounts of potassium hexachloro iridate (IV) and potassium hexacyano ferrite (II) were changed in inverse proportion to the volume of grains, and the amount of sodium p-iodoacetamidobenzene sulfonate monohydrate was changed in proportion to the peripheral length of the grains. The emulsion A-2 was composed of hexagonal tabular grains having an average grain size that was defined as equivalent sphere diameter of 0.75 μm, an average thickness of 0.11 μm, and an aspect ratio of 14.0. The emulsion A-3 was composed of hexagonal tabular grains having an average grain size that was defined as equivalent sphere diameter of 0.52 μm, an average thickness of 0.09 μm, and an aspect ratio of 11.3.

Added to the emulsion A-1 were a 5.6 ml of 1-% aqueous potassium iodide solution at 40° C. and then the following spectral sensitizing dye, Compound I, potassium thiocyanate, chloroauric acid, sodium thiosulfate and mono (pentafluorophenyl)diphenyl phosphine selenide, whereby the emulsion A-1 was subjected to spectral sensitization and chemical sensitization. Herein, the amount of each chemical sensitizer was controlled such that the optimum chemical sensitivity of the emulsion was obtained. Blue-sensitive emulsion A-1 was thus prepared.

Sensitizing dye for blue-sensitive emulsion I
2.5 x $10^{-4}$ mol per 1-mol-Ag of Emulsion A-1

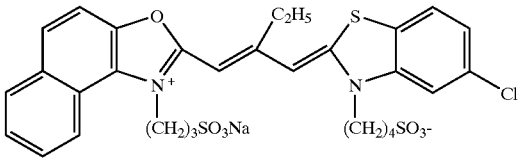

Compound I

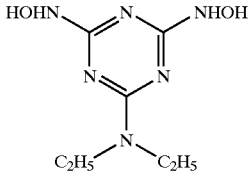

Stabilizer S (Mixture of Following Compounds)

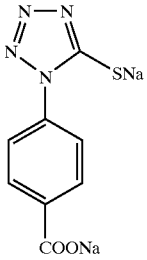

2 x $10^{-4}$ mol per
1 mol-Ag of Emulsion A-1

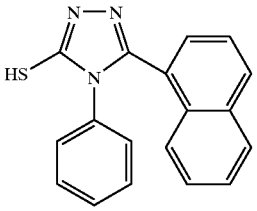

8 x $10^{-5}$ mol per
1 mol-Ag of Emulsion A-1

Blue-sensitive emulsions A-2b and A-3b were prepared in the same manner as the blue-sensitive emulsion A-1b except for using the emulsions A-2 and A-3 instead of the emulsion A-1, respectively. Incidentally, the amount of sensitizing dye was changed in accordance with the surface area of silver halide grains in each emulsion, and the amount of the chemical sensitizer was changed such that the optimum chemical sensitivity of the emulsion was obtained.

Further, green-sensitive emulsions A-1g, A-2g and A-3g, and red-sensitive emulsions A-1r, A-2r and A-3r were prepared in the same manner as the blue-sensitive emulsions A-1b, A-2b and A-3b instead of using the following sensitizing dye instead of the above blue-sensitizing dye, respectively.

Sensitizing dye for green-sensitive emulsion I
5.5 x $10^{-4}$ mol per 1-mol-Ag of Emulsion A-1

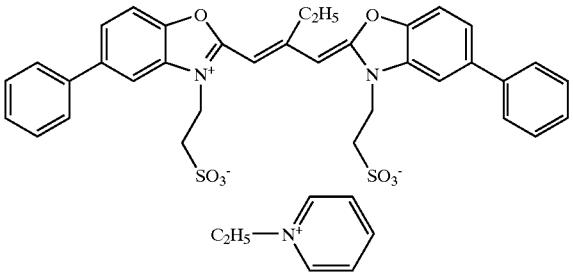

-continued

Sensitizing dye for green-sensitive emulsion II
1.3 x $10^{-4}$ mol per 1-mol-Ag of Emulsion A-1

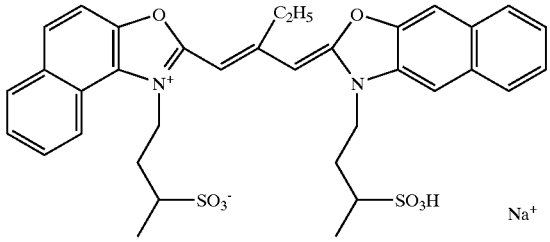

Sensitizing dye for green-sensitive emulsion III
4.8 x $10^{-5}$ mol per 1-mol-Ag of Emulsion A-1

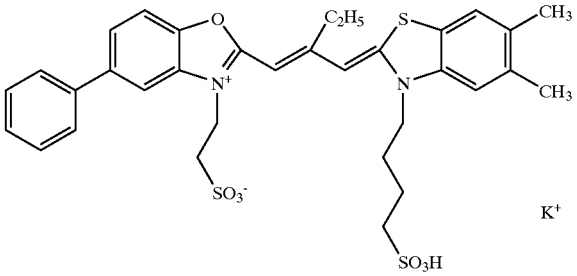

Sensitizing dye for red-sensitive emulsion I
2.5 x $10^{-4}$ mol per 1-mol-Ag of Emulsion A-1

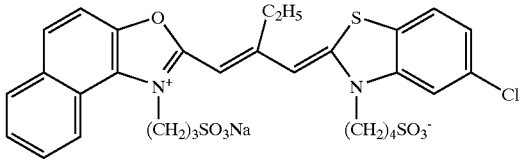

Sensitizing dye for red-sensitive emulsion II
6.3 x $10^{-5}$ mol per 1-mol-Ag of Emulsion

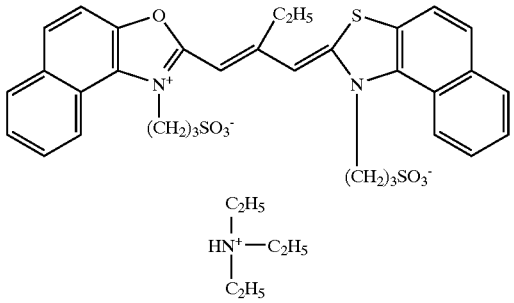

Sensitizing dye for red-sensitive emulsion III
3.1 x $10^{-4}$ mol per 1-mol-Ag of Emulsion A-1

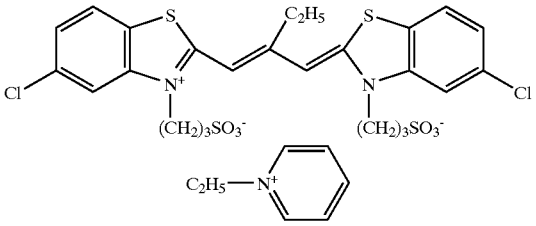

C. Preparation of Silver Salt of 1-phenyl-5-Mercaptotetrazole 431 g of a lime-treated gelatin and 6,569 ml of distilled water were charged into a reaction vessel. A solution B was then prepared by mixing 320 g of 1-phenyl-5-mercaptotetrazole with 2,044 ml of distilled water and 790 g of a 2.5-M aqueous sodium hydroxide solution. The solution B was added to the resulting mixture in the reaction vessel, and nitric acid or sodium hydroxide was added thereto, if necessary, to control its pAg at 7.25 and its pH at 8.00.

To the mixture was added 3,200 ml of a 0.54-M aqueous silver nitrate solution at a rate of 250 ml/minutes while strongly stirring, and the solution B was simultaneously added to the mixture near the stirrer while controlling the pAg of the mixture to 7.25. The mixture was then concentrated by ultrafiltration to prepare a dispersion containing fine grains of a silver salt of 1-phenyl-5-mercaptotetrarole.

D. Preparation of Silver Benzotriazole 0.34 g of benzotriazole, 0.24 g of sodium hydroxide and 25 g of a phthalated gelatin were dissolved in 700 ml of water and stirred at 60° C. A solution of 3.4 g of benzotriazole and 1.2 g of sodium hydroxide in 150 ml of water and a solution of 5 g of silver nitrate in 150 ml of water were then added simultaneously to the resultant mixture near the stirrer over 4 minutes. After stirring for 5 minutes, a solution of 3.4 g of benzotriazole and 0.2 g of sodium hydroxide in 150 ml of water and a solution of 5 g of silver nitrate in 150 ml of water were added simultaneously to the mixture near the stirrer over 6 minutes. The pH of the emulsion thus obtained was controlled for precipitation to remove excess salts. The pH was adjusted to 6.0 to prepare a silver benzotriazole emulsion with a yield of 470 g.

E. Preparation of Substrate

With a substrate film used as a support for a silver halide photosensitive material comprising a heat-responsive-discolorable coloring layer and a photosensitive layer, an undercoat layer, an antistatic layer (first back layer), a magnetic recording layer (second back layer) and a third back layer were coated thereon.

(1) Preparation of Substrate Film 100 parts by weight of polyethylene-2,6-naphthalene dicarboxylate (PEN) and 2 parts by weight of an ultraviolet absorbent "Tinuvin P. 326" available from Ciba-Geigy were uniformly mixed, and melted at 300° C. The melted mixture was extruded through a T-die, stretched 3.3 times in the longitudinal direction and 4.0 times in the transverse direction at 140° C., and subjected to thermal fixing at 250° C. for 6 seconds, to prepare a PEN film having a thickness of 90 μm. Added to the PEN film were suitable amounts of a blue dyestuff, a magenta dyestuff and a yellow dyestuff [I-1, I-4, I-6, I-24, I-26, I-27 and II-5 described in Kokaigiho (Journal of Technical Disclosure), Kogi No. 94-6023]. The PEN film was then wound around a stainless steel winding core having a diameter of 30 cm and subject to thermal history at 110° C. for 48 hours, to prepare a substrate free from curling.

(2) Coating of Undercoat Layer

The both surfaces of the PEN film were subjected to a glow discharge treatment according to the following method. Four cylindrical electrodes each having a diameter of 2 cm and a length of 40 cm were fixed onto an insulating plate in a vacuum tank at an interval of 10 cm, and the substrate was disposed such that it ran 15 cm apart from the cylindrical electrodes. A heat roll equipped with a thermoregulator having a diameter of 50 cm was mounted just in front of the cylindrical electrodes, and the substrate was in contact with the heat roll in a range of ¾ of a periphery thereof. The substrate of 90 μm in thickness and 30 cm in width was moved and heated by the heat roll so that the temperature on the substrate surface was 115° C. between the heat roll and the electrode zone. The heated PEN film was conveyed at a rate of 15 cm per second and subjected to a glow discharge treatment.

The conditions of the glow discharge treatment were as follows:

| | |
|---|---|
| Pressure in vacuum tank: | 26.5 Pa, |
| Partial pressure of $H_2O$ in atmospheric gas: | 75%, |
| Discharge frequency: | 30 kHz, |
| Output: | 2500 W, and |
| Strength of treatment: | 0.5 kV · A · min./m$^2$. |

As the electrodes for a vacuum glow discharge, those described in JP 7-003056 A were used.

One surface of the glow-treated PEN substrate (on the side of the emulsion layer) was coated with a coating liquid having the following composition described in JP 51-3619 A, and dried at 115° C. for 3 minutes, to form an undercoat layer having a thickness of 0.02 μm.

| Composition of Coating liquid for Undercoat | |
|---|---|
| Gelatin | 83 parts by weight |
| Water | 291 parts by weight |
| Salicylic Acid | 18 parts by weight |
| Colloidal Silica "Aerosil R972" available from Nippon Aerosil Co., Ltd. | 1 part by weight |
| Methanol | 6,900 parts by weight |
| n-Propanol | 830 parts by weight |
| Polyamide-Epichlorohydrin Resin | 25 parts by weight |

(3) Coating of Antistatic Layer (First Back Layer)

A mixture of 40 parts by weight of conductive fine particles "SN-100" available from Ishihara Sangyo Kaisha, Ltd. and 60 parts by weight of water was roughly dispersed by a stirrer while adding an aqueous solution of 1 N sodium hydroxide thereto. The mixture was dispersed by a horizontal-type sand mill to prepare a dispersion (pH of 7.0) of conductive fine particles having an average diameter of 0.06 μm in terms of secondary particles.

A rear surface of the surface-treated PEN substrate was then coated with a coating liquid having the following composition so that the amount of the conductive fine particles coated was 270 mg/m$^2$, and dried at 115° C. for 3 minutes, to form an antistatic layer (first back layer).

| Composition of Coating liquid for Antistatic Layer | |
|---|---|
| Conductive Fine Particles "SN-100" Available from Ishihara Sangyo Kaisha, Ltd. | 270 parts by weight |
| Gelatin | 23 parts by weight |
| Surfactant "LEODOL TW-L 120" Available from Kao Corporation | 6 parts by weight |
| Hardener "DENACOL EX-521" Available from NAGASE KASEI Chemicals Ltd. | 9 parts by weight |
| Water | 5,000 parts by weight |

(4) Coating of Magnetic Recording Layer (Second Back Layer)

Magnetic particles of Co-deposited γ-$Fe_2O_3$ "CSF-4085 V2" available from Toda Kogyo Co., Ltd. were coated with a silane coupling agent "X-12-641" available from Shin-Etsu Chemical Co., Ltd. in an amount of 16% by mass.

The CSF-4085 V2 treated with X-12-641 was used to prepare a coating liquid having the following composition, which was applied to the above first back layer such that amount of the CSF-4085 V2 treated with X-12-641 was 62 mg/m$^2$, and dried at 115° C. for 1 minute, to form a magnetic recording layer (second back layer). The magnetic particles and the following abrasives were dispersed by a method described in JP 6-035092 A.

| Composition of Coating liquid for Magnetic Recording Layer | |
|---|---|
| Diacetyl Cellulose (Binder) | 1,140 parts by weight |
| Magnetic Particles "CSF-4085 V2" Treated with "X-12-641" | 62 parts by weight |
| Alumina Abrasives "AKP-50" Available from Sumitomo Chemical Co., Ltd. | 40 parts by weight |
| Hardener "Millionate MR-400" Available from Nippon Polyurethane Industry Co., Ltd. | 71 parts by weight |
| Cyclohexanone | 12,000 parts by weight |
| Methylethyl Ketone | 12,000 parts by weight |

Increase in color density of DB of the magnetic recording layer by X-light (blue filter) was approximately 0.1, and the magnetic recording layer had a saturated magnetization moment of 4.2 emu/g, a coercivity of $7.3\times10^4$ A/m and a rectangularity of 65%.

(5) Coating of Third Back Layer

A wax (1-2) of n-$C_{17}H_{35}COOC_{40}H_{81}$ was emulsified in water by a high-pressure homogenizer to prepare an aqueous dispersion of wax having a concentration of 10% by mass and a weight-average diameter of 0.25 $\mu$m.

The resultant dispersion was used to prepare a coating liquid having the following composition, which was applied to the above magnetic recording layer such that amount of the wax (1-2) was 27 mg/m$^2$, and dried at 115° C. for 1 minute, to form a third back layer.

| Composition of Coating liquid for Third Back Layer | |
|---|---|
| Above Aqueous Wax Dispersion (10% by mass) | 270 parts by weight |
| Pure Water | 176 parts by weight |
| Ethanol | 7,123 parts by weight |
| Cyclohexanone | 841 parts by weight |

F. Preparation of Emulsified Dispersion Comprising Coupler 8.95 g of a yellow coupler (CPY-1), 0.90 g of a development accelerator (X), 4.54 g of a high-boiling-point organic solvent (e), and 4.54 g of a high-boiling-point organic solvent (f) were dissolved in 50.0 ml of ethyl acetate at 60° C. The resulting solution was mixed with 200 g of an aqueous solution containing 18.0 g of a lime-treated gelatin and 0.8 g of sodium dodecylbenzenesulfonate, and emulsified by a Dissolver stirrer at 10,000 rpm for 20 minutes. After dispersion, distilled water was added to the resultant mixture to make the total amount 300 g and stirred at 2,000 rpm for 10 minutes.

Another emulsion was prepared in the same manner except for using 8.95 g of a yellow coupler (CPY-2) in place of 8.95 g of the yellow coupler (CPY-1).

Yellow Coupler (CPY-1)

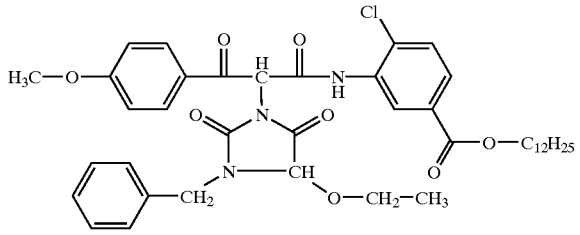

Yellow Coupler (CPY-2)

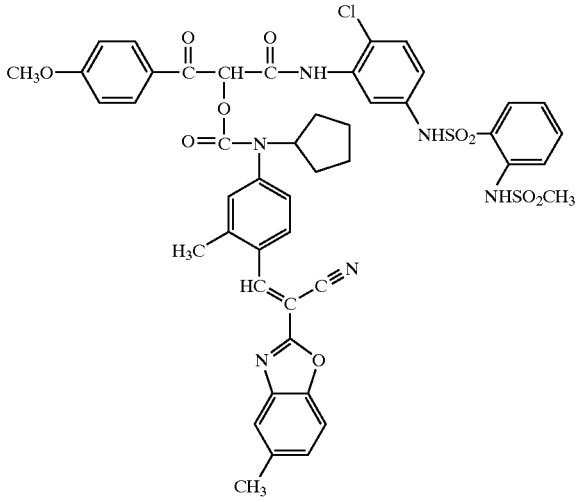

Development Accelerator (X)

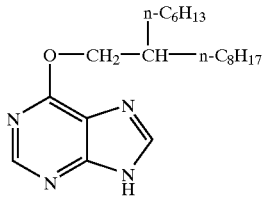

High-Boiling-Point Organic Solvent (e)

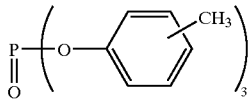

High-Boiling-Point Organic Solvent (f)

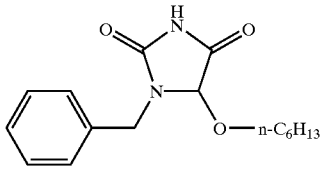

G. Preparation of Magenta Coupler Dispersion and Cyan Coupler Dispersion 4.68 g of a magenta coupler (CPM-1), 2.38 g of a magenta coupler (CPM-2) and 0.71 g of the development accelerator (X) were dissolved in 7.52 g of the high-boiling-point organic solvent (e) and 38.0 ml of ethyl acetate at 60° C. The resultant solution was mixed with 150 g of an aqueous solution containing 12.2 g of a lime-treated gelatin and 0.8 g of sodium dodecylbenzenesulfonate, and emulsified at 10,000 rpm for 20 minutes by the Dissolver stirrer. After dispersion, distilled water was added to the resultant mixture to make the total amount 300 g, and stirred at 2,000 rpm for 10 minutes to prepare an emulsion. Another emulsion was prepared in the same manner except for using 4.68 g of a magenta coupler (CPM-3) and 2.38 g of the magenta coupler (CPM-2) in place of 4.68 g of the magenta coupler (CPM-1) and 2.38 g of the magenta coupler (CPM-2).

Magenta Coupler (CPM-1)

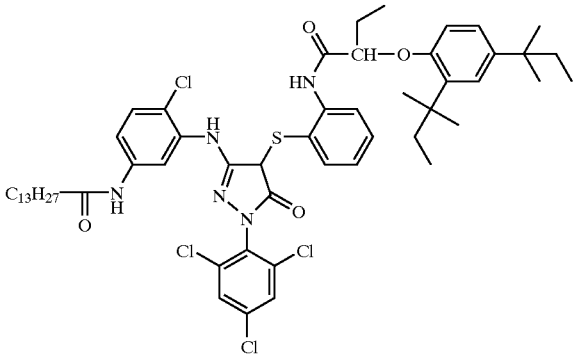

Magenta Coupler (CPM-2)

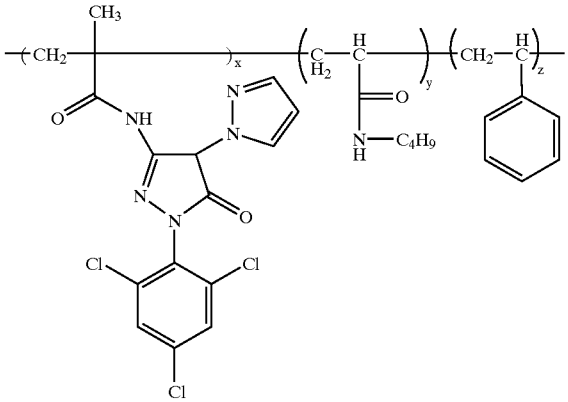

Magenta Coupler (CPM-3)

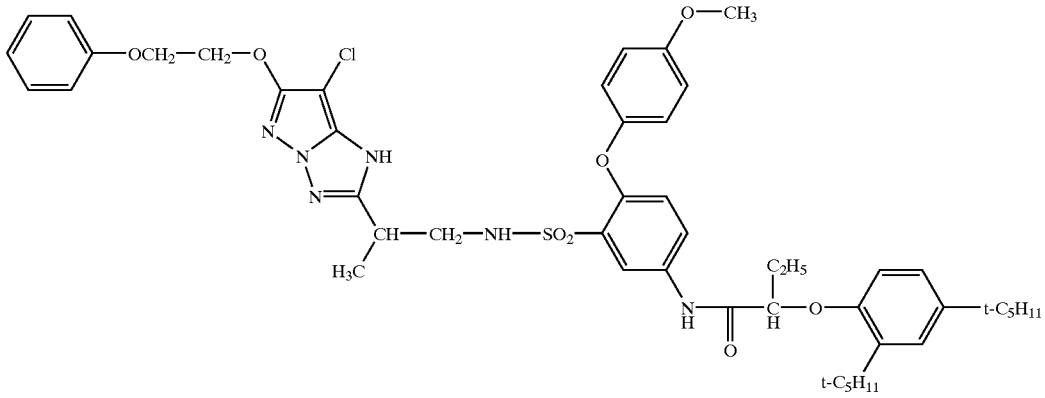

7.32 g of the following cyan coupler (CPC-1), 3.10 g of the cyan coupler (CPC-2) and 1.04 g of the development accelerator (X) were dissolved in 11.62 g of the high-boiling-point organic solvent (e) and 38.0 ml of ethyl acetate at 60° C. The resulting solution was mixed with 150 g of an aqueous solution containing 12.2 g of a lime-treated gelatin and 0.8 g of sodium dodecylbenzenesulfonate, and emulsified at 10,000 rpm for 20 minutes by the Dissolver stirrer. After dispersion, distilled water was added to the resultant mixture to make the total amount 300 g, and stirred at 2,000 rpm for 10 minutes to prepare an emulsion.

Another emulsion was prepared in the same manner except for using 7.32 g of a cyan coupler (CPC-3) and 3.10 g of a cyan coupler (CPC-4) in place of 7.32 g of the cyan coupler (CPC-1) and 3.10 g of the cyan coupler (CPC-2).

Cyan Coupler (CPC-1)

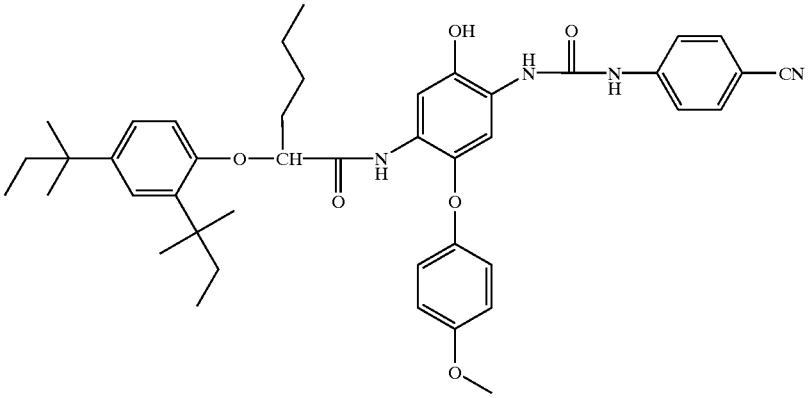

Cyan Coupler (CPC-2)

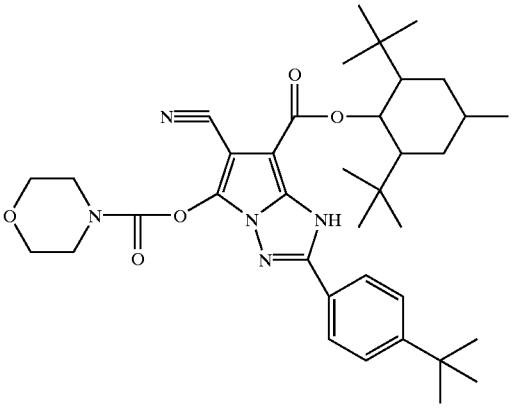

Cyan Coupler (CPC-3)

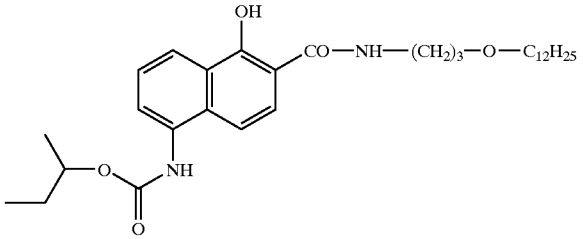

Cyan Coupler (CPC-4)

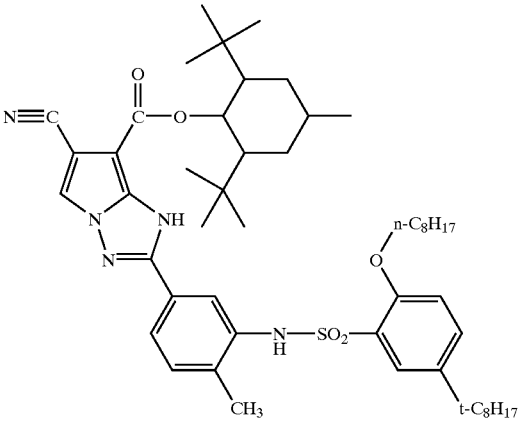

H. Preparation of Developing Agent Dispersion

A microcrystal dispersion of the following developing agent DEVP-A was prepared as follows. First, 1.0 g of "Surfactant 10G" available from Arch Chemicals and 100 g of water were added to a mixture of 50 g of the developing agent DEVP-A and 30 g of a 10-%-by-mass aqueous solution of a modified polyvinyl alcohol "POVAL MP203" available from Kuraray Co., Ltd. and well mixed to prepare a slurry. The slurry was conveyed by a diaphragm pump to a horizontal-type sand mill ("UVM-2" available from IMEX Co.) packed with zirconium beads having an average diameter of 0.5 mm, in which it was dispersed for 6 hours. Water was then added to the slurry to adjust the concentration of the developing agent DEVP-A to 10% by mass, to prepare microcrystal dispersion. The microcrystal dispersion comprised grains having a median size of 0.50 μm and the maximum grain size of 1.5 μm or less. The resultant microcrystal dispersion was filtrated by a polypropylene filter having a pore size of 10.0 μm to remove foreign matter such as dust, and stored. The microcrystal dispersion was filtrated again by the polypropylene filter immediately before using.

A microcrystal dispersion of the following developing agent DEVP-B was prepared as follows. First, 0.5 g of Alkanol XC and 100 g of water were added to a mixture of 50 g of the developing agent DEVP-B and 30 g of a 10-%-by-mass aqueous solution of modified polyvinyl alcohol "POVAL MP203" available from Kuraray Co., Ltd. and well mixed to prepare a slurry. The slurry was conveyed by a diaphragm pump to a horizontal-type sand mill ("UVM-2" available from IMEX Co.) packed with zirconium beads having an average diameter of 0.5 mm, in which it was dispersed for 6 hours. Water was then added to the slurry to adjust the concentration of the developing agent DEVP-B to 10% by mass, to prepare a microcrystal dispersion comprising grains having a median size of 0.30 μm and the maximum grain size of 1.0 μm or less. The resultant microcrystal dispersion was filtrated by a polypropylene filter having a pore size of 10.0 μm to remove foreign matter such as dust, and stored. The microcrystal dispersion was filtrated again by the polypropylene filter immediately before using.

DEVP-A

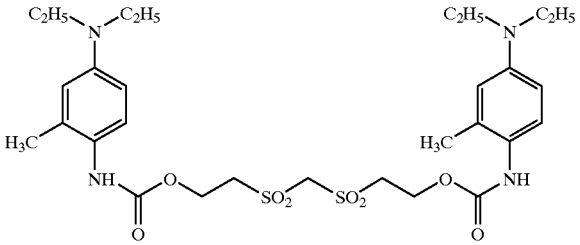

-continued

DEVP-B

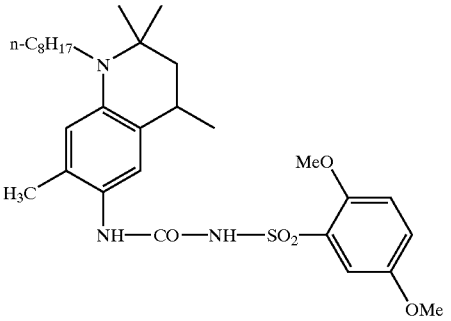

I. Coating of Filter Layer and Antihalation Layer

Dye compositions sucu as Y-101, M-101, C-101, Y-102, M-102 and C-102 were used for coloring an intermediate layer as a filter layer or an antihalation layer. 10% by mass of a gelatin solution was added to and mixed with to 100 g of each of these dye compositions at 50° C. The amounts of the resultant mixtures coated to the substrates are shown in Table 1.

Using these emulsions and materials, the multi-layered heat-developable color photosensitive materials 201 (Comparative Example 1), 202 (Example 1), 203 (Comparative Example 2) and 204 (Example 2) shown in Table 1 were produced.

TABLE 1

| Layer | Composition | Comparative Example 1 Photosensitive Material 201 | Example 1 Photosensitive Material 202 |
|---|---|---|---|
| Protective Layer | Lime-Treated Gelatin | 914 mg | 914 mg |
| | Matting Agent (Silica) | 50 mg | 50 mg |
| | Surfactant (a) | 30 mg | 30 mg |
| | Surfactant (b) | 40 mg | 40 mg |
| | Water-Soluble Polymer (c) | 15 mg | 15 mg |
| | Hardening Agent (t) | 110 mg | 110 mg |
| Intermediate Layer | Lime-Treated Gelatin | 461 mg | 461 mg |
| | Surfactant (b) | 5 mg | 5 mg |
| | Salicylanilide | 200 mg | 200 mg |
| | Formalin Scavenger (d) | 150 mg | 150 mg |
| | Water-Soluble Polymer (c) | 15 mg | 15 mg |
| High-Sensitivity, Yellow Color-Forming Layer | Lime-Treated Gelatin | 1750 mg | 1750 mg |
| | Emulsion A-1b (Amount of Silver) | 550 mg | 550 mg |
| | Silver Benzotriazole (Amount of Silver) | 165 mg | 165 mg |
| | Silver Salt of 1-Phenyl-5-Mercaptotetrazole | 437 mg | 437 mg |
| | Yellow Coupler (CPY-1) | 179 mg | 179 mg |
| | DEVP-A | 230 mg | 230 mg |
| | Development Accelerator (X) | 17.9 mg | 17.9 mg |
| | High-Boiling-Point Organic Solvent (e) | 90 mg | 90 mg |
| | High-Boiling-Point Organic Solvent (f) | 115 mg | 115 mg |
| | Surfactant (g) | 27 mg | 27 mg |
| | Salicylanilide | 200 mg | 200 mg |
| | Water-Soluble Polymer (c) | 1 mg | 1 mg |
| Medium-Sensitivity, Yellow Color-Forming Layer | Lime-Treated Gelatin | 1470 mg | 1470 mg |
| | Emulsion A-2b (Amount of Silver) | 263 mg | 263 mg |
| | Silver Benzotriazole (Amount of Silver) | 79 mg | 79 mg |
| | Silver Salt of 1-Phenyl-5-Mercaptotetrazole | 209 mg | 209 mg |
| | Yellow Coupler (CPY-2) | 269 mg | 269 mg |
| | DEVP-A | 380 mg | 380 mg |
| | Development Accelerator (X) | 26.9 mg | 26.9 mg |

TABLE 1-continued

| | | | |
|---|---|---|---|
| | High-Boiling-Point Organic Solvent (e) | 134 mg | 134 mg |
| | High-Boiling-Point Organic Solvent (f) | 190 mg | 190 mg |
| | Surfactant (g) | 26 mg | 26 mg |
| | Salicylanilide | 300 mg | 300 mg |
| | Water-Soluble Polymer (c) | 2 mg | 2 mg |
| Low-sensitivity, Yellow Color-Forming Layer | Lime-Treated Gelatin | 1680 mg | 1680 mg |
| | Emulsion A-3b (Amount of Silver) | 240 mg | 240 mg |
| | Silver Benzotriazole (Amount of Silver) | 72 mg | 72 mg |
| | Silver Salt of 1-Phenyl-5-Mercaptotetrazole | 191 mg | 191 mg |
| | Yellow Coupler (CPY-2) | 448 mg | 448 mg |
| | DEVP-A | 590 mg | 590 mg |
| | Development Accelerator (X) | 44.8 mg | 44.8 mg |
| | High-Boiling-Point Organic Solvent (e) | 224 mg | 224 mg |
| | High-Boiling Point Organic Solvent (f) | 295 mg | 295 mg |
| | Surfactant (g) | 30 mg | 30 mg |
| | Salicylanilide | 600 mg | 600 mg |
| | Water-Soluble Polymer (c) | 3 mg | 3 mg |
| Intermediate Layer (Yellow Filter Layer) | Lime-Treated Gelatin | 1000 mg | 1000 mg |
| | Surfactant (b) | 15 mg | 15 mg |
| | Surfactant (g) | 60 mg | 60 mg |
| | Stearyl Alcohol | 400 mg | 80 mg |
| | Leuco Dye (L1) | 200 mg | 200 mg |
| | Developer (SD-1) | 200 mg | 200 mg |
| | Polymer Latex (P-13) | — | 900 mg |
| | Water-Soluble Polymer (c) | 15 mg | 15 mg |
| High-sensitivity, Magenta Color-Forming Layer | Lime-Treated Gelatin | 781 mg | 781 mg |
| | Emulsion A-1g (Amount of Silver) | 488 mg | 488 mg |
| | Silver Benzotriazole (Amount of Silver) | 146 mg | 146 mg |
| | Silver Salt of 1-Phenyl-5-Mercaptotetrazole | 388 mg | 388 mg |
| | Magenta Coupler (CPM-1) | 47 mg | 47 mg |
| | Magenta Coupler (CPM-2) | 24 mg | 24 mg |
| | DEVP-A | 74 mg | 74 mg |
| | Development Accelerator (X) | 4.7 mg | 4.7 mg |
| | High-Boiling-Point Organic Solvent (e) | 75 mg | 75 mg |
| | Surfactant (g) | 8 mg | 8 mg |
| | Salicylanilide | 100 mg | 100 mg |
| | Water-Soluble Polymer (c) | 8 mg | 8 mg |
| Medium-Sensitivity, Magenta Color-Forming Layer | Lime-Treated Gelatin | 659 mg | 659 mg |
| | Emulsion A-2g (Amount of Silver) | 492 mg | 492 mg |
| | Silver Benzotriazole (Amount of Silver) | 148 mg | 148 mg |
| | Silver Salt of 1-Phenyl-5-Mercaptotetrazole | 391 mg | 391 mg |
| | Magenta Coupler (CPM-3) | 94 mg | 94 mg |
| | Magenta Coupler (CPM-2) | 48 mg | 48 mg |
| | DEVP-A | 140 mg | 140 mg |
| | Development Accelerator (X) | 14.1 mg | 14.1 mg |
| | High-Boiling-Point Organic Solvent (e) | 150 mg | 150 mg |
| | Surfactant (g) | 11 mg | 11 mg |
| | Salicylanilide | 80 mg | 80 mg |
| | Water-Soluble Polymer (c) | 14 mg | 14 mg |
| Low-Sensitivity, Magenta Color-Forming Layer | Lime-Treated Gelatin | 711 mg | 711 mg |
| | Emulsion A-3g (Amount of Silver) | 240 mg | 240 mg |
| | Silver Benzotriazole (Amount of Silver) | 72 mg | 72 mg |
| | Silver Salt of 1-Phenyl-5-Mercaptotetrazole | 191 mg | 191 mg |
| | Magenta Coupler (CPM-3) | 234 mg | 234 mg |
| | Magenta Coupler (CPM-2) | 119 mg | 119 mg |
| | DEVP-A | 349 mg | 349 mg |
| | Development Accelerator (X) | 35.3 mg | 35.3 mg |
| | High-Boiling-Point Organic Solvent (e) | 376 mg | 376 mg |
| | Surfactant (g) | 29 mg | 29 mg |
| | Salicylanilide | 80 mg | 80 mg |

TABLE 1-continued

| | | | |
|---|---|---|---|
| | Water-Soluble Polymer (c) | 14 mg | 14 mg |
| Intermediate Layer (Magenta Filter Layer) | Lime-Treated Gelatin | 600 mg | 600 mg |
| | Surfactant (g) | 15 mg | 15 mg |
| | Surfactant (h) | 24 mg | 24 mg |
| | Stearyl Alcohol | 150 mg | 30 mg |
| | Leuco Dye (L2) | 75 mg | 75 mg |
| | Developer (SD-1) | 75 mg | 75 mg |
| | Polymer Latex (P-13) | — | 450 mg |
| | Formalin Scavenger (d) | 300 mg | 300 mg |
| | Water-Soluble Polymer (c) | 15 mg | 15 mg |
| High-Sensitivity, Cyan Color-Forming Layer | Lime-Treated Gelatin | 842 mg | 842 mg |
| | Emulsion A-1r (Amount of Silver) | 550 mg | 550 mg |
| | Silver Benzotriazole (Amount of Silver) | 165 mg | 165 mg |
| | Silver Salt of 1-Phenyl-5-Mercaptotetrazole | 437 mg | 437 mg |
| | Cyan Coupler (CPC-1) | 19 mg | 19 mg |
| | Cyan Coupler (CPC-2) | 44 mg | 44 mg |
| | DEVP-A | 91 mg | 91 mg |
| | Development Accelerator (X) | 6.2 mg | 6.2 mg |
| | High-Boiling-Point Organic Solvent (e) | 70 mg | 70 mg |
| | Surfactant (g) | 5 mg | 5 mg |
| | Salicylanilide | 80 mg | 80 mg |
| | Water-Soluble Polymer (c) | 18 mg | 18 mg |
| Medium-Sensitivity, Cyan Color-Forming Layer | Lime-Treated Gelatin | 475 mg | 475 mg |
| | Emulsion A-2r (Amount of Silver) | 600 mg | 600 mg |
| | Silver Benzotriazole (Amount of Silver) | 180 mg | 180 mg |
| | Silver Salt of 1-Phenyl-5-Mercaptotetrazole | 477 mg | 477 mg |
| | Cyan Coupler (CPC-3) | 56 mg | 56 mg |
| | Cyan Coupler (CPC-4) | 131 mg | 131 mg |
| | DEVP-A | 209 mg | 209 mg |
| | Development Accelerator (X) | 18.7 mg | 18.7 mg |
| | High-Boiling-Point Organic Solvent (e) | 209 mg | 209 mg |
| | Surfactant (g) | 10 mg | 10 mg |
| | Salicylanilide | 50 mg | 50 mg |
| | Water-Soluble Polymer (c) | 15 mg | 15 mg |
| Low-Sensitivity, Cyan Color-Forming Layer | Lime-Treated Gelatin | 825 mg | 825 mg |
| | Emulsion A-3r (Amount of Silver) | 300 mg | 300 mg |
| | Silver Benzotriazole (Amount of Silver) | 90 mg | 90 mg |
| | Silver Salt of 1-Phenyl-5-Mercaptotetrazole | 239 mg | 239 mg |
| | Cyan Coupler (CPC-3) | 99 mg | 99 mg |
| | Cyan Coupler (CPC-4) | 234 mg | 234 mg |
| | DEVP-A | 373 mg | 373 mg |
| | Development Accelarator (X) | 33.2 mg | 33.2 mg |
| | High-Boiling-Point Organic Solvent (e) | 372 mg | 372 mg |
| | Surfactant (g) | 17 mg | 17 mg |
| | Salicylanilide | 100 mg | 100 mg |
| | Water-Soluble Polymer (c) | 10 mg | 10 mg |
| Antihalation Layer | Lime-Treated Gelatin | 1500 mg | 1500 mg |
| | Surfactant (g) | 35 mg | 35 mg |
| | Stearyl Alcohol | 800 mg | 160 mg |
| | Leuco Dye (L3) | 400 mg | 400 mg |
| | Developer (SD-1) | 400 mg | 400 mg |
| | Polymer Latex (P-13) | — | 2400 mg |
| | Surfactant (b) | 120 mg | 120 mg |
| | Water-Soluble Polymer (c) | 15 mg | 15 mg |
| | Transparent PEN Substrate (96 μm) | | |

| Layer | Composition | Comparative Example 2 Photosensitive Material 203 | Example 2 Photosensitive Material 204 |
|---|---|---|---|
| Protective Layer | Lime-Treated Gelatin | 914 mg | 914 mg |
| | Matting Agent (Silica) | 50 mg | 50 mg |
| | Surfactant (a) | 30 mg | 30 mg |
| | Surfactant (b) | 40 mg | 40 mg |
| | Water-Soluble Polymer (c) | 15 mg | 15 mg |
| | Hardening Agent (t) | 110 mg | 110 mg |

TABLE 1-continued

| | | | |
|---|---|---|---|
| Intermediate Layer | Lime-Treated Gelatin | 461 mg | 461 mg |
| | Surfactant (b) | 5 mg | 5 mg |
| | Salicylanilide | 200 mg | 200 mg |
| | Formalin Scavenger (d) | 150 mg | 150 mg |
| | Water-Soluble Polymer (c) | 15 mg | 15 mg |
| High-Sensitivity, Yellow Color-Forming Layer | Lime-Treated Gelatin | 1750 mg | 1750 mg |
| | Emulsion A-1b (Amount of Silver) | 550 mg | 550 mg |
| | Silver Benzotriazole (Amount of Silver) | 165 mg | 165 mg |
| | Silver Salt of 1-Dodecyl-5-Mercaptotetrazole | 12 mg | 12 mg |
| | Yellow Coupler (CPY-1) | 179 mg | 179 mg |
| | DEVP-B | 230 mg | 230 mg |
| | Development Accelerator (X) | 17.9 mg | 17.9 mg |
| | High-Boiling-Point Organic Solvent (e) | 90 mg | 90 mg |
| | High-Boiling-Point Organic Solvent (f) | 115 mg | 115 mg |
| | Surfactant (g) | 27 mg | 27 mg |
| | Salicylanilide | 200 mg | 200 mg |
| | Water-Soluble Polymer (c) | 1 mg | 1 mg |
| Medium-Sensitivity, Yellow Color-Forming Layer | Lime-Treated Gelatin | 1470 mg | 1470 mg |
| | Emulsion A-2b (Amount of Silver) | 263 mg | 263 mg |
| | Silver Benzotriazole (Amount of Silver) | 79 mg | 79 mg |
| | Silver Salt of 1-Dodecyl-5-Mercaptotetrazole | 6 mg | 6 mg |
| | Yellow Coupler (CPY-2) | 269 mg | 269 mg |
| | DEVP-B | 380 mg | 380 mg |
| | Development Accelerator (X) | 26.9 mg | 26.9 mg |
| | High-Boiling-Point Organic Solvent (e) | 134 mg | 134 mg |
| | High-Boiling-Point Organic Solvent (f) | 190 mg | 190 mg |
| | Surfactant (g) | 26 mg | 26 mg |
| | Salicylanilide | 300 mg | 300 mg |
| | Water-Soluble Polymer +B240 (c) | 2 mg | 2 mg |
| Low-sensitivity, Yellow Color-Forming Layer | Lime-Treated Gelatin | 1680 mg | 1680 mg |
| | Emulsion A-3b (Amount of Silver) | 240 mg | 240 mg |
| | Silver Benzotriazole (Amount of Silver) | 72 mg | 72 mg |
| | Silver Salt of 1-Dodecyl-5-Mercaptotetrazole | 5 mg | 5 mg |
| | Yellow Coupler (CPY-2) | 448 mg | 448 mg |
| | DEVP-B | 590 mg | 590 mg |
| | Development Accelerator (X) | 44.8 mg | 44.8 mg |
| | High-Boiling-Point Organic Solvent (e) | 224 mg | 224 mg |
| | High-Boiling Point Organic Solvent (f) | 295 mg | 295 mg |
| | Surfactant (g) | 30 mg | 30 mg |
| | Salicylanilide | 600 mg | 600 mg |
| | Water-Soluble Polymer (c) | 3 mg | 3 mg |
| Intermediate Layer (Yellow Filter Layer) | Lime-Treated Gelatin | 1000 mg | 1000 mg |
| | Surfactant (b) | 15 mg | 15 mg |
| | Surfactant (g) | 60 mg | 60 mg |
| | Stearyl Alcohol | 400 mg | 80 mg |
| | Leuco Dye (L1) | 200 mg | 200 mg |
| | Developer (SD-1) | 200 mg | 200 mg |
| | Polymer Latex (P-13) | — | 900 mg |
| | Water-Soluble Polymer (c) | 15 mg | 15 mg |
| High-sensitivity, Magenta Color-Forming Layer | Lime-Treated Gelatin | 781 mg | 781 mg |
| | Emulsion A-1g (Amount of Silver) | 488 mg | 488 mg |
| | Silver Benzotriazole (Amount of Silver) | 146 mg | 146 mg |
| | Silver Salt of 1-Dodecyl-5-Mercaptotetrazole | 11 mg | 11 mg |
| | Magenta Coupler (CPM-1) | 47 mg | 47 mg |
| | Magenta Coupler (CPM-2) | 24 mg | 24 mg |
| | DEVP-B | 74 mg | 74 mg |
| | Development Accelerator (X) | 4.7 mg | 4.7 mg |
| | High-Boiling-Point Organic Solvent (e) | 75 mg | 75 mg |
| | Surfactant (g) | 8 mg | 8 mg |

TABLE 1-continued

| | | | |
|---|---|---|---|
| | Salicylanilide | 100 mg | 100 mg |
| | Water-Soluble Polymer (c) | 8 mg | 8 mg |
| Medium-Sensitivity, Magenta Color-Forming Layer | Lime-Treated Gelatin | 659 mg | 659 mg |
| | Emulsion A-2g (Amount of Silver) | 492 mg | 492 mg |
| | Silver Benzotriazole (Amount of Silver) | 148 mg | 148 mg |
| | Silver Salt of 1-Dodecyl-5-Mercaptotetrazole | 11 mg | 11 mg |
| | Magenta Coupler (CPM-3) | 94 mg | 94 mg |
| | Magenta Coupler (CPM-2) | 48 mg | 48 mg |
| | DEVP-B | 140 mg | 140 mg |
| | Development Accelerator (X) | 14.1 mg | 14.1 mg |
| | High-Boiling-Point Organic Solvent (e) | 150 mg | 150 mg |
| | Surfactant (g) | 11 mg | 11 mg |
| | Salicylanilide | 80 mg | 80 mg |
| | Water-Soluble Polymer (c) | 14 mg | 14 mg |
| Low-Sensitivity, Magenta Color-Forming Layer | Lime-Treated Gelatin | 711 mg | 711 mg |
| | Emulsion A-3g (Amount of Silver) | 240 mg | 240 mg |
| | Silver Benzotriazole (Amount of Silver) | 72 mg | 72 mg |
| | Silver Salt of 1-Dodecyl-5-Mercaptotetrazole | 5 mg | 5 mg |
| | Magenta Coupler (CPM-3) | 234 mg | 234 mg |
| | Magenta Coupler (CPM-2) | 119 mg | 119 mg |
| | DEVP-B | 349 mg | 349 mg |
| | Development Accelerator (X) | 35.3 mg | 35.3 mg |
| | High-Boiling-Point Organic Solvent (e) | 376 mg | 376 mg |
| | Surfactant (g) | 29 mg | 29 mg |
| | Salicylanilide | 80 mg | 80 mg |
| | Water-Soluble Polymer (c) | 14 mg | 14 mg |
| Intermediate Layer (Magenta Filter Layer) | Lime-Treated Gelatin | 850 mg | 850 mg |
| | Surfactant (g) | 15 mg | 15 mg |
| | Surfactant (h) | 24 mg | 24 mg |
| | Stearyl Alcohol | 300 mg | 30 mg |
| | Leuco Dye (L2) | 75 mg | 75 mg |
| | Developer (SD-1) | 75 mg | 75 mg |
| | Polymer Latex (P-13) | — | 450 mg |
| | Formalin Scavenger (d) | 300 mg | 300 mg |
| | Water-Soluble Polymer (c) | 15 mg | 15 mg |
| High-Sensitivity, Cyan Color-Forming Layer | Lime-Treated Gelatin | 842 mg | 842 mg |
| | Emulsion A-1r (Amount of Silver) | 550 mg | 550 mg |
| | Silver Benzotriazole (Amount of Silver) | 165 mg | 165 mg |
| | Silver Salt of 1-Dodecyl-5-Mercaptotetrazole | 12 mg | 12 mg |
| | Cyan Coupler (CPC-1) | 19 mg | 19 mg |
| | Cyan Coupler (CPC-2) | 44 mg | 44 mg |
| | DEVP-B | 91 mg | 91 mg |
| | Development Accelerator (X) | 6.2 mg | 6.2 mg |
| | High-Boiling-Point Organic Solvent (e) | 70 mg | 70 mg |
| | Surfactant (g) | 5 mg | 5 mg |
| | Salicylanilide | 80 mg | 80 mg |
| | Water-Soluble Polymer (c) | 18 mg | 18 mg |
| Medium-Sensitivity, Cyan Color-Forming Layer | Lime-Treated Gelatin | 475 mg | 475 mg |
| | Emulsion A-2r (Amount of Silver) | 600 mg | 600 mg |
| | Silver Benzotriazole (Amount of Silver) | 180 mg | 180 mg |
| | Silver Salt of 1-Dodecyl-5-Mercaptotetrazole | 13 mg | 13 mg |
| | Cyan Coupler (CPC-3) | 56 mg | 56 mg |
| | Cyan Coupler (CPC-4) | 131 mg | 131 mg |
| | DEVP-B | 209 mg | 209 mg |
| | Development Accelerator (X) | 18.7 mg | 18.7 mg |
| | High-Boiling-Point Organic Solvent (e) | 209 mg | 209 mg |
| | Surfactant (g) | 10 mg | 10 mg |
| | Salicylanilide | 50 mg | 50 mg |
| | Water-Soluble Polymer (c) | 15 mg | 15 mg |
| Low-Sensitivity, Cyan Color-Forming Layer | Lime-Treated Gelatin | 825 mg | 825 mg |
| | Emulsion A-3r (Amount of Silver) | 300 mg | 300 mg |
| | Silver Benzotriazole | 90 mg | 90 mg |

TABLE 1-continued

| | | | |
|---|---|---|---|
| | (Amount of Silver) | | |
| | Silver Salt of 1-Dodecyl-5-Mercaptotetrazole | 7 mg | 7 mg |
| | Cyan Coupler (CPC-3) | 99 mg | 99 mg |
| | Cyan Coupler (CPC-4) | 234 mg | 234 mg |
| | DEVP-B | 373 mg | 373 mg |
| | Development Accelerator (X) | 33.2 mg | 33.2 mg |
| | High-Boiling-Point Organic Solvent (e) | 372 mg | 372 mg |
| | Surfactant (g) | 17 mg | 17 mg |
| | Salicylanilide | 100 mg | 100 mg |
| | Water-Soluble Polymer (c) | 10 mg | 10 mg |
| Antihalation Layer | Lime-Treated Gelatin | 1500 mg | 1500 mg |
| | Surfactant (g) | 14 mg | 14 mg |
| | Stearyl Alcohol | 800 mg | 160 mg |
| | Leuco Dye (L3) | 400 mg | 400 mg |
| | Developer (SD-1) | 400 mg | 400 mg |
| | Polymer Latex (P-13) | — | 2400 mg |
| | Surfactant (b) | 120 mg | 120 mg |
| | Water-Soluble Polymer (c) | 15 mg | 15 mg |
| | Transparent PEN Substrate (96 μm) | | |

Surfactant (a)

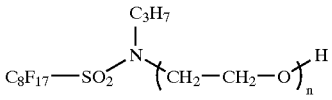

n = 14–16

Surfactant (b)

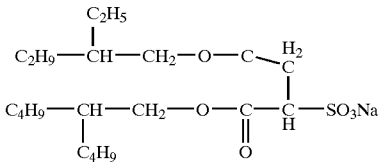

Water-Soluble Polymer (c)

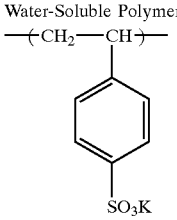

Hardening Agent (t)

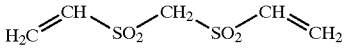

Formalin Scavenger (d)

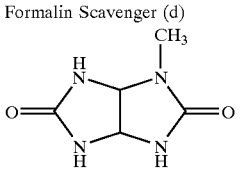

Surfactant (g)
Alkanol XC

J. Image Forming and Evaluation

Each of the silver halide photosensitive materials 201 to 204 was then cut to a 135-negative-film size, punched and incorporated into a camera to take pictures of a human being and Macbeth chart. After the exposure, each sample was heated at 150° C. for 15 seconds by a heat drum for thermal development. Image formed on each thermally developed, silver halide photosensitive material was read by a digital image-reading device "Frontier SP-1500" available from Fuji Photo Film Co., Ltd., subjected to image processing by a workstation, and output by a thermal development printer "PICTROGRAPHY 3000" available from Fuji Photo Film Co., Ltd.

The photosensitive materials 201 to 204 were read at room temperature (25° C.). With respect to the photosensitive materials 201 and 203, the image was read with warm air sent to the surface of the photosensitive materials by a dryer, such that the surface temperature was kept at 65 to 70° C. The image was subjected to color correction for increasing chroma with color reproduction maintained by digital signal processing using a Macbeth chart, to provide the printed image with high chroma.

In the room-temperature-reading image of the photosensitive materials 201 and 203 (Comparative Examples 1 and 2), their reading time was 3 to 4 times that of Examples 1 and 2, because the filter dye and the antihalation dye were not substantially discolored in Comparative Examples 1 and 2. Further, there were large reading noises, resulting in rough image, in Comparative Examples 1 and 2. The reading image of the photosensitive materials 201 and 203 at a high in a range of (65° C. to 70° C.) was rough image with large reading noises, though the lowermost concentrations of the photosensitive materials were lowered.

On the other hand, in the cases of the photosensitive materials 202 and 204 of Examples 1 and 2 read at room temperature, 80% or more of the filter dye and the antihalation dye were discolored, resulting in decrease in the minimum concentrations of the photosensitive materials and thus shortened reading time and improved image. Particularly, the photosensitive material 204 (Example 2) was excellent in both color reproduction and sharpness.

As described above in detail, using the heat-responsive-discolorable coloring composition in the filter layer or the antihalation layer of the heat-developable photosensitive material, the lowermost concentration of the photosensitive material decreases after treatment, whereby image with excellent quality can be obtained even by a simple reading apparatus for converting to digital signals.

What is claimed is:

1. A silver halide photosensitive material comprising a substrate, a heat-responsive-discolorable coloring layer and a photosensitive layer coated thereon, wherein said heat-responsive-discolorable coloring layer is composed of a heat-responsive-discolorable coloring composition, which is colored at a temperature lower than its discoloration initiation temperature (T); which is substantially discolored at a temperature equal to or higher than the discoloration initiation temperature (T); and which does not recover its color once discolored, even when its temperature is lowered to a temperature lower than the discoloration initiation temperature (T) again, said discoloration initiation temperature (T) being 60 to 200° C., and said heat-responsive-discolorable coloring composition comprising a polymer having a glass transition temperature (Tg) of 60 to 200° C., and said photosensitive layer comprising a silver halide, dye-providing compound and a binder, the heat-responsive-discolorable coloring composition being heated to a temperature equal to or hither than the glass transition temperature (Tg) of the polymer, whereby the polymer hinders interaction between an electron-donating color former and a color developing agent, resulting in discoloration.

2. The silver halide photosensitive material according to claim 1, wherein said heat-responsive-discolorable coloring composition comprises an electron-donating, organic color former and an acidic compound.

3. The silver halide photosensitive material according to claim 2, wherein said acidic compound is a phenol compound.

4. The silver halide photosensitive material according to claim 1, wherein said polymer is in the form of dispersed particles having an average particle size of 0.01 $\mu$m to 1 $\mu$m.

5. The silver halide photosensitive material according to claim 1, wherein said photosensitive layer comprises an organic silver salt.

6. The silver halide photosensitive material according to claim 1, wherein said heat-responsive-discolorable coloring composition contains a hindered phenol.

7. The silver halide photosensitive material according to claim 2, wherein said heat-responsive-discolorable coloring composition further contains a hindered phenol.

8. A method for forming an image comprising the steps of exposing a silver halide photosensitive material, and heating the exposed silver halide photosensitive material at 60 to 200° C. to form an image thereon, said silver halide photosensitive material comprising a substrate, a heat-responsive-discolorable coloring layer and a photosensitive layer coated thereon, wherein said heat-responsive-discolorable coloring layer is composed of a heat-responsive-discolorable coloring composition, which is colored at a temperature lower than its discoloration initiation temperature (T); which is substantially discolored at a temperature equal to or higher than the discoloration initiation temperature (T); and which does not recover its color once discolored, even when its temperature is lowered to a temperature lower than the discoloration initiation temperature (T) again, said discoloration initiation temperature (T) being 60 to 200° C., and said heat-responsive-discolorable coloring composition comprising a polymer having a glass transition temperature (Tg) of 60 to 200° C., and said photosensitive layer comprising a silver halide, dye-providing compound and a binder, the heat responsive-discolorable coloring composition being heated to a temperature equal to or higher than the glass transition temperature (Tg) of the polymer, whereby the polymer hinders interaction between an electron-donating color former and an color developing agent, resulting in discoloration.

9. The method for forming an image according to claim 8, wherein said image formed on said silver halide photosensitive material is optically read at a temperature of 60° C. or lower to produce a digital image information.

* * * * *